US008037792B2

(12) United States Patent
Sasaki et al.

(10) Patent No.: US 8,037,792 B2
(45) Date of Patent: Oct. 18, 2011

(54) MOUNTINGS FOR RIVING KNIVES OF TABLE SAWS

(75) Inventors: Katsuhiko Sasaki, Anjo (JP); Takehiko Sugiura, Anjo (JP); Masahiko Inai, Anjo (JP); Masaaki Uchida, Anjo (JP)

(73) Assignee: Makita Corporation, Anjo (JP)

( * ) Notice: Subject to any disclaimer, the term of this patent is extended or adjusted under 35 U.S.C. 154(b) by 62 days.

(21) Appl. No.: 12/428,083

(22) Filed: Apr. 22, 2009

(65) Prior Publication Data

US 2009/0205472 A1 Aug. 20, 2009

Related U.S. Application Data

(62) Division of application No. 11/076,989, filed on Mar. 11, 2005, now Pat. No. 7,540,223.

(30) Foreign Application Priority Data

Mar. 12, 2004 (JP) ..... 2004-070679
Mar. 16, 2004 (JP) ..... 2004-074367
Mar. 17, 2004 (JP) ..... 2004-075584

(51) Int. Cl.
*B27G 19/08* (2006.01)

(52) U.S. Cl. ..... 83/102.1; 83/477.2; 83/478

(58) Field of Classification Search ..... 83/102, 83/102.1, 103–107, 477.2, 478, 483, DIG. 1; 30/371, 161; 144/182–184, 40
See application file for complete search history.

(56) References Cited

U.S. PATENT DOCUMENTS

| | | | | |
|---|---|---|---|---|
| 615,833 | A | | 12/1898 | Fisher |
| 713,196 | A | | 11/1902 | Bennett |
| 1,244,187 | A | | 10/1917 | Frisbie |
| 2,593,596 | A | | 4/1952 | Olson |
| 3,943,934 | A | | 3/1976 | Bent |
| 4,159,568 | A | * | 7/1979 | Berner ..... 30/124 |
| 4,386,609 | A | | 6/1983 | Mongeon |
| 4,615,247 | A | | 10/1986 | Berkeley |
| 4,721,023 | A | | 1/1988 | Bartlett et al. |
| 5,231,906 | A | | 8/1993 | Kogej |
| 5,979,065 | A | | 11/1999 | Hsu |

(Continued)

FOREIGN PATENT DOCUMENTS

EP 0 883 459 B1 12/1998

(Continued)

OTHER PUBLICATIONS

Japanese Office Action dated Aug. 25, 2009.

(Continued)

*Primary Examiner* — Phong Nguyen
(74) *Attorney, Agent, or Firm* — Oliff & Berridge, PLC

(57) ABSTRACT

A device for mounting a cover of a cutting blade to a riving knife may have an engaging member for releasably engaging at least a part of the riving knife from both sides, in a direction of thickness of the riving knife. The engaging member is manually operable without any additional tools. A device for mounting a riving knife to a table saw may include a manually operable lock member and a biasing member. The biasing member is arranged and constructed to normally bias the lock member towards a lock position. The riving knife may be divided into a first knife portion and a second knife portion. A positioning device may position the first knife portion and the second knife portion substantially within a single plate.

6 Claims, 42 Drawing Sheets

U.S. PATENT DOCUMENTS

| | | | | |
|---|---|---|---|---|
| 5,979,523 | A | 11/1999 | Puzio et al. | |
| 6,085,424 | A | 7/2000 | Mai | |
| 6,170,370 | B1 | 1/2001 | Sommerville | |
| 6,405,624 | B2 | 6/2002 | Sutton | |
| 6,418,829 | B1 | 7/2002 | Pilchowski | |
| 6,840,144 | B2 | 1/2005 | Huang | |
| 2004/0011177 | A1 | 1/2004 | Huang | |
| 2004/0226173 | A1 * | 11/2004 | Ping | 30/161 |

FOREIGN PATENT DOCUMENTS

| | | | |
|---|---|---|---|
| JP | U 49-103094 | | 12/1947 |
| JP | U 6-46901 | | 6/1994 |
| JP | U-7-17502 | | 3/1995 |
| JP | 2000-084729 | A | 3/2000 |
| JP | 2000-190125 | A | 7/2000 |
| JP | 2000-326303 | A | 11/2000 |
| JP | 2001-500795 | T | 1/2001 |
| JP | 2002-254403 | A | 9/2002 |
| WO | WO 97/31745 | | 9/1997 |

OTHER PUBLICATIONS

Japanese Office Action for Japanese Patent Application No. 2004-074361 with (English-language translation) dated Mar. 2, 2010.

* cited by examiner

MOUNTINGS FOR RIVING KNIVES OF TABLE SAWS

This is a Division of application Ser. No. 11/076,989, filed Mar. 11, 2005, which in turn claims the benefit of Japanese patent application serial numbers 2004-70679, 2004-74367, and 2004-75584. The disclosures of the prior applications is hereby incorporated by reference herein in their entireties.

BACKGROUND OF THE INVENTION

1. Field of the Invention

The present invention relates to cutting tools and in particular to cutting tools known as "table saws" having a table and a circular rotary cutting blade, so that a workpiece is cut by the cutting blade as it is moved along the table.

2. Description of the Related Art

Conventionally, as shown in FIGS. 51 and 52, a table saw 100 includes a table 102 for placing a workpiece W thereon, and a circular cutting blade 103 rotatably mounted to the table 102. The cutting blade 103 is positioned such that an upper portion of the cutting blade 103 extends above an upper surface of the table 102. The vertical position of the cutter blade 103 relative to the table 102 can be adjusted in order to adjust the height of the cutter blade 103 relative to the upper surface of the table 102. Pressing the workpiece W against the exposed upper portion of the cutter blade 103 can cut a workpiece W placed on the table 102. In this type of table saw 100, a cutting blade having a thickness of about 2 mm is typically used as a cutting blade 103.

Additionally in this kind of table saw 100, a flat, plate-like riving knife 104 is disposed on the rear side (i.e., the right side as viewed in FIGS. 51 and 52) of the cutting blade 103. The riving knife 104 is positioned within the same plane as the cutting blade 103. In general, the riving knife 104 is made of thin steel plate and has a thickness of about 2 mm corresponding to the cutting blade 103. As the workpiece W is moved during a cutting operation by the cutting blade 103, the riving knife 104 may consequently enter the kerf or split formed in the workpiece W by the cutting blade 103. This result is due to the riving knife 104 being positioned within the same plane as the cutting blade 103. The riving knife 104 entering the split helps to prevent cut portions of the workpiece positioned on either side of the cutting blade 103 from contacting the side surfaces of the cutting blade 103. As a result, a phenomenon can be prevented commonly known as "kickback," i.e., causing the workpiece W to be pressed back against the direction of feed by the rotating cutting blade 103.

Typically, in this kind of table saw 100, a safety cover C is provided in order to cover the upper portion of the cutting blade 103 extending above the upper surface of the table 102. For example, the cover C may be formed from a material such as a transparent resin plate. The cover C may serve as a safety cover for preventing foreign objects from unintentionally contacting the cutting blade 103. Additionally, the cover C may also serve as a dust cover for preventing cutting chips produced during the cutting operation from being scattered to the surrounding environment.

When the workpiece W is initially moved during a cutting operation, the cover C may be opened upward as it is lifted by the workpiece W. During the cutting operation, the cover C may then be held so as to rest against the upper surface of the cut workpiece W. As the workpiece W is moved away from a the cutting blade 103 after having been cut, the cover C may again contact the upper surface of the table 102 in order to substantially cover the entire upper portion of the circular saw blade 103 mat extends above the upper surface of the table 102.

In general, the cover C is pivotally supported by a support block 106, via a pin 106*a* that is disposed on the rear side of the support block 106, for the purpose of ensuring mounting strength. The result is that the cover C is mounted to the upper portion of the riving knife 104 via the support block 106. In the known art, the support block 106 is fixedly mounted to the upper portion of the riving knife 104, for example, by means of two fixing screws 107. Therefore, as shown in FIGS. 53 and 54, nuts 108 may be secured to the upper portion of the riving knife 104 by welding, allowing the fixing screws 107 to engage the nuts 108 so as to be tightened. Taking into account the possible vibrations present during a cutting operation, there has been a proposal to securely fix the support block and the riving knife together through the use of rivets or the like, without utilizing bolts and nuts.

In the case of an ordinary cutting or ripping operation, the above known mounting structures of the cover C may not cause any problems in operation. However, in case of a groove forming or dado operation (i.e., any cut in which the height of the cutting blade 103 above the upper surface of the table 102 is less than the thickness of the workpiece W), the cover C and the support block 106 may be required to be removed due to their otherwise interfering with the workpiece W. For example, a riving knife 104 having nuts 108 as shown may interfere with a groove forming or dado operation since the nuts 108 extend laterally beyond width of the riving knife 104, and consequently, potentially beyond the width of the kerf or split.

Therefore, in the known art for a groove forming operation, not only are the cover C and the support block 106 removed from the table saw, but also the riving knife 104 itself is removed from the table saw. Alternatively, the removal of a single integrated assembly of a cover, a support block and a riving knife, has also been proposed. Such known techniques are disclosed in Japanese Laid-Open Utility Model Publication No. 6-46901 and U.S. Pat. No. 5,979,523.

As described above, the known table saws require troublesome and time-consuming operations for removing and remounting a riving knife in addition to a cover C and support block in order to perform a groove forming operation. Therefore, the overall ease of operability of the table saws is degraded.

In addition, the known table saws also require troublesome and time consuming operations for mounting a riving knife on the table saw. FIG. 55 shows a known table saw 300 having a table 302, a cutting blade 303, and a riving knife 304, corresponding to a table 102, a cutting blade 103, and a riving knife 104 as shown in FIG. 51. In this known table saw 300, a mount 305 is disposed below the table 302. The mount 305 is vertically movable relative to the table 302 along parallel support rods 306. The cutting blade 303 and an electric motor 307 for rotating the cutting blade 303 are mounted to the central portion of the mount 305. The mount 305 has an extension 305*a* on the left side as viewed in FIG. 55. The riving knife 304 is mounted to the extension 305*a* via a mounting bracket 309.

In general, the riving knife 304 is fixed to the mounting bracket 309 by fixing bolts 308. The riving knife 304 can therefore be fixed in position relative to the mounting bracket 309 by tightening the fixing bolts 308. Conversely, the riving knife 304 can be removed from the mounting bracket 309 by loosening the fixing bolts 308. In addition, the vertical position of the riving knife 304 can be adjusted within a predetermined range. Such a known mounting structure is disclosed in U.S. Pat. No. 6,170,370.

However, in order to mount and remove the riving knife 304, a spanner, wrench, Allen key, or the like, type of hand tool is required for tightening and loosening the fixing bolts 308. Therefore, the mounting and removing operations of the riving knife 304 can be troublesome and time-consuming. The operability of the table saw is also degraded in this respect.

Further, as described in connection with the known table saws shown in FIGS. 51 to 54, the nuts 108 are typically secured to the upper portion of the riving knife 104 by welding. The known mounting construction of the cover does not appear to be designed with the consideration that the cover will be removed from the riving knife. Instead, the cover is usually removed from the table saw together with the riving knife in the event of a groove forming operation.

In order to facilitate a groove forming operation, there has been proposed a riving knife divided into a first portion and a second portion that are positioned within a single plane. The cover of the cutting blade is vertically and pivotally supported on the second portion (e.g., located to the rear side of the first portion, or farthest from the cutting blade with respect to the cutting direction) of the riving knife. During the normal cutting operation, the first portion and the second portion cooperate together to operate as a single riving knife. In order to remove the cover for performing a groove forming operation, the cover may be removed together with the second portion of the riving knife. This allows the first portion of the riving knife, disposed on the front side of the second portion with respect to the cutting direction, to be used for a groove forming operation without having to be removed.

However, the divided riving knife causes an additional problem. Generally, in order to perform a riving function the riving knife is made of thin steel plate having a thickness equal to or smaller than the thickness of a cutting blade (i.e., 1.5 mm to 2 mm in general). As a result of such a thin thickness, there is a difficulty in maintaining the positions of the first and second portions of the riving knife within a single plane. In some cases, the separate components of the riving knife may not smoothly enter the split of the workpiece. The operability of the table saw is subsequently degraded in this respect and a cutting operation cannot be efficiently performed.

SUMMARY OF THE INVENTION

It is accordingly an object of the present invention to teach mounting devices relating to riving knives that are improved in operability. It is also an object of the present invention to teach riving knives that are improved in operability.

In one aspect of the present teachings, devices are taught for mounting a cover of a cutting blade to a riving knife. The riving knife has an upper edge and a rear edge. The device includes a support member and an engaging member. The support member serves to support the cover. The engaging member is coupled to the support member and serves to releasably engage the riving knife. The engaging member may releasably engage the riving knife by interfacing with cavities in opposing surfaces of the riving knife.

Because the engaging member engages a cavity formed in at least a part of the riving knife, the riving knife does not require any projections or protrusions that extend laterally outward from beyond the thickness of the riving knife. As a result, by removing the mourning device together with the cover from the riving knife, it is possible to perform a groove forming operation while the riving knife remains mounted to the table saw. As a result, the preparation for a groove forming operation can be quickly and easily performed.

In one embodiment, the support member includes a support bracket for contacting the upper edge of the riving knife. The engaging member includes a joint plate coupled to the support bracket so that the joint plate can move substantially within the same plane as the riving knife. The joint plate includes at least one first joint portion having a thickness equal to or smaller than a thickness of the riving knife. Each first joint portion is engageable with a corresponding first joint recess formed in the upper edge of the riving knife so that the first joint portion is prevented from moving relative to the riving knife with respect to the thickness of the riving knife. The first joint portion does not extend outward from beyond the surface surrounding the corresponding first joint recess in the direction of thickness when a first joint portion is engaged with a first joint recess of the riving knife.

With this arrangement, since the first joint portion does not extend outward from beyond the surface surrounding the corresponding first joint recess, the usable range of the riving knife can be extended to substantially include the entire height of the riving knife. For example, even if the overall height of a riving knife mounted state to a table saw is lower than the height of the cutting blade extending from the surface of the table saw, it may not be necessary to raise the height of the riving knife to a higher position for cutting a workpiece having a large thickness.

Preferably, the joint plate has a plurality of first joint portions for engaging corresponding first joint recesses formed in the riving knife. Each of the first joint portions may have a tapered outer circumferential surface inclined with respect to the direction of thickness of the joint plate. The first joint portions are arranged along a first direction of the joint plate such that the tapered orientations of the outer circumferential surfaces alternate relative to each other in the direction of thickness of the riving knife. In this connection, the riving knife has a plurality of first joint recesses having tapered inner circumferential surfaces corresponding to the outer circumferential surfaces of the first joint portions. The mounting device further includes a pressing device for pressing the support bracket against the top surface of the riving knife. The pressing device forces the joint plate to move upward and away from the riving knife. Consequently, the upper portions of the tapered outer circumferential surfaces of the first joint portions are forced to contact the upper portions of the tapered inner circumferential surfaces of the first joint recesses.

With this arrangement, the joint plate can be reliably fixed in position relative to the riving knife. More specifically, the joint plate can be reliably fixed in the direction of thickness of the riving knife in addition to a direction perpendicular to the direction of thickness.

Preferably, the pressing device is a threaded mechanism that applies a lifting force to the joint plate and an equal and opposite reaction pressing force to the support bracket. Therefore, the joint plate can be further reliably fixed in position due to the tightening force of the threaded mechanism.

In a further embodiment, a substantially V-shaped guide projection is formed along at least a portion of the length of a lower edge of the support bracket. The guide projection is engageable with a corresponding V-shaped guide recess formed in at least a portion of the upper edge of the riving knife. The guide projection and the guide recess engage with each other when the support bracket is pressed against the upper edge of the riving knife. Therefore, the support bracket can be reliably fixed in position relative to the riving knife. Consequently, die joint plate can be reliably held in position relative to the riving knife during and after the application of the lifting force by the pressing device.

In a still further embodiment, the support bracket contacts the rear edge of the riving knife in addition to the upper edge. The joint plate is pivotally mounted to the support bracket. The support bracket includes at least one second joint portion having a thickness equal to or smaller than the thickness of the riving knife. Each second joint portion is engageable with a corresponding second joint recess formed in an alternate edge of the riving knife so that the second joint portion is prevented from moving relative to the riving knife with respect to the thickness and the direction perpendicular to the thickness. The second joint portion does not extend outward from beyond the surface surrounding the corresponding second joint recess in the direction thickness when the second joint portion engages with the second joint recess of the riving knife. The joint plate is operable to engage the first joint portion with the first joint recess and engage the second joint portion with the second joint recess. The support bracket is then fixed in position relative to the riving knife while contacting with two alternate edges, such as the upper edge and the rear edge.

Also with this arrangement, the usable range of the riving knife can be extended to substantially the entire height of the riving knife.

Preferably, the joint plate has a plurality of second joint portions for engaging corresponding second joint recesses formed in the riving knife. Each of the second joint portions has a tapered outer circumferential surface inclined with respect to the direction of thickness of the joint plate. The second joint portions are arranged along a second direction such that the tapered orientations of the outer circumferential surfaces are alternately opposing to each other relative to the direction of thickness. In this connection, the riving knife has a plurality of second joint recesses having tapered inner circumferential surfaces corresponding to the outer circumferential surfaces of the second joint portions.

Preferably, the mounting device further includes a biasing member for normally biasing the joint plate in the direction of engagement between the first joint portions and the first joint recesses. Therefore, the mounting device as well as the cover can be reliably mounted to the riving knife.

Preferably, the mounting device further includes a guide member for engaging the upper edge of the riving knife. The guide member aids in positioning the joint plate relative to the riving knife in the direction of thickness when the joint plate has been pivoted to a position where the first joint portions are disengaged from the first joint recesses. Therefore, the joint plate and consequently the support bracket may be easily and reliably positioned relative to the riving knife before and during the mounting operation. This allows the mounting operation to be efficiently performed.

In a further embodiment, the engaging member includes a pair of resiliently deformable plates defining an insertion recess. The insertion recess has a width configured to permit the insertion of a portion of the riving knife. The mounting device further includes a lever mounted to the support member and operable between a mounting position and a releasing position. The resiliently deformable plates are resiliently deformed so as to narrow the width of the insertion recess, clamping the inserted portion of the riving knife therebetween when the lever is operated to the mounting position.

In order to mount the mounting device to the riving knife using this arrangement, the lever is initially in a releasing position. The operator may move the mounting device such that a portion of the riving knife is inserted into the insertion recess. The operator may then move the lever from the releasing position to the mounting position. The lever causes the resiliently deformable plates to resiliently deform, narrowing the width of the insertion recess and clamping the inserted portion of the riving knife. In order to remove the mounting device from the riving knife, the operator may move the lever to the releasing position. The resiliently deformable plates resiliently recover their original configurations and release the riving knife. In this way, the mounting device can be easily mounted to and removed from the riving knife.

Preferably, the resiliently deformable plates have inner walls opposing to both sides of the riving knife. The projections are formed on the inner walls of the resiliently deformable plates in order to engage corresponding engaging holes formed in the riving knife. Therefore, die mounting device can be further reliably fixed in position relative to the riving knife.

Preferably, pressing projections are formed on the outer walls of the resiliently deformable plates. When the lever is moved to a mounting position the lever engages the pressing projections to urge the resiliently deformable plates to narrow the width of the insertion recess. The riving knife can further be firmly clamped by the resiliently deformable plates using this configuration. In addition, because the lever may move between a position engaging the pressing projections and a position not engaging the pressing projections, an operator should be able to detect different operational feelings distinguishing these two positions. Therefore, the overall operability may be improved in this respect.

In a still further embodiment, the engaging member includes a clamp base that functions to clamp a part of the riving knife against the mount member.

Preferably, the clamp base is coupled to the support member via a threaded shaft extending through the clamp base. The threaded shaft has a first end mounted to the support member and a second end extending outward from the clamp base. The mounting device further includes a nut engaged with the second end of the threaded shaft and a lever joined to the nut. The mounting portion of the riving knife is clamped between the support member and the clamp base as the lever is pivoted to a mounting position, tightening the nut.

In order to mount the mounting device to the riving knife using this configuration, the operator may move the lever such that a portion of the riving knife can be inserted into the insertion recess. The operator may then pivot the lever to the mounting position. Therefore, the nut is tightened, causing the clamp base to move toward the mount base. As a result, a portion of the riving knife may be clamped between the clamp base and the mount base. In order to remove the mounting device from the riving knife, the operator may pivot the lever in the opposite direction. This causes the clamp base to move away from the mount base, releasing the riving knife. Therefore, the mounting device and consequently the cover can be removed from the riving knife. In this way, the mounting device can be easily mounted to and removed from the riving knife.

Alternatively, the support member may include a mount base having an engaging projection and a support projection formed on a surface opposing to the clamp base. The engaging projection may be configured to engage a corresponding engaging recess formed in an upper portion of the riving knife when the support member is mounted to the riving knife. The support projection may be positioned in a position opposite to the engaging projection with respect to the threaded shaft. The clamp base pivots about the support projection as the clamp base moves toward and away from the mount base due to the pivotal operation of the lever. Also with this arrangement, the mounting device and subsequently the cover can be easily mounted and removed from the riving knife.

Preferably, the mount base includes a first contact portion and a second contact portion respectively contacting the upper edge and the rear edge of the riving knife.

In another aspect of the present teachings, table saws are taught that include a mounting device. The table saws further include a table for placing a workpiece thereon so that the cutting blade cuts the workpiece as the workpiece is moved along the table. The riving knife is positioned on the rear side of the cutting blade, substantially within the same plane as the cutting blade.

In a further aspect of the present teachings, devices for mounting riving knives to table saws are taught. The device includes a manually operable lock member movable between a lock position and an unlock position in order to lock and unlock at least a part of the riving knife. A biasing member is arranged and constructed to normally bias the lock member towards the lock position.

Therefore, the riving knife can be easily mounted by the manual operation of the lock member. In addition, because the biasing member normally biases the lock member towards the lock position, the lock member automatically moves to the lock position when released. The operability of the mounting device can therefore be improved.

In one embodiment, the mounting device further includes a mount member defining a mount recess for receiving at least a part of the riving knife. The lock member is a lock pin supported by the mount member. The lock pin is positioned to extend into the mount recess in order to engage the riving knife. The lock pin also prevents the riving knife from being removed from the mount recess when the lock pin is in the lock position.

Therefore, in order to mount the riving knife to the table saw the operator may insert the part of the riving knife into the mount recess and then release the lock pin. This allows the riving knife to be mounted to the mounting device and consequently mounted to the table saw. In order to remove the riving knife from the table saw, the operator may move the lock pin to an unlock position against the biasing force of the biasing member. The riving knife may then be released from the lock pin and the riving knife removed from the mount recess. In this way, the riving knife can be easily removed and mounted by the operation of the lock pin without requiring the use of bolts or the like. Therefore, the preparation for a cutting operation can be easily and rapidly performed.

Preferably, the mount member includes a mount base and a holder plate attached to the mount base. The mount recess is defined between the mount base and the holder plate. The lock pin is axially slidably inserted into the mount member. The lock pin moves between a lock position and an unlock position in the axial direction.

Preferably, the lock pin extends through a lock hole formed in a base portion of the riving knife. The lock pin has a tapered portion that is configured to engage the lock hole when the lock pin is in the lock position.

In another embodiment, the mounting device further includes a mount base and a holder plate defining a mount recess for receiving at least a part of the riving knife. The lock member is the holder plate. The holder plate is movable relative to the mount base in order to clamp and unclamp the riving knife.

Also with this arrangement, the riving knife can be easily mounted to the mounting device by inserting a part of the riving knife into the mount recess and moving the holder plate towards the mount base through the biasing force of the biasing member. Therefore, the preparation for a cutting operation can be easily and rapidly performed.

Preferably, at least one of the mount base and the holder plate is engageable with the riving knife in the direction of thickness of the riving knife. Thereby the one of the mount base and the holder plate can prevent the riving knife from being removed from the mount recess when the holder plate is positioned in a lock position. With this arrangement, the riving knife can be further reliably mounted to the mounting device.

Preferably, the mounting device further includes a threaded shaft rotatably inserted into the mount base. The threaded shaft includes a first end and a second end. An operation lever is threadably engaged with the first end of the threaded shaft. The holder plate is coupled to the second end of the threaded shaft so that the threaded shaft does not rotated relative to the holder plate. A cam mechanism is disposed between the operation lever and the mount base. The threaded shaft moves in an axial direction to move the holder plate to a lock position in response to the pivotal operation of the operation lever.

With this arrangement, in order to mount the riving knife the operator initially positions the operation lever in a releasing position. The operator may then insert a portion of the riving knife into the mount recess. The operator then pivots the lever so that the holder plate is moved to clamp and lock the riving knife against the mount base through the operation of the cam mechanism via the threaded shaft. In order to remove the riving knife, the operator may pivot the lever in the opposite direction. The holder plate is then moved away from the mount base, releasing the riving knife. Therefore, the operation for mounting the riving knife to the table saw can be easily and quickly performed.

Preferably, the mounting device further includes a rotation prevention mechanism disposed between the holder plate and the mount base. The rotation prevention mechanism functions to prevent rotation of the holder plate relative to the mount base.

In a further aspect of the present teachings, table saws are taught that include a mounting device for mounting the riving knife to the table saw, a table for placing a workpiece thereon, a cutting blade for cutting the workpiece, and a motor for driving the cutting blade. The cutting blade cuts the workpiece as the workpiece is moved along the table. The cutting blade, the motor, and the mounting device for mounting the riving knife are attached to another mount such that the riving knife is positioned on the rear side of the cutting blade substantially within the same plane as the cutting blade. An upper portion of the cutting blade and an upper portion of the riving knife extend upward above the surface of the table.

In a still further aspect of the present teachings, riving knives are taught that are adapted to enter a split or kerf formed in a workpiece by a cutting blade of a table saw during a cutting operation. The riving knives may include a first knife pardon and a second knife portion separated from each other and adapted be mounted to the table saw. The first and second knife portions are positioned adjacent each other to form an interconnected riving knife when mounted to the table saw. The mounted first knife portion and second knife portion respectively have a first edge and a second edge opposing each other. A positioning device serves to position the first knife portion and the second knife portion within substantially the same plane.

Because the first and second knife portions can be positioned within substantially the same plane, the first and second knife portions may operate together like a single riving knife formed from a single plate of material. Therefore the two riving knife portions can smoothly enter a split that is formed in the workpiece during the cutting operation. As a result, a phenomenon commonly known as "kickback" can be reliably inhibited or prevented.

In one embodiment, the positioning device includes a projection formed on the first edge of the first knife portion and a recess formed in the second edge of the second knife portion. The projection and the recess engage each other to prevent the first knife portion and the second knife portion from moving relative to each other in the thickness direction.

Preferably, the projection extends along the length of the first edge and has a substantially V-shaped cross section. The recess extends along the length of the second edge and has a substantially V-shaped cross-section conforming to the cross-section of the projection. The positioning device therefore has a relatively simple construction.

In another embodiment, the positioning device includes a positioning member that extends across and along the surfaces of the first knife portion and the second knife portion.

Preferably, the positioning member is movable relative to the first and second knife portions so as to not interfere with the movement of the workpiece along the surface of the table of the table saw during the cutting operation. The cutting operation of the workpiece can therefore be performed without being interfered with by the positioning member.

Preferably, the positioning member is forced to move due to contact with the workpiece as the workpiece is moved during the cutting operation.

The positioning member may pivot, move parallel, or extend and retract relative to a linear path. In one embodiment of the positioning member, the positioning member is pivotally mounted to one of the first and second knife portions. The positioning member pivots within a plane substantially parallel to the surface of the first and second knife portions. The positioning member may therefore hold the first and second knife portions within the same plane during the pivotal movement of the positioning member.

In another embodiment, a biasing member biases the positioning member in order to hold the positioning member in a first position. The positioning member pivots from the first position to a second position against the biasing force of the biasing member as the positioning member is forced to move due to contact with the workpiece. The positioning member may consequently reliably follow the movement of the workpiece. In addition, the positioning member may reliably return to the first position when the cutting operation has been completed.

Preferably, the positioning member has a pivotal axis positioned below the surface of the table. In a first position the positioning member extends substantially vertically upward from the pivotal axis. The positioning member is positioned below or substantially flush with the surface of the table when the positioning member is in a second position. Therefore, the positioning member does not interfere with the movement of the workpiece during a cutting operation, since the positioning member may move below the table as the workpiece is moved.

In another embodiment, the first knife portion has an upper portion extending upward beyond the height of the cutting blade. The positioning member is pivotally mounted to the upper portion of the first knife portion. In the first position, the positioning member extends substantially vertically downward from its mounting location. The positioning member is positioned above the workpiece when the positioning member is in a second position. Therefore, with this arrangement the positioning member does not interfere with the movement of the workpiece during a cutting operation since the positioning member may move above the workpiece as the workpiece is moved.

In a further embodiment, the first knife portion is positioned further from the cutting blade than the second knife portion. The riving knife includes a cover vertically pivotally mounted to an upper portion of the first knife portion in order to cover and uncover the cutting blade. Therefore, in order to perform a groove forming operation, the first knife portion may be removed together with the cover. The groove forming operation can then be readily performed with the aid of the second knife portion.

DETAILED DESCRIPTION OF THE INVENTION

Each of the additional features and teachings disclosed above and below may be utilized separately or in conjunction with other features and teachings to provide improved mounting structures of covers, improved mounting structures of riving knives, and improved riving knives. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Representative embodiments of the present invention will now be described with reference to the drawings. First to fifth representative embodiments relate to mounting structures of covers for mounting to riving knives. Sixth to eleventh representative embodiments relate to mounting structures of riving knives for mounting to table saws. Twelfth to fourteenth representative embodiments relate to configurations of riving knives. Each of the first to fifth representative embodiments may be applied independently or in combination with any one of the sixth to eleventh representative embodiments or any one of the twelfth to fourteenth representative embodiments. Similarly, each of the sixth to eleventh representative embodiments may be applied independently or in combination with any one of the first to fifth representative embodiments or any one of the twelfth to fourteenth representative embodiments. Each of the twelfth to fourteenth representative embodiments may be applied independently or in combination with any one of the first to fifth representative embodiments or any one of the sixth to eleventh representative embodiments.

First Representative Embodiment

Figure 1:
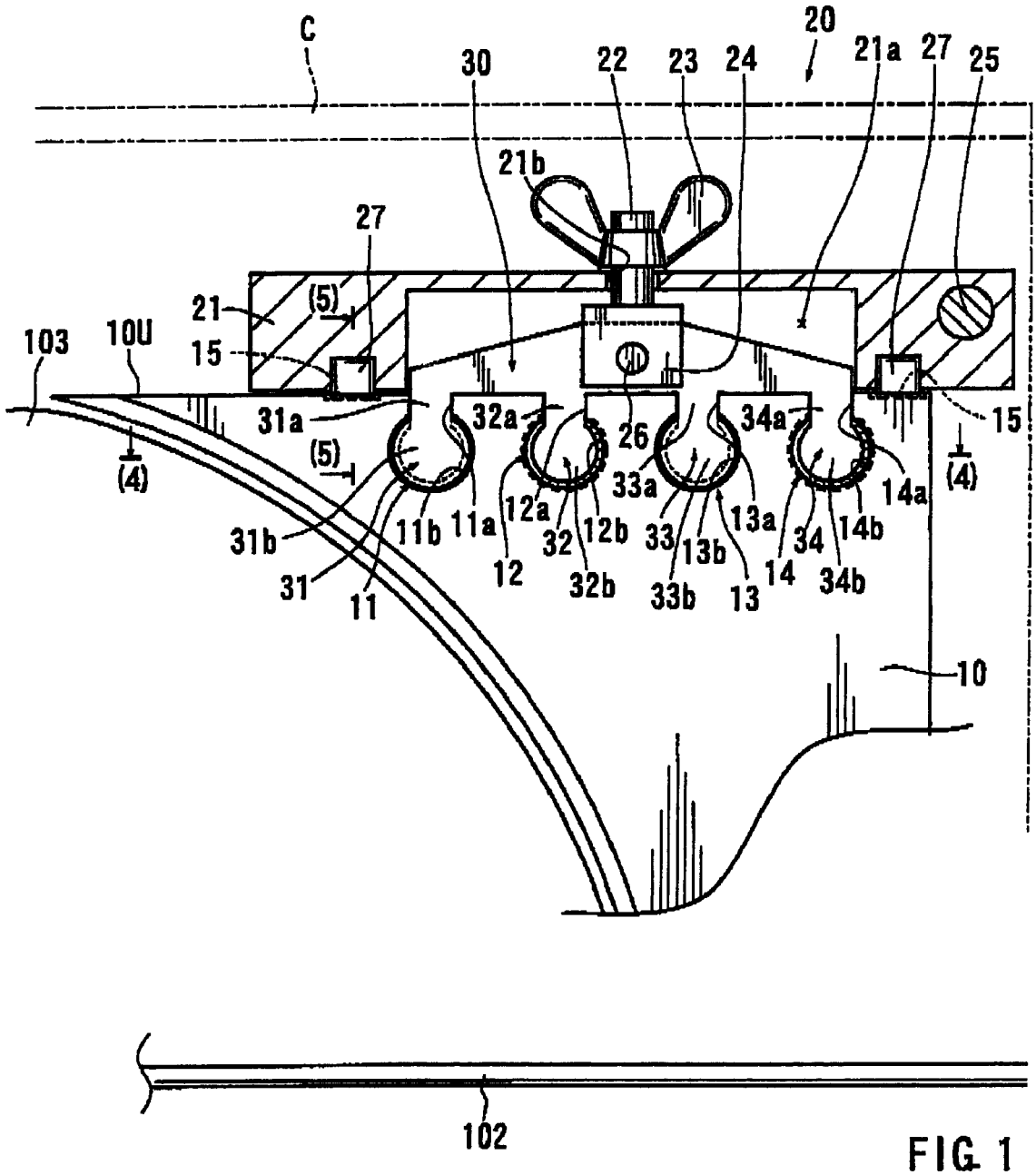
FIG. 1 is a view of a mounting structure according to a first representative embodiment of the present invention and showing a side view of a support device mounted to a riving knife.

The first representative embodiment will be initially described with reference to FIGS. 1 to 5. Referring to FIG. 1, a riving knife 10 is positioned within the same plane as a circular saw blade or cutting blade 103. The riving knife 10 is disposed so as to follow the cutting blade 103 with respect to a cutting direction. The cutting blade 103 has an upper portion that extends above the surface of a table 102. The vertical position of the cutting blade 103 and the riving knife 10 may be adjusted with respect to the table 102 in order to change the cutting depth of the cutting blade 103 with respect to a workpiece. In this representative embodiment, the riving knife 10 has a thickness of about 2.0 mm.

Similar to the cutting blade 103, the riving knife 10 is positioned such that an upper portion of the riving knife 10 extends above the table 102. The riving knife 10 may enter the split formed in the workpiece during the cutting operation so that the width of the split may be maintained at greater than a predetermined width. Therefore, the separate split portions of the workpiece may not contact with the side surfaces of the cutting blade 103. As a result, a phenomenon known as "kickback" may be inhibited or prevented.

In this representative embodiment, a cover C is mounted to the riving knife 10 via a support device 20. The support device 20 includes a support bracket 21 that contacts with an upper end surface 10U of the riving knife 10. The upper end surface 10U of the riving knife 10 has a width of about 2.0 mm. A support rod 25 is fixedly inserted into the rear portion (i.e., the right side as viewed in FIGS. 1 and 2) of the support bracket 21. The support rod 25 pivotally supports the cover C. The cover C serves to substantially cover the entire upper portion of the cutting blade 103, specifically the portion that extends above the table 102, from both sides of the cutting blade 103.

Figure 3:
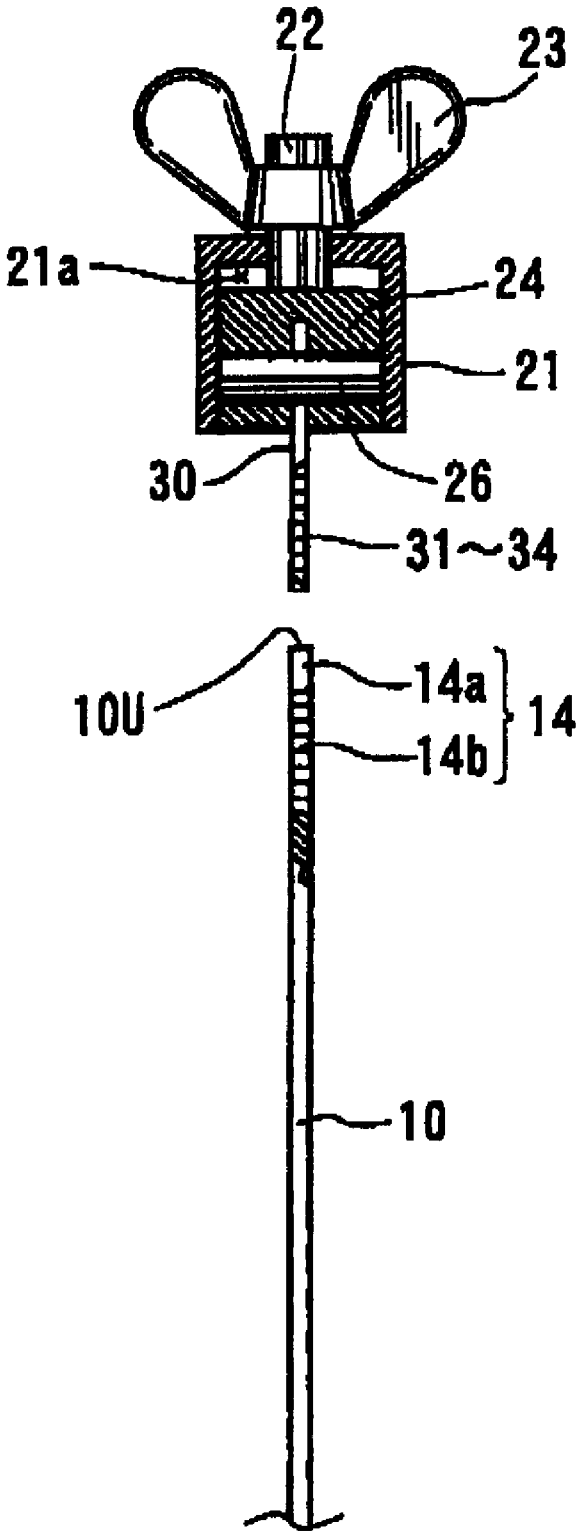
FIG. 3 is a cross-sectional view taken along line (3)-(3) in FIG. 2 and showing the support device and the riving knife as viewed from the front side with respect to the cutting direction.

An accommodation recess 21*a* is formed in the central portion of the lower surface of the support bracket 21 in order to accommodate a joint plate 30. An insertion hole 21*b* is formed in the support bracket 21 so as to extend from the central portion of the bottom of the accommodation recess 21*a* through to the upper surface of the support bracket 21. From below the support bracket 21, a threaded shaft 22 is inserted into the insertion hole 21*b* to extend upward beyond the upper surface of the support bracket 21. A wing nut or butterfly nut 23, for example, threadably engages with the upwardly extended portion of the threaded shaft 22. The lower end of the threaded shaft 22 is secured to a retainer block 24 that is positioned within the accommodation recess 21*a*. As shown in FIG. 3, the retainer block 24 closely and slidably contacts with opposing inner walls (i.e., the right and left inner walls as viewed in FIG. 3) of the accommodation recess 21*a*. The retainer block 24 is therefore vertically movable relative to die accommodation recess 21*a*. However, the retainer block 24 is prevented from rotating within a horizontal plane relative to the support bracket 21. Therefore, the retainer block 24 moves upward towards the bottom of the accommodation recess 21*a* when the butterfly nut 23 is tightened against the threaded shaft 22.

The retainer block 24 supports the joint plate 30 via a joint pin 26. In the representative embodiment, the joint plate 30 is made of metal plate that has a thickness, for example such as 1.5 mm, that is slightly smaller than the thickness of the riving knife 10. As shown in FIG. 1, the joint plate 30 of the representative embodiment has four joint portions 31 to 34 that extend downward from the joint plate 30. The joint portions 31 to 34 respectively have rectangular arms 31*a* to 34*a* and circular engaging portions 31*b* to 34*b*. Each of the engaging portions 31*b* to 34*b* has an outer circumferential surface that is tapered along the thickness of the joint plate 30 so that each of the engaging portions 31*b* to 34*b* has a substantially truncated conical configuration (see FIG. 4).

Figure 2:
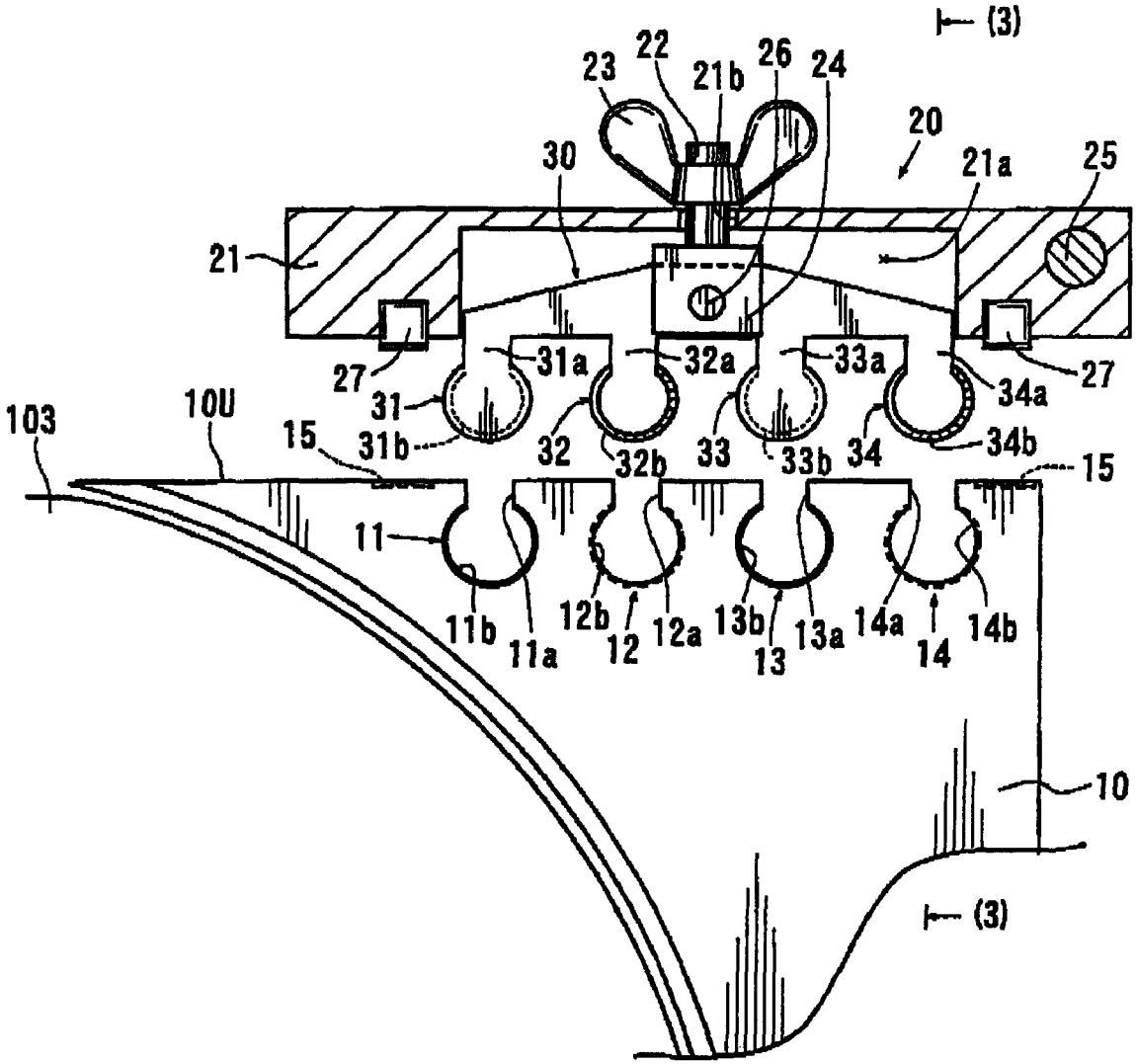
FIG. 2 is a side view similar to FIG. 1 but showing a state where the support device has been removed from the riving knife.
Figure 4:
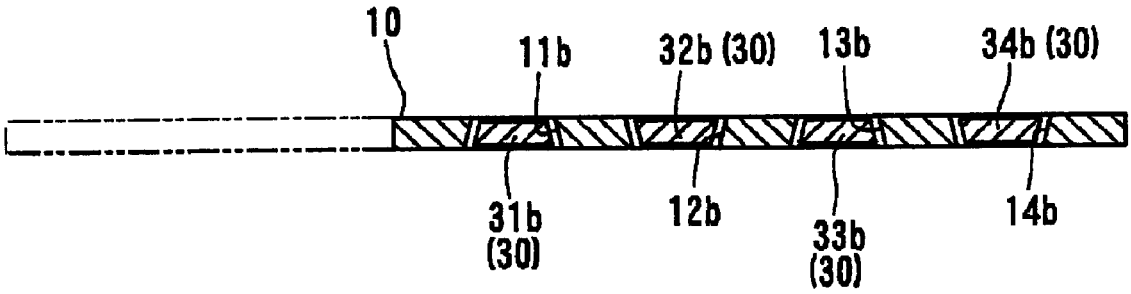
FIG. 4 is a cross-sectional view taken along line (4)-(4) in FIG. 1 and showing the engagement of the joint portions of a joint plate with the joint recesses of the riving knife.

As shown in FIG. 4, the circumferential surfaces of the engaging portions 31*b* to 34*b* are alternately tapered in opposing directions. Therefore, FIG. 2 shows the bottom portions (i.e., the widest portions) of the truncated conical configurations of the leftmost engaging portion 31*b* and the third from the left side engaging portion 33*b*. Conversely, the top portions (i.e., the thinnest portions) of the truncated conical configurations of the second from the left side engaging portion 33*b* and the rightmost engaging portion 34*b* may also be viewed in FIG. 2. In other words, the engaging portions 31*b* to 34*b* are configured such that their top portions and the bottom portions are alternatively oriented in opposing directions. The engaging portions 31 to 34 have the same substantial thickness as the rest of the joint plate 30, i.e., in this representative example a thickness of approximately 1.5 mm.

The upper central portion of the joint plate 30 is pivotally joined to the retainer block 24 via the joint pin 26. The joint plate 30 can pivot forward and rearward with respect to the cutting direction within the accommodation recess 21*a*. The front and rear walls of the accommodation recess 21 may limit the pivotal range of the joint plate 30. Substantially V-shaped guide projections 27 (see FIG. 5) are formed on the front and rear portions of the lower surface of the support bracket 21. The operation of the guide projections 27 will be described later.

Referring to FIGS. 1 and 2, joint recesses 11 to 14 are formed in the upper portion of the riving knife 10 so as to correspond to the joint portions 31 to 34 of the joint plate 30. The joint recesses 11 to 14 have respective rectangular recess portions 11*a* to 14*a* and circular engaging holes 11*b* to 14*b* connected to the rectangular recess portions 11*a* to 14*a*. As shown in FIG. 4, the inner circumferential walls of the engaging holes 11*b* to 14*b* are tapered to correspond to the respective engaging portions 31*b* to 34*b* of the joint plate 30. Consequently, the tapering directions of the engaging holes 11*b* to 14*b* are alternately oriented in opposing directions. Specifically, the diameters of the leftmost engaging hole 11*b* and the third engaging hole 13*b* from the left side increase in a downward direction as viewed in FIG. 4. Conversely, the diameters of the second engaging hole 12*b* from the left side and the rightmost engaging hole 14*b* increase in the upward direction as viewed in FIG. 4. The side of the larger diameter of each of the engaging holes 11*b* to 14*b* will be hereinafter called the "open side."

The recess portions 11*a* to 14*a* and the engaging holes 11*b* to 14*b* of the joint recesses 11 to 14 are sized so as to permit insertion of the corresponding arms 31*a* to 34*a* and the corresponding engaging portions 31*b* to 34*b* from both sides (i.e., the upper side and the lower side as viewed in FIG. 4) of the riving knife 10. In other words, the smallest diameters of the engaging holes 11*b* to 14*b* are greater than the largest diameters of the engaging portions 31*b* to 34*b*. In the configuration where the joint portions 31 to 34 of the joint plate 30 have been received within the corresponding joint recesses 11 to 14 of the riving knife 10, as shown in FIGS. 1 and 4, the joint portions 31 to 34 should not extend beyond the thickness of the riving knife 10. Fitting the joint portions 31 to 34 within the thickness of the riving knife 10 may be accomplished in part because the thickness of the joint portions 31 to 34 is 1.5 mm and the depth of the joint recesses 11 to 14 is 2.0 mm (the depth of the joint recesses is equal to the thickness of the riving knife 10).

Figure 5:
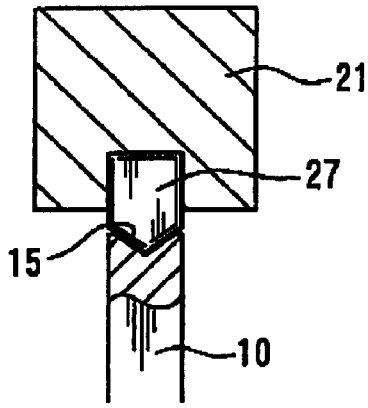
FIG. 5 is a partial cross-sectional view taken along line (5)-(5) in FIG. 1 and showing the engagement of a guide projection of the support device with a guide recess of the riving knife.

As shown in FIGS. 1 and 2, guide recesses 15 are formed in the front and rear portions of the upper end surface 10U of the riving knife 10. The guide recesses 15 are respectively positioned to correspond to the guide projections 27 of the support device 20. The guide recesses 15 have substantially V-shaped cross-sections conforming to the V-shaped configurations of the guide projections 27 (see FIG. 5). In this representative embodiment, the guide projections 27 respectively engage the corresponding guide recesses IS at about the same time that the joint recesses 11 to 14 respectively receive the joint portions 31 to 34. The support device 20 may be fixed in position relative to the riving knife 10, with respect to the direction of thickness of the riving knife 10, upon engagement between the guide projections 27 and the guide recesses 15, as shown in FIG. 5.

The operation of the above representative embodiment will now be described. After the joint portions 31 to 34 of the joint plate 30 are received by the corresponding joint recesses 11 to 14 formed in the upper portion of the riving knife 10, the operator may fix the support bracket 21 in position relative to the upper portion of the riving knife 10 by tightening the butterfly nut 23. By tightening the butterfly nut 23, the support bracket 21 is forced towards the upper end surface 10U of the riving knife 10. As a result, the engaging projections 27 of the support bracket 21 securely engage the corresponding guide recesses 15. In addition, engaging portions 31*b* to 34*b* of the joint portions 31 to 34 of the joint plate 30 are pressed against the upper portions of the inner circumferential walls of the engaging holes 11*b* to 14*b* of the corresponding joint recesses 11 to 14 in a surface-to-surface contact relationship. The support bracket 21 is then reliably fixed in position relative to the upper portion of the riving knife 10. In this configuration, the cover C can vertically pivot relative to the riving knife 10 in order to allow the workpiece W to access the upper portion of the cutting blade 103.

When the engaging portions 31*b* to 34*b* are pressed against the upper parts of the inner circumferential walls of the engaging holes 11*b* to 14*b* in surface-to-surface contact relationship as described above, a first force may be produced in one direction perpendicular to the surfaces of the riving knife 10 by the engaging portions 31*b* and 33*b*. A second force, equal to the first force, may be produced in an opposite direction by the engaging portions 32*b* and 34*b*. The two sets of forces are due to the truncated conical configurations of the engaging portions 31*b* to 34*b* and the engaging holes 11*b* to 14*b* and also due to the alternating arrangement of the tapering directions of these elements. As a result, the joint plate 30 may be reliably positioned in line with the riving knife 10. The joint plate 30 may also be centered relative to the riving knife 10 with respect to the direction of thickness of the riving knife 10.

In the event that a groove forming operation is desired, the cover C may be removed while the riving knife 10 is kept in position. To remove the cover C, the operator must first loosen the butterfly nut 23. The pressing force applied by the support bracket 21 is then released from the upper end surface 10U of the riving knife 10. At the same time, the pressing force applied by the engaging portions 31*b* to 34*b* of the joint portions 31 may also be released from the circumferential surfaces of the corresponding engaging holes 11*b* to 14*b* of the riving knife 10. As a result, it is possible to remove the support bracket 21 from the upper portion of the riving knife 10 and to withdraw the joint portions 31 to 34 from the corresponding joint recesses 11 to 14. In this way, the support device 20 and consequently the cover C can be easily removed from the riving knife 10. In addition, the riving knife 10 does not include any external element or protrusion that extends laterally beyond the thickness of the riving knife 10. Therefore, it is possible to set the riving knife 10 to be positioned so as to not extend upward beyond the height of the cutting blade 103. As a result, it is not necessary to perform a separate adjusting operation for lowering the position of the riving knife 10 below the height of the cutting blade 103 after removing the cover C in order to perform a groove forming operation.

Further, after the cover C and the support device 20 have been removed, the table saw can be readily used for a groove forming operation. This is due at least in part because there are no elements, such as welded nuts as in the known table saw, secured to sides of the riving knife that would extend beyond the width of the cut.

As described above, in this representative embodiment, the support device 20 with the cover C can be mounted to the riving knife 10 by rotating the butterfly nut 23 in a tightening direction. Rotating the butterfly nut 23 in a tightening direction clamps the upper portion of the riving knife 10 between the joint portions 31 to 34 and the guide projections 27. It is not necessary to provide additional elements, such as nuts for example, extending laterally from the side surfaces of the riving knife 10. Therefore, if the cover C has been removed from the riving knife 10 the groove forming operation can be performed without removing the riving knife 10.

Further, in this representative embodiment, the cover C can be easily removed from the riving knife 10. Therefore, it is possible to effectively and rapidly prepare for switching between a groove forming operation and for a normal cutting operation, since it is not necessary to separately remove or remount the riving knife 10.

Furthermore, in the mounted state of the cover C and the support device 20 where the joint portions 31 to 34 of the joint plate 30 are inserted into the corresponding engaging holes 11 to 14, the joint portions 31 to 34 should not extend laterally beyond the surfaces of the riving knife 10. This is due in part because the thickness of the joint portions 31 to 34 (e.g., 1.5 mm in this representative embodiment) is smaller than the thickness of the riving knife 10 (e.g., 2.0 mm in this representative embodiment). Therefore, even on the condition that the cover C has been mounted, the entire riving knife 10 (i.e., the entire area up to about the upper edge of the riving knife 10) can enter the split of the workpiece to enable effective cutting operations.

Still furthermore, the joint plate 30 can be mounted and removed by rotating the butterfly nut 23 relative to the threaded shaft 22 in the tightening and loosening directions. Therefore, it is possible to mount and remove the cover C without requiring the use of a separate tightening tool, such as a wrench, key, or spanner for example.

The above first representative embodiment may be modified in various ways within the scope of the current invention. For example, although the guide projections 27 have V-shaped lower extremities, they may have semicircular cross-sectional lower extremities. In such a case, the respective guide recesses of the riving knife 10 may have corresponding semicircular cross-sections.

The number of the joint portions of the joint plate 30 and the corresponding joint recesses of the riving knife is not limited to four, but may instead be any of an even number greater than four, for example, such as six or eight. The even number of joint portions is primarily used in order to ensure a parallel relationship between the riving knife 10 and the joint plate 30. However, such number may be determined depending in part on the space to be occupied by the connection.

Although the outer circumferential surfaces of the joint portions 31*b* to 34*b* of the joint plate 30 and the corresponding inner circumferential surfaces of the joint recesses 11*b* to 14*b* are configured to have truncated conical configurations, these surfaces may have other configurations such as truncated pyramid configurations, for example. Otherwise, they may be configured to have non-tapered configurations extending substantially parallel to the direction of thickness of the riving knife 10, such as a stepped configuration for example.

Furthermore, the joint plate 30 may be directly connected to the retainer block 24 to integrate the joint plate 30 with the retainer block 24. With this configuration, the joint pin 26 may be omitted.

Second Representative Embodiment

The second representative embodiment will now be described with reference to FIGS. 6 to 10. This representative embodiment is a modification of the first representative embodiment. Therefore, like members are given the same reference numerals as the first representative embodiment and an explanation of these members may not be repeated. With this second representative embodiment, the cover C can be easily removed from and mounted to a riving knife 40. Similar to the first representative embodiment, the cover C may be mounted to the upper portion of the riving knife 40 by a support device 50. In addition, in order to open and close the cover C, the cover C is vertically pivotable about a support shaft 55 mounted to the support device 50.

Figure 6:
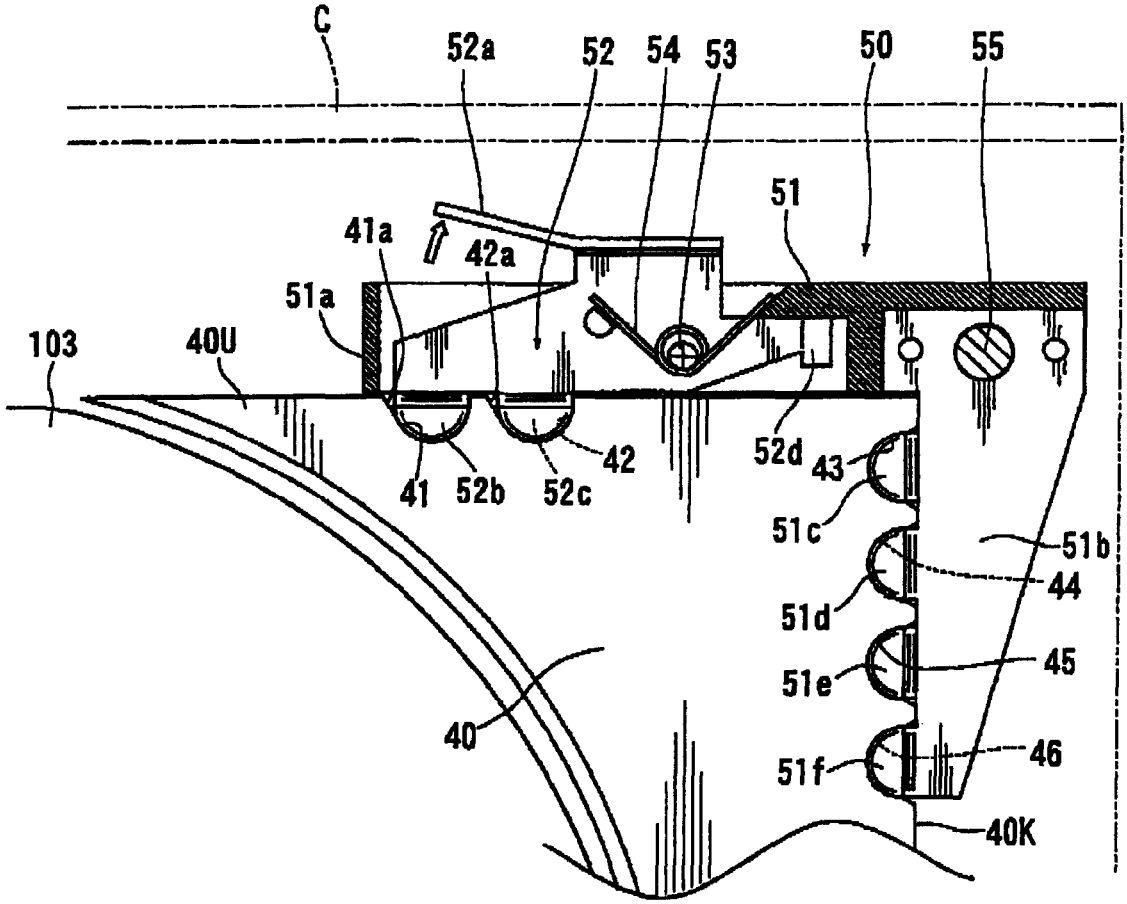
FIG. 6 is a view of a mounting structure accenting to a second representative embodiment and showing a side view of a support device mounted to a riving knife.

The support device 50 includes a support bracket 51 that has a horizontal portion 51*a* (to the left in FIG. 6) and a vertical portion 51*b* (to the right in FIG. 6) respectively opposing to an upper end surface 40U and a rear end surface 40K of the riving knife 40. A joint plate 52 is vertically pivotally mounted to the horizontal portion 51 via a support shaft 53. As shown in FIG. 6, the joint plate 52 is biased in a counterclockwise direction by a torsion spring 54. The joint plate 52 includes an upper lever portion 52*a*, movable joint portions 52*b* and 52*c*, and a rear guide portion 52*d*. The movable joint portions 52*b* and 52*c* extend towards the upper end surface 4017 of the riving knife 40.

Figure 8:
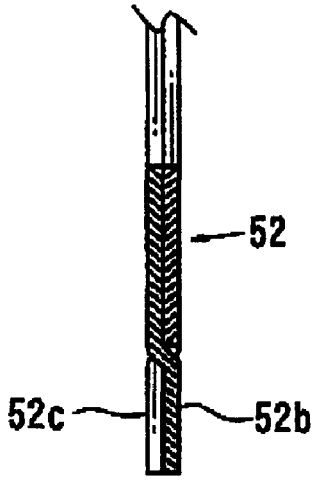
FIG. 8 is a partial cross-sectional view taken along line (8)-(8) in FIG. 7 and showing a vertical sectional view of a joint plate.
Figure 9:
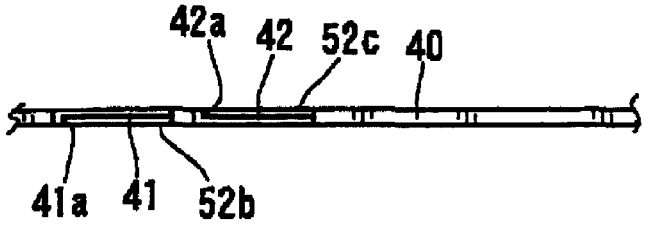
FIG. 9 is a partial view of the upper end of the riving knife as viewed in a direction of arrow (9) in FIG. 7.
Figure 10:
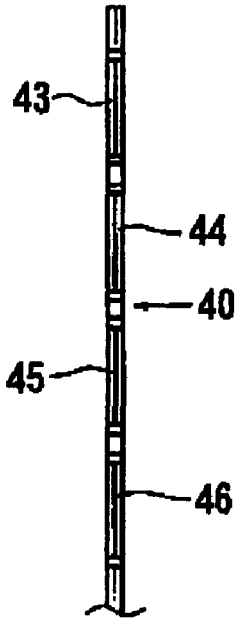
FIG. 10 is a partial view of the rear end of the riving knife as viewed in a direction of arrow (10) in FIG. 7.

Two thin parallel steel plates joined to each other form the joint plate 52. Each of the steel plates has a thickness of about 0.8 mm in this example. A semi-circular extension is formed extending from the lower edge of one of the steel plates to define the movable joint portion 52*b*. Similarly, a semi-circular extension is formed extending from the lower edge of the other steel plate to define the movable joint portion 52*c*. Therefore, the movable joint portions 52*b* and 52*c* each respectively have a thickness of about 0.8 mm. As shown in FIG. 8, the movable joint portions 52*c* and 52*b* are bent at their upper ends so as to be shifted by a distance corresponding to the thickness of the steel plate. Consequently, the movable joint portions 52*b* and 52*c* intersect with each other at their upper ends and extend substantially parallel to each other in a vertical direction as viewed in FIG. 8.

Figure 7:
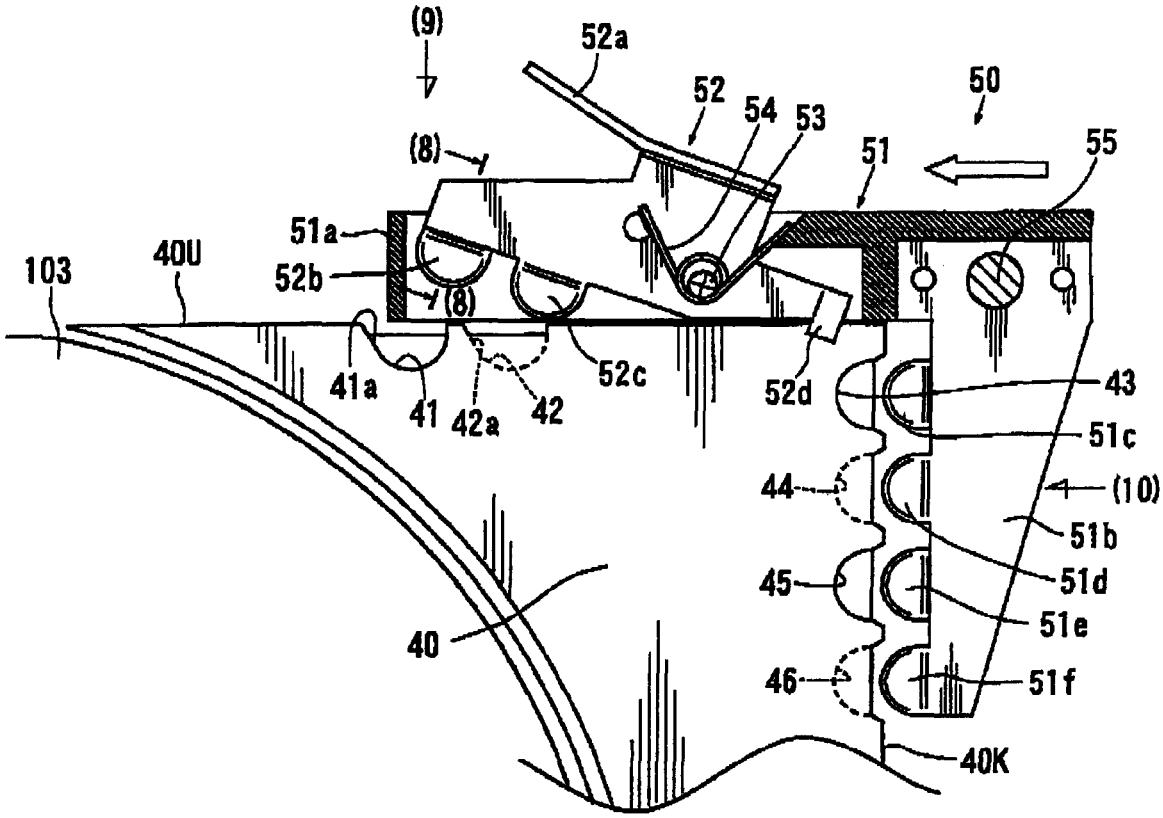
FIG. 7 is a view similar to FIG. 6 but showing the state where the support device has been removed from the riving knife.

Referring to FIG. 7, the guide portion 52*d* is configured to have a substantially Y-shaped cross section, so that the guide portion 52*d* engages the riving knife 40 between branched portions of Y-shape from the right and left side of the riving knife 40 when the joint plate 52 has been pivoted against the biasing force of the torsion spring 54, as shown in FIG. 7. Due to engagement of the riving knife 40 by doe guide portion 52*d*, the position of the joint plate 52 and consequently the position of the support device 50 may be fixed relative to the riving knife 40 with respect to the direction of thickness of the riving knife 40.

Four fixed joint portions 51*c*, 51*d*, 51*e*, and 51*f*, are formed on the vertical portion 51*b* of the support bracket 51 and extend toward the riving knife 40. The fixed joint portions 51*c*, 51*d*, 51*e*, and 51*f*, are arranged in a vertical direction. Similar to the guide portion 52, two thin parallel steel plates joined together form the vertical portion 51*b*. Two semi-circular extensions are formed along the left edge of one of the steel plates to define the fixed joint portions 51*c* and 51*e* (i.e., the first and third joint portions as counted from the top). Similarly, two semi-circular extensions are formed along the left edge of the other steel plate to define the fixed joint portions 51*d* and 51*f* (i.e., the second and fourth joint portions as counted from the top). Although not explicitly shown in the drawings but similar to FIG. 8, the fixed joint portions 51*c* and 51*e* are bent at their right ends so as to be shifted by a distance corresponding to the thickness of the steel plate. Also, the fixed joint portions 51*d* and 51*f* are bent at their right ends in an opposite direction so as to be shifted by a distance corresponding to the thickness of the steel plate. As a result, the fixed joint portions 51*c* and 51*e* and the fixed joint portions 51*d* and 51*f* intersect with each other at their right ends and extend parallel to each other if viewed in a vertical direction in FIG. 7 (FIG. 7 is listed for orientation of the vertical direction, actual detail for these elements is not shown).

Joint recesses 41 and 42 are formed to extend into the upper end surface 40U of the riving knife 40. The joint recesses 41 and 42 have semi-circular configurations substantially conforming to the configurations of the movable joint portions 52*b* and 52*c*. The positions of the joint recesses 41 and 42 correspond to the movable joint portions 52*b* and 52*c*. In addition, joint recesses 43 through 46 are formed so as to extend into the rear end 40K (i.e., the right end as viewed in FIGS. 6 and 7) of the riving knife 40. The joint recesses 43 to 46 have semi-circular configurations substantially conforming to the configurations of the fixed joint portions 51*c* to 51*f*. The joint recesses 41 and 42 are positioned on opposite sides with respect to the direction of thickness of the riving knife 40 (see FIG. 9). Similarly, the joint recesses 43 through 46 are alternately positioned on opposing sides with respect to the thickness of the riving knife 40 (see FIG. 10). More specifically, the joint recesses 41 and 42 are respectively positioned on a first side and a second side with respect to the thickness of the riving knife 40. The joint recesses 43 and 45 (i.e., the first and third recesses as counted from the top) are positioned on the first side. The joint recesses 44 and 46 (i.e., the second and fourth recesses as counted from the top) are positioned on the second side. Each of the joint recesses 41 to 46 has a depth (i.e., in the direction of thickness of the riving knife 40) of approximately 0.8 mm. Therefore, the movable joint portions 52*b* and 52*c* and the fixed joint portions 51*c* to 51*f* may be received within the corresponding joint recesses 41 to 46 without extending laterally outward beyond the surfaces of the riving knife 40 surrounding the joint recesses 41 to 46.

When the movable joint portions 52*b* and 52*c* are inserted into the corresponding joint recesses 41 and 42 so as to be positioned on opposing sides (i.e., the first and second sides) of the riving knife 40, the upper portion of the riving knife 40 may be clamped and held between the movable joint portions 52*b* and 52*c* Similarly, when the fixed joint portions 51*c* to 51*f* are inserted into the corresponding joint recesses 43 to 46 so as to be positioned alternately on the opposing sides (i.e., the first and second sides) of the riving knife 40, the rear portion of the riving knife 40 may be clamped and held between the fixed joint portions 51*c* and 51*e* and the fixed joint portions 51*d* and 51*f*.

As shown in FIGS. 6 and 7, the joint recess 41 has a front edge 41*a* (i.e., the left edge as viewed in FIGS. 6 and 7) that extends tangentially at an angle from the joint recess 41. Similarly, the joint recess 42 has a front edge 42*a* that extends tangentially at an angle from the joint recess 42. This configuration of the front edges 41*a* and 42*a* of the joint recesses 41 and 42 allows the joint portions 52*b* and 52*c* to smoothly enter and exit from the corresponding joint recesses 41 and 42 along a circular moving path, as will be described later.

According to the second representative embodiment described above, the support bracket 51 may be reliably and fixedly joined to the upper end surface 40U and the rear end surface 40K. The joint is reliably fixed because the movable joint portions 52*b* and 52*c* are inserted into the corresponding joint recesses 41 and 42 from the upper end surface 40U so as to be positioned on opposing sides (i.e., the first and second sides), and also because the fixed joint portions 51*c* to 51*f* are inserted into the corresponding joint recesses 43 to 46 from the rear end surface 40K to be alternately positioned on opposing sides (i.e., the first and second sides). In this way, the cover C may be mounted to the riving knife 40. In a mounted configuration, the support device 50 may be fixed in position with respect to the forward and rearward directions (i.e., the left and right directions as viewed in FIG. 7) through engagement between the movable joint portions 52*b* and 52*c* and the joint recesses 41 and 42. In addition, the support device 50 may be fixed in position with respect to the vertical direction through engagement between the fixed joint pardons 51*c* to 51*f* and the joint recesses 43 to 46. Further, the support device 50 may be fixed in position with respect to the direction of thickness of the riving knife 40 through the alternate positioning of the movable joint portions 52*b* and 52*c* and the fixed joint portions 51*d* to 51*f* located on opposing sides of the riving knife 40, engaging the joint recesses 41 to 46. In this way, the cover C may be mounted to the riving knife 40. The mounted cover C may pivot to open and close access to the upper portion of the cutting blade 103.

In order to remove the cover C from the riving knife 40, the operator may move the lever portion 52*a* upward, as indicated by the arrow in FIG. 6. Moving the lever portion 52*a* in this manner pivots the joint plate 52 in the clockwise direction about the support shaft 53, against the biasing force of the torsion spring 54, As a result, the movable joint portions 52*b* and 52*c* may be removed from the joint recesses 41 and 42. Upon removal of the movable joint portions 52*b* and 52*c* from the joint recesses 41 and 42, the support device 50 may be moved in the rearward direction (i.e., in the cutting direction, to the right as viewed in FIGS. 6 and 7).

By moving the support device 50 to the right, the fixed joint portions 51*c* to 51*f* may be removed from the joint recesses 43 to 46. As a result, the support device 50 and consequently the cover C may be removed from the riving knife 40.

In the configuration where the support device 50 and the cover C have been removed from the riving knife 40, no element or part extends laterally outward beyond the thickness of the riving knife 40. Therefore, the groove forming operation can be performed with the aid of the remaining riving knife 40.

In order to mount the cover C to the riving knife 40, the operator may move the lever portion 52*a* upward against the biasing force of the torsion spring 54 to pivot the joint plate 52 in the clockwise direction about the support shaft 53. The operator may then hold the joint plate 52 in the inclined position as shown in FIG. 7. Next the operator positions the support bracket 51 such that the horizontal portion 51*a* and the vertical portion 51*b* of the support bracket 51 respectively extend along the upper end surface 40U and the rear end surface 40K of the riving knife 40. With the joint plate 52 held in an inclined position, the operator moves the support device 50 leftward as indicated by the arrow in FIG. 7. The fixed joint portions 51*c* to 51*f* are inserted and engaged with the corresponding joint recesses 43 to 46 of the riving knife 40. In order to facilitate the insertion of the fixed joint portions 51*c* to 51*f* into the joint recesses 43 to 46, the guide portion 52*d* of the joint plate 52 may be engaged with the upper end surface 40U of the riving knife 40 in order to accurately position the support device 50 relative to the riving knife 40 in the direction of thickness. The support device 50 is then moved leftward while the guide portion 52*d* slides along the upper end surface 40U of the riving knife 40. In this way, the fixed joint portions 51*c* to 51*f* may be smoothly and reliably inserted into the corresponding joint recesses 43 to 46. As a result, the support device 50 may be fixed in position relative to the riving knife 40 with respect to the vertical direction and the thickness direction since the fixed joint portions 51*c* to 51*f* engaged with the joint recesses 43 to 46 are alternately positioned along opposite sides with respect to the riving knife 40.

After the fixed joint portions 51*c* to 51*f* have engaged the joint recesses 43 to 46, the operator may release the lever portion 52*a*. The joint plate 52 pivots in a counterclockwise direction (as viewed in FIGS. 6 and 7) due to the biasing of the torsion spring 54. As a result, the movable joint portions 52*b* and 52*c* are inserted into and engage with the corresponding joint recesses 41 and 42. As previously described, the joint recesses 41 and 42 have the front edges 41*a* and 42*a* respectively extending tangentially at an angle from the joint recesses 41 and 42. Therefore, the movable joint portions 52*b* and 52*c* may smoothly enter the joint recesses 41 and 42 as they move in a circular path about the support shaft 53. As a result, the support device 50 may be fixed in position relative to the riving knife 40 with respect to the forward and rearward directions and the thickness direction since the movable joint portions 52*b* and 52*c* engaged with the joint recesses 41 and 42 are positioned along opposing side surfaces of the riving knife 40. The mounting operation of the cover C to the riving knife 40 is then completed.

With the second representative embodiment, the cover C can also be easily mounted to and removed from the riving knife 40. It is not necessary to remove the riving knife 40 in order to perform a groove forming operation. As a result, troublesome operations for removing and mounting the riving knife are no longer necessary. Therefore, the cutting device can be rapidly and efficiently switched between a normal cutting operation and a groove forming operation.

According to the second representative embodiment, the support device 50 may be mounted to the riving knife 40 together with the cover C by clamping the upper and rear portions of the riving knife 40 in the direction of thickness by means of the movable joint portions 52*b* and 52*c* and the fixed joint portions 51*c* to 51*f*. The riving knife 40 is not required to have any elements or parts, such as welded nuts for example, that extend laterally beyond the thickness of the riving knife 40. Therefore, the groove forming operation can be performed with the riving knife 40 remaining in place after the cover C has been removed from the riving knife 40.

In addition, according to the second representative embodiment, in the mounted state the movable joint portions 52*b* and 52*c* and the fixed joint portions 51*c* to Sit do not extend laterally from the thickness of the riving knife 40. Therefore, the entire area of the riving knife 40 can be used and entered into the split. As a result, the "kickback" phenomenon prevention function can be effectively performed by substantially the entire portion of the riving knife 40 extending above the surface of the table 102.

Further, the movable joint portions 52*b* and 52*c* and the fixed joint portions 51*c* to 51*f* can clamp the riving knife 40 via the pivoting operation of the lever portion 52*a*. Consequently, no separate fixing tool is required for mounting and removing the cover C.

The second representative embodiment may be modified in various ways within the scope of the present teachings. In this representative embodiment, the vertical position of the support device 50 and correspondingly the vertical position of the cover C has been fixed in position through engagement of the fixed joint portions 51*c* to 51*f* with the joint recesses 43 to 46. However, the fixed joint portions 51*c* to 51*f* and the joint recesses 43 to 46 may be eliminated as will be hereinafter described in connection with the third representative embodiment. The third representative embodiment may be considered a modification of the second representative embodiment.

Third Representative Embodiment

Figure 11:
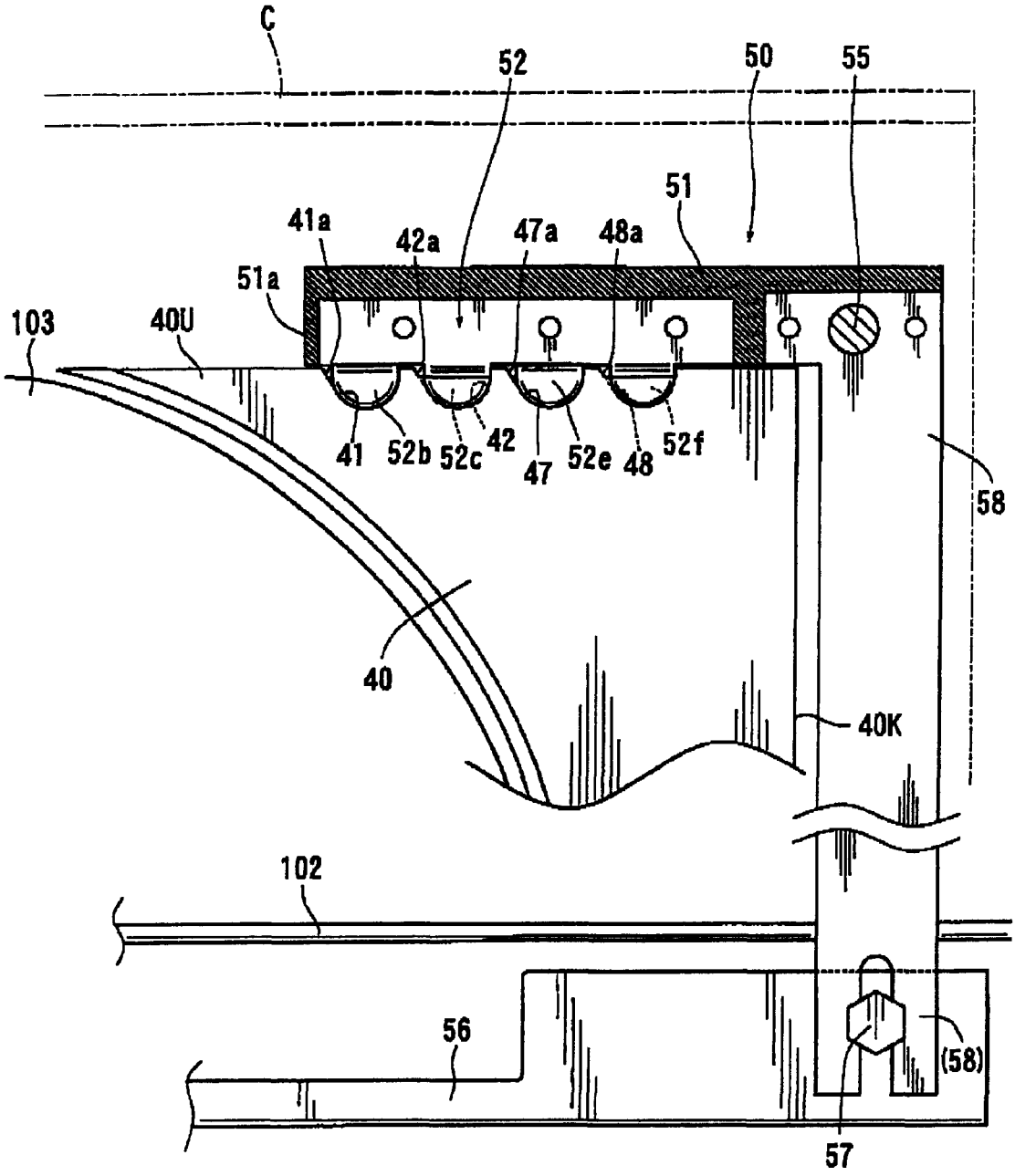
FIG. 11 is a view of a mounting structure according to a third representative embodiment and showing a side view of a support device mounted to a riving knife.

In the third representative embodiment, as shown in FIG. 11, the vertical portion 51*b* of the support bracket 51 is replaced with a vertical extension 58 that extends downward below the table 102. The lower end of the vertical extension 58 is fixed in position relative to a mount 56 by a fastening device 57, for example, such as a nut and bolt The mount 56 is adapted to mount the riving knife 40 thereon. The vertical position of the vertical extension 58 is adjustable relative to the mount 56 via a slot formed in the vertical extension 58, through which a bolt of the fastening device 57 is inserted. In addition, in the third representative embodiment the movable joint plate 52 is eliminated. Therefore, the joint portions 52*b* and 52*c* are directly formed on the horizontal portion 51*a* of the support bracket 51. Further, two additional joint portions 52*e* and 52*f* are also formed on the horizontal portion 51*a*. As a result, two additional joint recesses 47 and 48, similar to the joint recesses 41 and 42 and respectively having tangentially extending front edges 47*a* and 48*a*, are formed in the upper portion of the riving knife 40.

According to the third representative embodiment in order to remove the support bracket 51 and consequently the cover C from the riving knife 40, the operator may loosen the fastening device 57 and then move the support bracket upward. Therefore, the joint portions 52*b*, 52*c*, 52*e*, and 52*f*, may be removed from the corresponding joint recesses 41, 42, 47, and 48. At the same time, the vertical extension 58 may be removed from the mount 56. In this manner, the cover C can easily be removed from the riving knife 40.

In order to mount the cover C and the support bracket 51 to the riving knife 40, the operator may lower the support bracket 51 so as to insert the joint portions 52*b*, 52*c*, 52*e*, and 52*f*, into the corresponding joint recesses 41, 42, 47, and 48. The operator may then tighten the fastening device 57 in order to fix the vertical position of the vertical extension 58.

In the third representative embodiment, the joint portions 52*b*, 52*c*, 52*e*, and 52*f*, engaged with the corresponding joint recesses 41, 42, 47, and 48, do not extend laterally from the thickness of the riving knife 40. Therefore, the entire area of the riving knife 40 (e.g., up to the upper end surface 40U) can enter the split of the workpiece in order to prevent "kickback" during the cutting operation.

Fourth Representative Embodiment

The fourth representative embodiment will now be described with reference to FIGS. 12 to 16. In this representative embodiment, the cover C may be mounted to a riving knife 70 via a support device 60. The cover C may vertically pivot to provide access to the upper portion of the cutting blade 103 for the workpiece W.

In this representative embodiment, two fixing holes 70*a* and 70*b* are formed in the upper portion of the riving knife 70. The lower end of the riving knife 70 extends below the surface of the table 102 and is mounted to a mount 56 (see FIG. 11 of the third representative embodiment). The mount 56 supports the cutting blade 103 such that the vertical position of die cutting blade 103 can be adjusted relative to the surface of the table 102.

Figure 14:
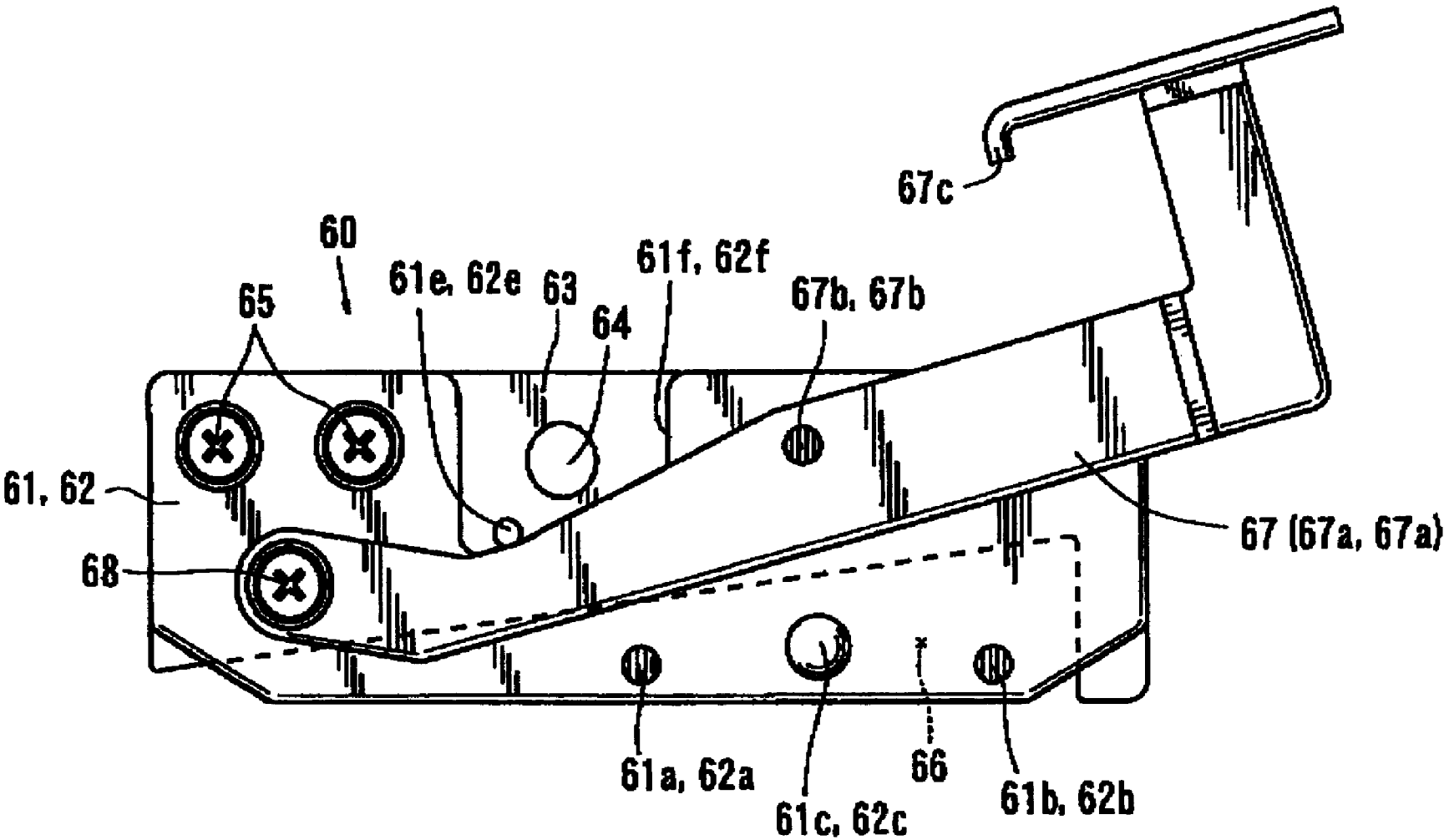
FIG. 14 is a side view of the support device and showing the state where a lever has been pivoted to a removing position.
Figure 15:
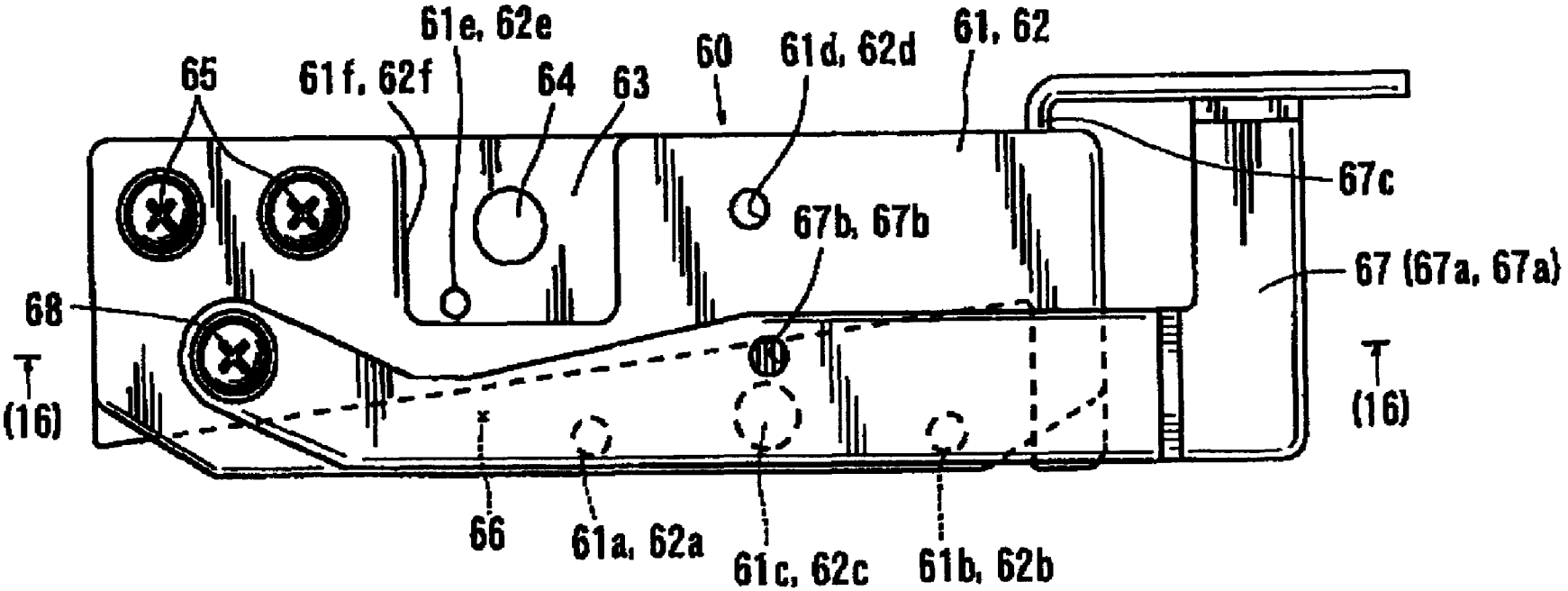
FIG. 15 is a side view similar to FIG. 14 but showing the state where the lever has pivoted to a mounting position.
Figure 16:
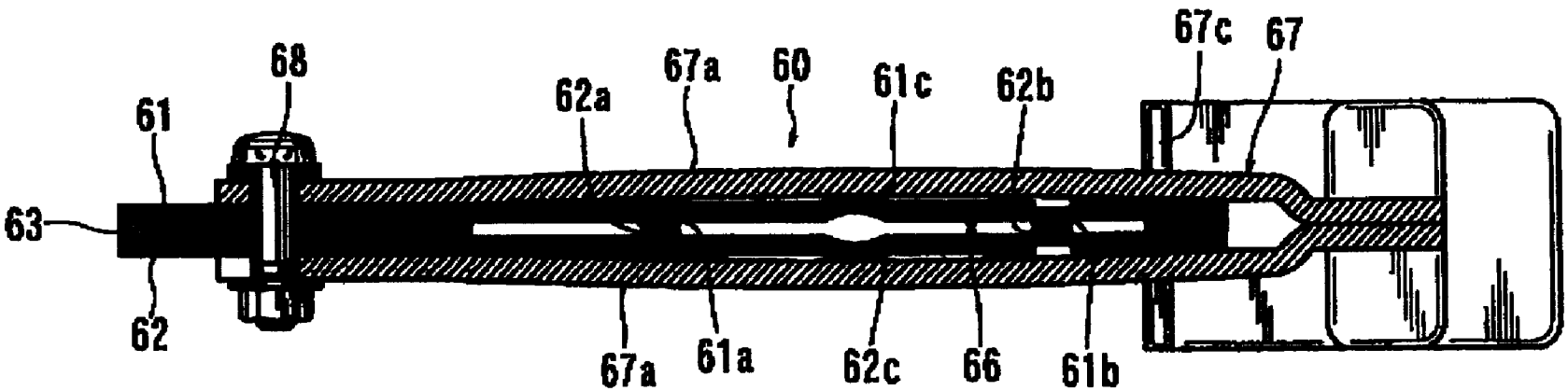
FIG. 16 is a view as viewed in a direction of arrow (16)-(16) in FIG. 15.
Figure 17:
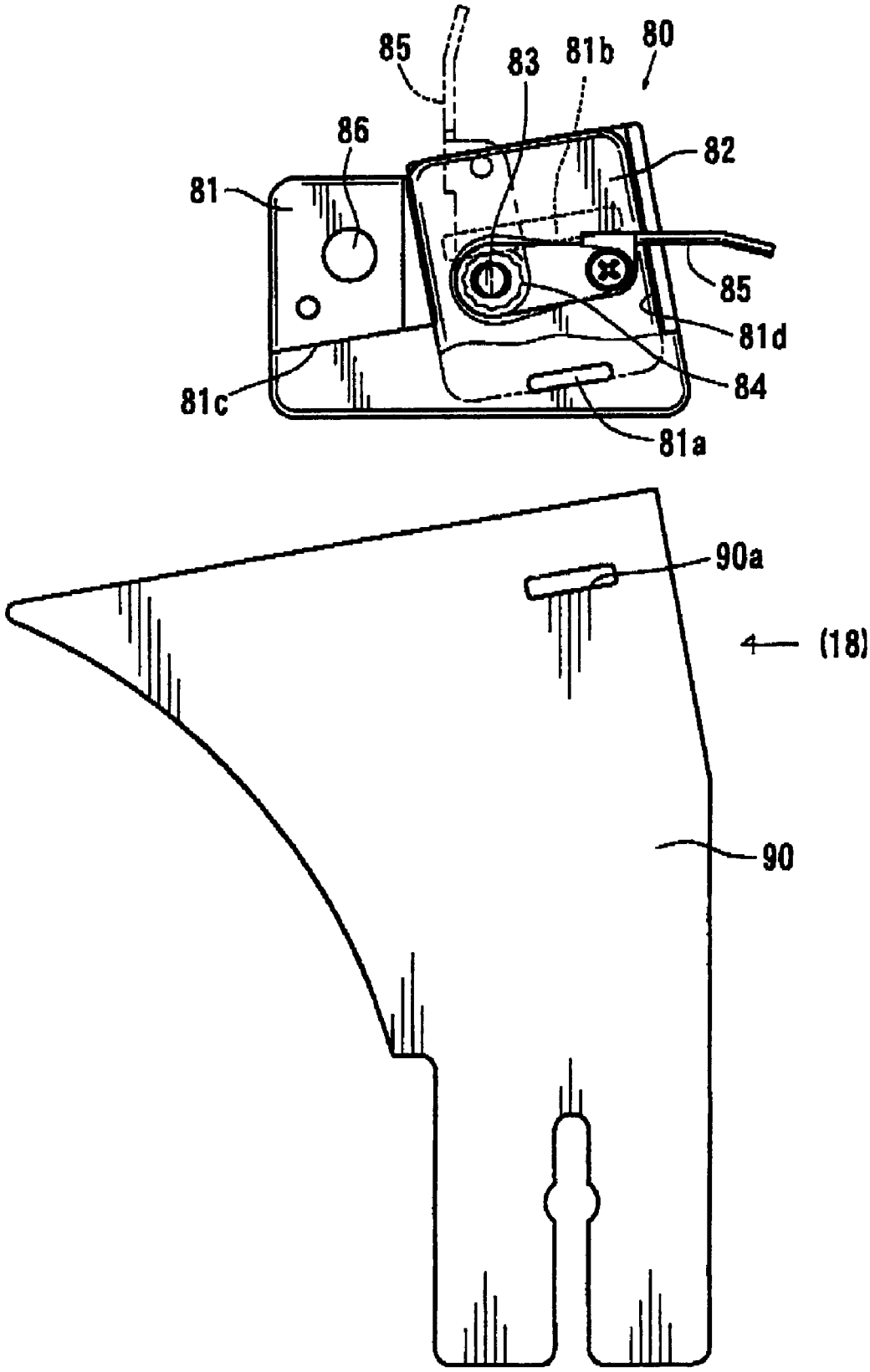
FIG. 17 is a view of a mounting structure according to a fifth representative embodiment and showing a side view of a support device and a riving knife at the state where the support device is removed from the riving knife.
Figure 18:
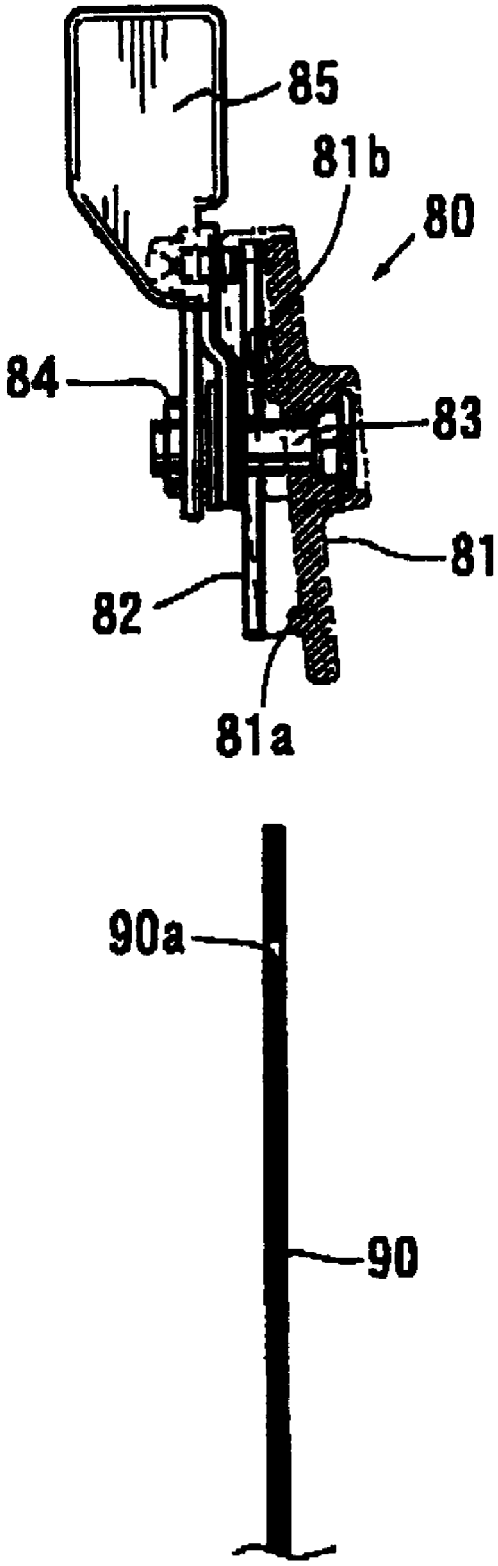
FIG. 18 is a rear partially sectional view as viewed in the direction of arrow (18) in FIG. 17.

Details of the support device 60 are shown in FIGS. 14 to 16. Referring to these figures, the support device 60 has a support shaft 64 mat pivotally supports the cover C. The support shaft 64 allows the cover C to vertically pivot so as to open and close access to the upper portion of the cutting blade 103. The support device 60 includes a pair of parallel outer plates 61 and 62 and an intermediate plate 63 interleaved between the outer plates 61 and 62. The outer places 61 and 62 and the intermediate plate 63 are joined to each other by fixing bolts 65 for example. Cutout recesses 61*f* and 62*f* are respectively formed in the outer plates 61 and 62. The intermediate plate 63 is exposed to the outside via the cutout recesses 61*f* and 62*f*. The support shaft 64 is mounted to the intermediate plate 63 and extends through the exposed regions of the intermediate plate 63. The cover C is vertically pivotally mounted to the support shaft 64.

The lower portion of the intermediate plate 63 contains a predetermined cut out region forming an insertion recess 66. The insertion recess 66, for receiving the upper portion of the riving knife 70, is defined between the outer plates 61 and 62 on the lower side of the support device 60. When the upper portion of the riving knife 70 is inserted into the insertion recess 66, the fixing holes 70*a* and 70*b* may be positioned within the insertion recess 66. Engaging projections 61*a* and 62*a* are respectively formed on the outer plates 61 and 62 in positions opposing the mounted location of fixing hole 70*a* in order to engage fixing hole 70*a*. Similarly, engaging projections 61*b* and 62*b* are respectively formed on the outer plates 61 and 62 in positions opposing the mounted location of fixing hole 70*b* in order to engage the fixing hole 70*b*.

In the areas bordering the insertion recess 66, the outer plates 61 and 62 may be resiliently deformable in the direction of their thickness. In order to enable insertion of the upper portion of the riving knife 70, the outer plates 61 and 62 may resiliently deform to increase the width of the insertion recess 66. The outer plates 61 and 62 may then resiliently spring back to press against the upper portion of the riving knife 70. The upper portion of the riving knife 70 is then resiliently clamped between the outer plates 61 and 62. At this point, the engaging projections 61*a* and 62*a* engage fixing hole 70*a* from both sides of the riving knife 70. Similarly, the engaging projections 61*b* and 62*b* engage the fixing hole 70*b* from both aides of the riving knife 70. In this way, the upper portion of the riving knife 70 may be fixed in position (e.g., in the removal direction in particular) relative to the support device 60. However, the riving knife 70 may still be removed from the support device 60 by forcibly moving the support device 60 upward against the resilient clamping force applied to the riving knife 70 by the outer plates 61 and 62.

The support device 60 includes a lever 67 that is vertically pivotally supported by the support device 60 via a support shaft 68. As shown in FIG. 16, the lever 67 is constituted by two lever plates 67*a* that are joined together. The lever plates 67*a* are respectively positioned to extend along the outer surfaces of the outer plates 61 and 62. A small clearance is formed between each of the lever plates 67*a* and the corresponding outer surface of the outer plate 61 (62) so that the lever plates 67*a* are movable relative to the outer plates 61 and 62.

Within the regions of the outer plates 61 and 62 defining the insertion recess 66, substantially hemispherical pressing projections 61*c* and 62*c* axe respectively formed on the outer surfaces of the outer plates 61 and 62 so as to extend outward therefrom. When the lever 67 is pivoted to a mounting position, the lever plates 67*a* oppose to or press against the pressing projections 61*c* and 62*c*. The regions of the outer plates 61 and 62 defining the insertion recess 66 may then be resiliently deformed towards each other so, reducing the width of the insertion recess 66. The engaging projections 61*a* and 62*a* are forced towards each other. Similarly, the engaging projections 61*b* and 62*b* are forced towards each other.

With this arrangement, when the lever 67 is pivoted to a mounting position, as shown in FIG. 15, after insertion of the upper portion of the riving knife 70 into the insertion recess 66, the upper portion of the riving knife 70 may then be securely clamped between the outer plates 61 and 62. At the same time, the engaging projections 61*a* and 62*a* firmly engage the fixing hole 70*a* from both sides of the riving knife 70. Similarly, the engaging projections 61*b* and 62*b* firmly engage the fixing hole 70*b* from both sides of the riving knife 70. As a result, the support device 60 can be mounted to the riving knife 70 in such a way as to not be easily removed unintentionally.

The lever 67 has a stopper 67*c* mounted to one end of the lever 67, remote from the pivotal axis. When the lever 67 reaches the mounting position, the stopper 67*c* contacts the upper end surfaces of the outer plates 61 and 62. The lever 67 is therefore prevented from moving beyond the mounting position.

When the lever 67 is pivoted upward away from the mounting position to a removing position, where the lever plates 67*a* do not interact with the pressing projections 61*c* and 62*c*, as shown in FIG. 14, the regions of the outer plates 61 and 62 defining the insertion recess 66 resiliently recover their configurations and move away from each other. The engaging projections 61*a* and 62*a* and the engaging projections 61*b* and 62*b* are respectively moved away from the fixing holes 70*a* and 70*b* of the riving knife 70, or at least their clamping force is relaxed. Therefore, the upper portion of the riving knife 70 can be removed from the insertion recess 66. In other words, the support device 60 and correspondingly the cover C can be removed from the riving knife 70.

As shown in FIG. 15, substantially hemispherical retainer projections 61*d* and 62*d* are respectively formed on the outer surfaces of the outer plates 61 and 62 in positions opposing to the lever plates 67*a* when the lever 67 is located in a removing position. A retainer hole 67*b* is formed in each of the lever plates 67*a*, in a substantially central position with respect to the longitudinal direction. Each retainer hole 67*b* is adapted to engage the tip of a corresponding retainer projection 61*d* (62*d*). Therefore, when the lever 67 has been pivoted to the removing position, the tips of the retainer projections 61*d* and 62*d* respectively engage the retainer holes 67*b* of the lever plates 67*a*. The lever 67 may consequently be held in a removing position configuration. In addition, stopper pins 61*e* and 62*e* respectively extend laterally from the outer surfaces of the intermediate plate 63 within the regions exposed by the cutout recesses 61*f* and 62*f* of the outer plates 61 and 62. The lever 67 is prevented by the stopper pins 61*e* and 62*e* from pivoting beyond a removing position.

According to the fourth representative embodiment described above, the support device 60 and consequently the cover C may be held in a mounted state on the riving knife 70 by positioning the lever 67 at the mounting position after inserting the upper portion of the riving knife 70 into the insertion recess 66 of the support device 60.

Figure 12:
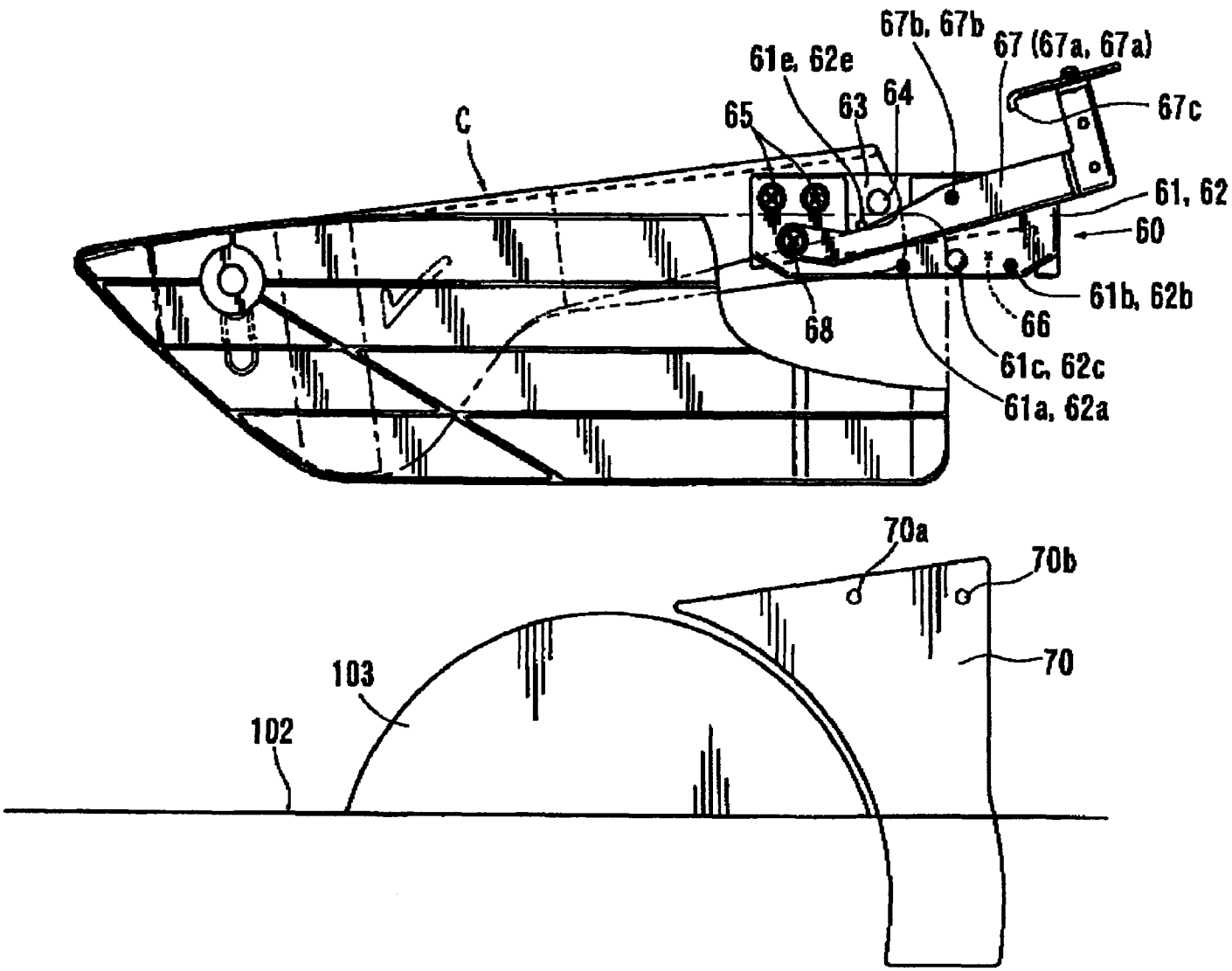
FIG. 12 is a view of a mounting structure according to a fourth representative embodiment and showing a side view of a support device and a cover in a state removed from a riving knife.
Figure 13:
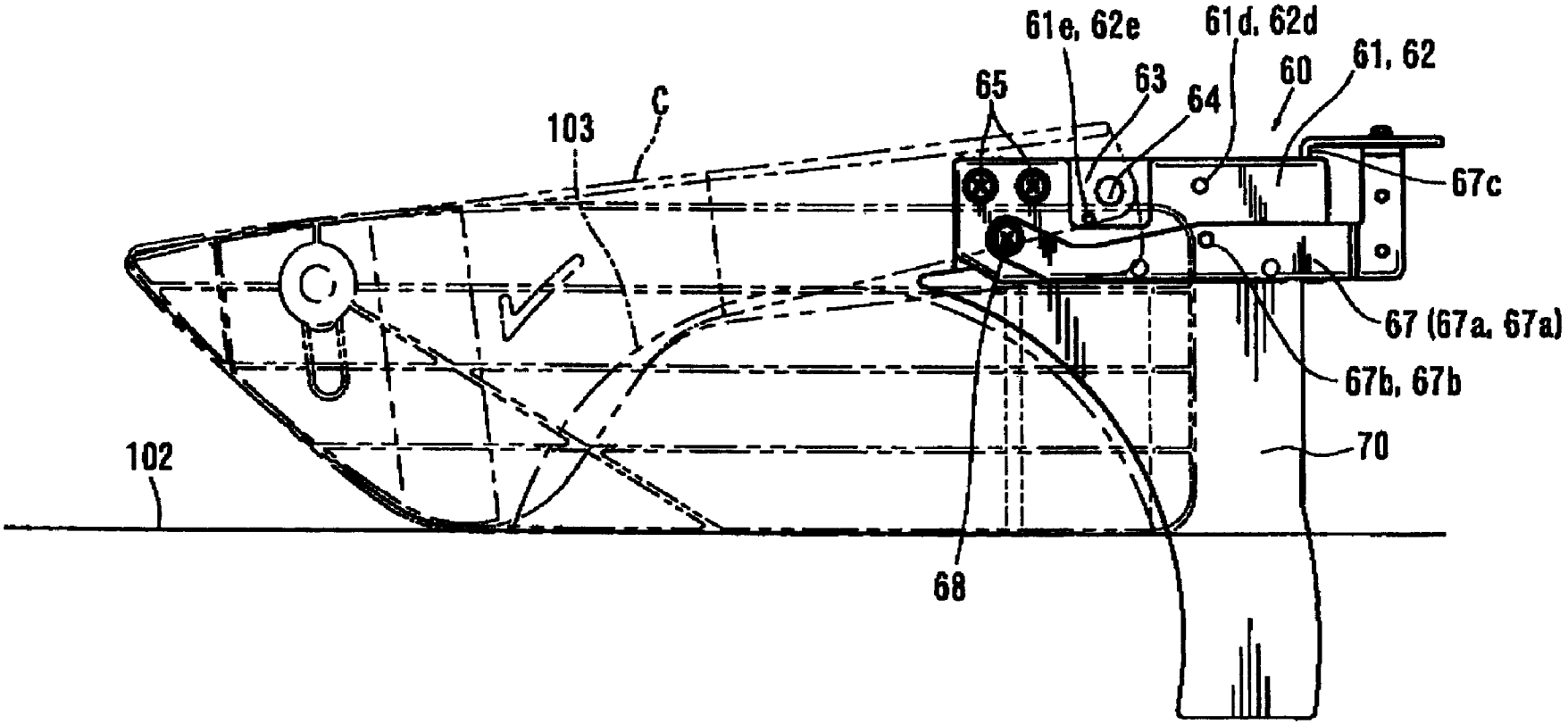
FIG. 13 is a view similar to FIG. 12 but showing the state where the cover has been mounted to the riving knife.

In order to remove the cover C from the riving knife 70, the operator initially pivots the lever 67 upward to a removing position, as shown in FIG. 14. The pressure applied by the lever plates 67*a* to the pressing projections 61*c* and 62*c* may then be released. The outer plates 61 and 62 resiliently recover their original configurations to increase the width of the insertion recess 66. As a result, the engaging projections 61*a* and 62*a* and the engaging projections 61*b* and 62*b* are moved away from the fixing holes 70*a* and 70*b* of the riving knife 70, and their resilient clamping force is relaxed. The upper portion of the riving knife 70 can then be removed from the insertion recess 66. In other words, the support device 60 and correspondingly the cover C can be removed from the riving knife 70 as shown in FIG. 12.

In order to remount the cover C to the riving knife 70, the operator may insert the upper portion of the riving knife 70 into the insertion recess 66. The operator may then pivot the lever 67 to a mounting position. When the lever 67 reaches the mounting position, the pressing projections 61*c* and 62 are respectively pressed inward by the lever plates 67*a*. Consequently, the width of the insertion recess 66 is reduced. The engaging projections 61*a* and 62*a* and the engaging projections 61*b* and 62*b* firmly engage the corresponding fixing holes 70*a* and 70*b*. The support device 60 is then mounted to the riving knife 70 in such a manner that the support device 60 is prevented or inhibited from being removed from the riving knife 70. Therefore, the cover C can be reliably and firmly mounted to the riving knife 70.

In this way, according to the fourth representative embodiment, the cover C can be easily removed from and mounted to the riving knife 70. In addition, the groove forming operation can be performed while the riving knife 70 remains mounted to the able saw. For this reason, the groove forming operation can be easily and rapidly prepared without requiring troublesome mounting and removing operations of the riving knife.

Further, the riving knife 70 is clamped between the outer plates 61 and 62 of the support device 60 by the pivoting operation of the lever 67. Therefore, no separate tightening tool, such as a spanner, wrench, or key, for example, is necessary for the mounting and removing operations.

The fourth representative embodiment may be modified in various ways within the scope of the current teachings. For example, although the pivotal movement of the lever 67 is utilized for mounting the support device 60 to the riving knife 70, a parallel displacement in the vertical direction of the lever 67 may also be utilized.

Fifth Representative Embodiment

The fifth representative embodiment will now be descried with reference to FIGS. 17 to 20. With this fifth representative embodiment, the cover C can be easily mounted to and removed from a riving knife 90. In this representative embodiment, the cover C is mounted to the riving knife 90 by means of a support device 80.

The support device 80 includes a mount base 81 and a clamp base 82. A support shaft 86 is mounted to the mount base 81 in order to pivotally support the cover C so that the cover C can open and close access to the upper portion of the cutting blade 103. In FIGS. 17 to 20, the cover C and the cutting blade 103 are not shown for the purposes of simplifying the illustrations.

A headed threaded shaft 83 is mounted to the mount base 81 and inserted into the clamp base 82. The end portion of the threaded shaft 83 extends outward from the clamp base 82. A nut 84 is engaged with an end portion of the threaded shaft 83. A lever 85 is secured to the nut 84. The nut 84 can be rotated relative to the threaded shaft 83 as the lever 85 is pivoted. When the lever 85 has been pivoted to a mounting position indicated by solid lines in FIG. 17, the nut 84 may be tightened, clamping together the clamp base 82 and the mount base 81. When the lever 85 has been pivoted to a removing position as indicated by chain lines in FIG. 17, the nut 84 may be loosened, permitting displacement of the clamp base 82 relative to the mount base 81. An elongated linear engaging projection 81*a* and an elongated linear support projection 81*b* are formed on the mount base 81 so as to project toward the clamp base 82. The engaging projection 81*a* is closely engageable (i.e., no substantial clearance) with a corresponding elongated recess 90*a* formed in the upper portion of the riving knife 90. The support projection 81*b* is positioned on the upper side of the same surface of clamp base 82 as the engaging projection 81*a*. The threaded shaft 83 is between the support projection 81*b* and the engaging projection 81*a* in the vertical direction, and closer to the support projection 81*b*. When the lever 85 has been pivoted to a removing position in order to permit displacement of the clamp base 82 relative to the mount base 81, the clamp base 82 may pivot about the support projection 81*b*, which serves as a fulcrum (see FIG. 18). The top portion of clamp base 82 is moved closer to the mount base 81 while the bottom portion of clamp base 82 is moved further away from the mount base 81. Consequently, it is possible to move the clamp base 82 towards and away from the engaging projection 81*a*.

Stepped contact portions 81*c* and 81*d* are formed on the mount base 81 and serve to respectively contact the upper end and the rear end of the riving knife 90. The stepped contact portions 81*c* and 81*d* aid in positioning the support device 80 relative to the riving knife 90.

In order to mount the cover, the operator may position the upper end and the rear end of the riving knife 90 to respectively contact the contact portions 81*c* and 81*d* of the mount base 81. The engaging projection 81*a* is positioned in engagement with the engaging recess 90*a*. The operator may then pivot the lever 85 to the mounting position and the nut 84 is tightened to press the clamp base 82 against the mount base 81. Therefore, the clamp base 82 is fixed in position relative to the mount base 81. The clamp base 82 is secured to the mount base 81 via the engaging projection 81*a* and the support projection 81*b*, positioned on both sides of the threaded shaft 83. As a result, the support device 80 and correspondingly the cover C can be fixedly mounted to the upper portion of the riving knife 90.

Figure 19:
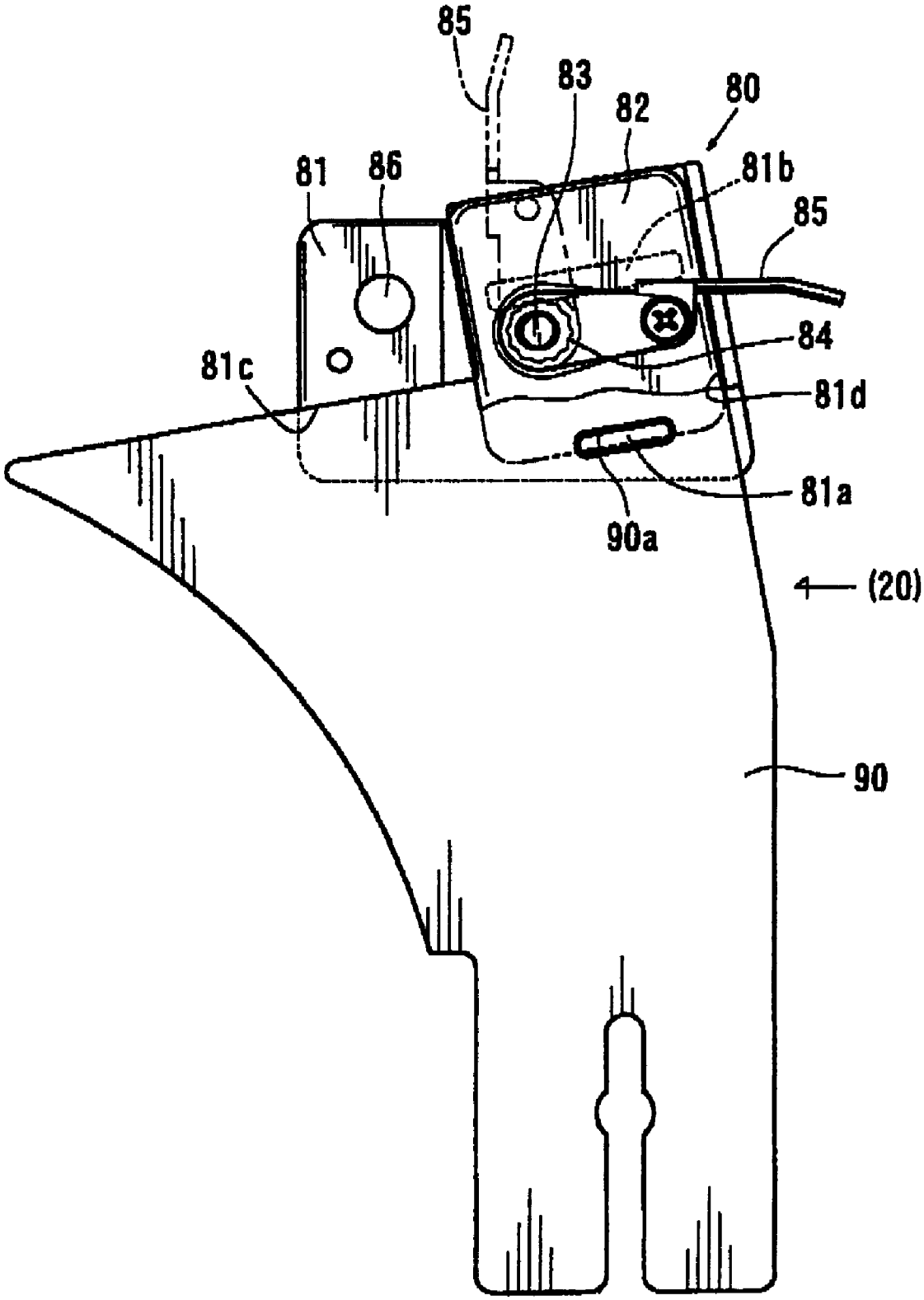
FIG. 19 is a side view of the support device and the riving knife at the state where the support device is mounted to the riving knife.
Figure 20:
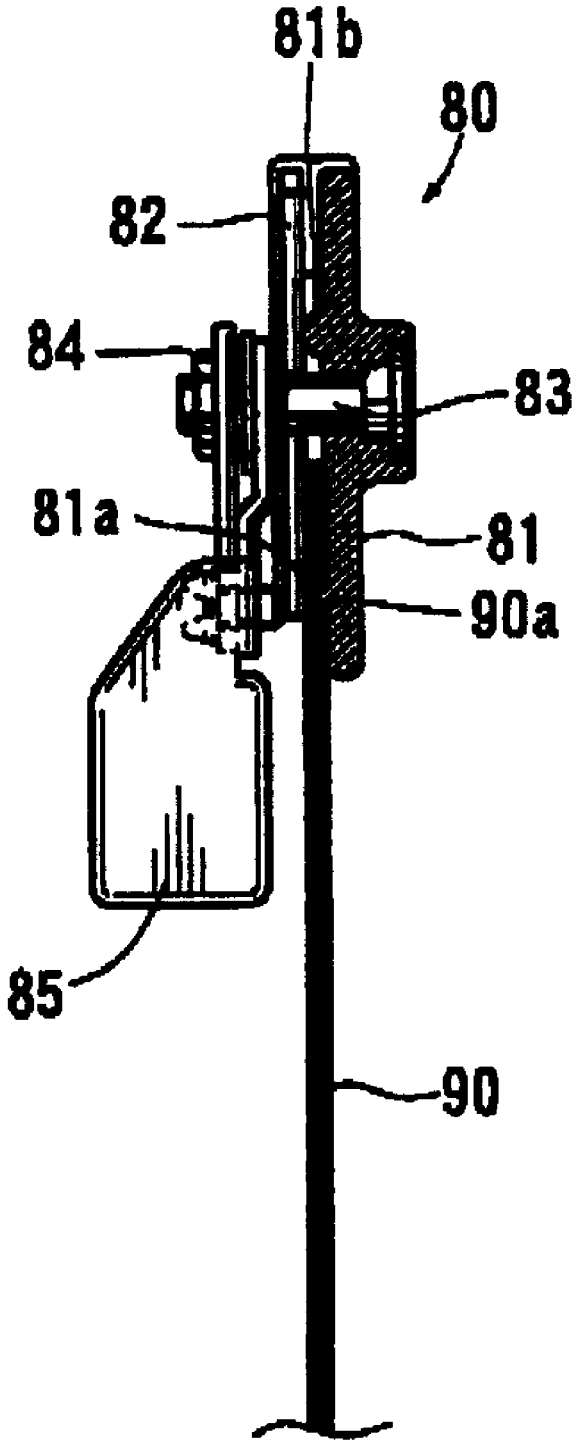
FIG. 20 is a rear partially sectional view as viewed in the direction of arrow (20) in FIG. 19.

In order to remove the cover C from the riving knife 90, the operator may pivot the lever 85 to a removing position, as indicated by chain lines in FIG. 19. As a result, the tightening force applied by the nut 84 is released to permit displacement of the clamp base 82 relative to the mount base 81. In this state, the clamp base 82 can be pivoted about the support projection 81*b*. Therefore, by pressing the upper portion of the clamp base 82 (i.e., essentially the surface of the clamp base 82 located above the threaded shaft 83 and the support projection 81*b*), the operator can pivot the clamp base 82 about the support projection 81*b* such that lower end of the clamp base 82 moves away from the engaging projection 81*a*. Consequently, the engaging projection 81*a* may be removed from the engaging recess 90*a*. The support device 80 and consequently the cover C can then be removed from the riving knife 90.

As described above, according to the fifth representative embodiment the cover C can be easily mounted to and removed from the riving knife 90. Therefore, it is not necessary to completely remove the riving knife 90 in order to perform a groove forming operation. As a result, the preparation for a groove forming operation can be rapidly and efficiently performed.

Further, in this representative embodiment the support device 80 can be fixed in position relative to the riving knife 90 by clamping the riving knife 90 between the mount base 81 and the clamp base 82 through the pivotal operation of the lever 85. Therefore, no additional or separate tightening tool, such as a spanner, wrench, or key, for example, is necessary for mounting and removing the cover C.

Sixth Representative Embodiment

Figure 55:
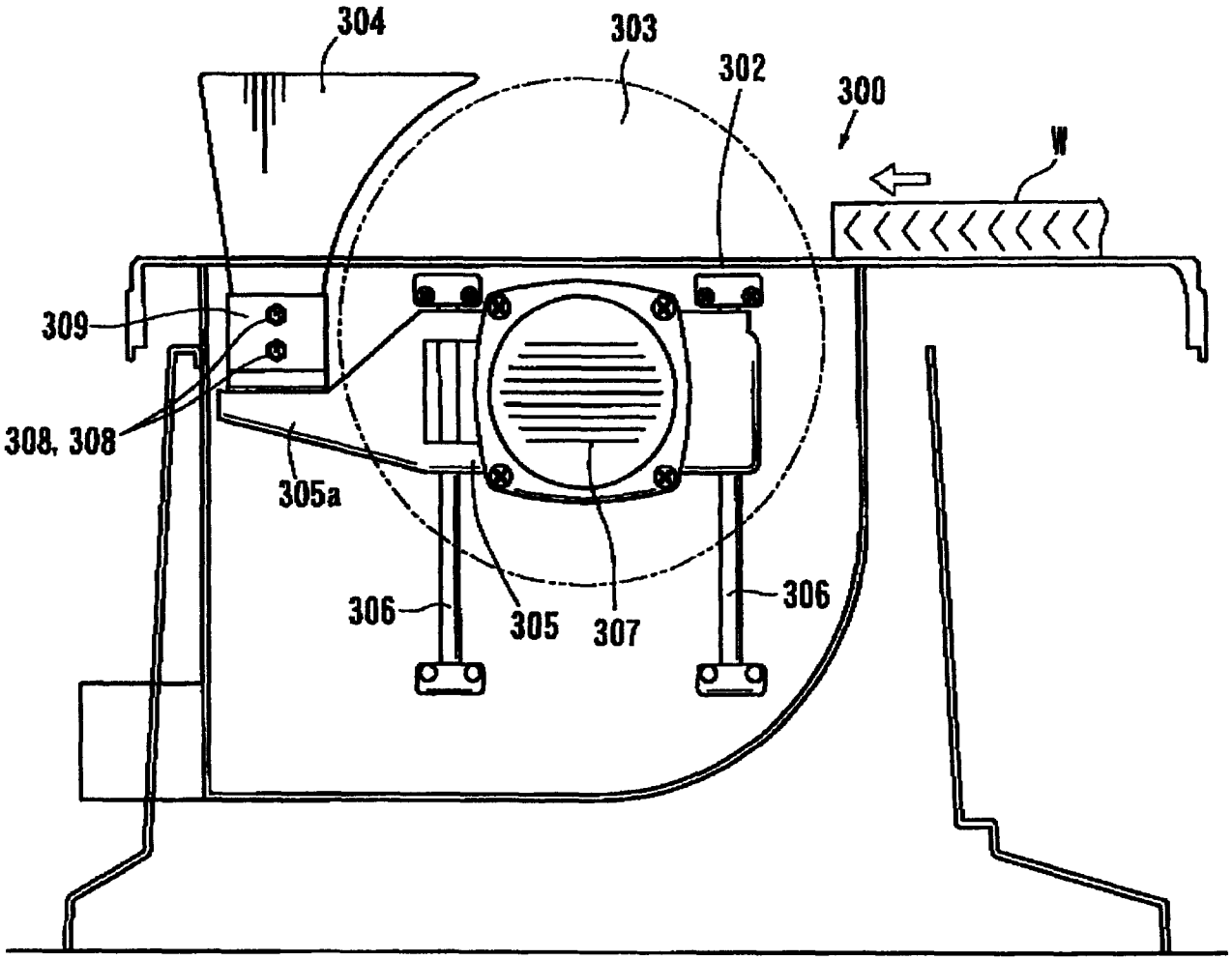
FIG. 55 PRIOR ART
FIG. 55 is a side view of a table saw incorporating a known structure for mounting a riving knife to the table saw.

The sixth representative embodiment will now be described with reference to FIGS. 21 to 25. This representative embodiment, as well as the seventh to eleventh representative embodiments that will be explained later, relate to the mounting structures of riving knives to table saws. The other constructions of the table saws may be the same as the table saw shown in FIG. 55.

Figure 21:
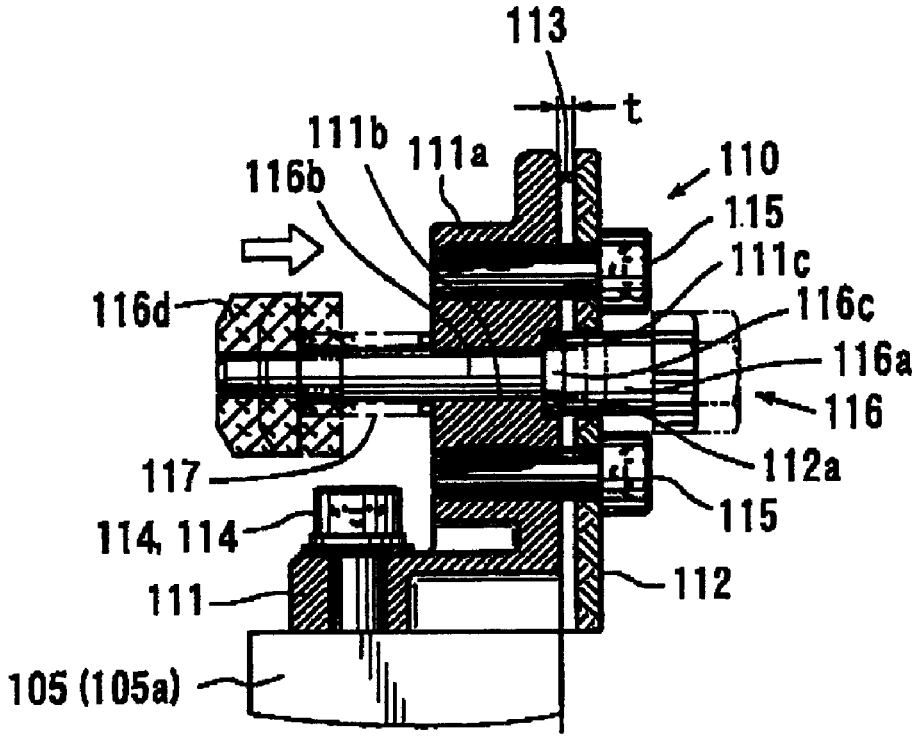
FIG. 21 is a sectional view of a mounting device for mounting a riving knife according to a sixth representative embodiment of the present invention and showing the state where the riving knife is not mounted to the mounting device and also showing various positions of an operation rod that is pushed by an operator.
Figure 22:
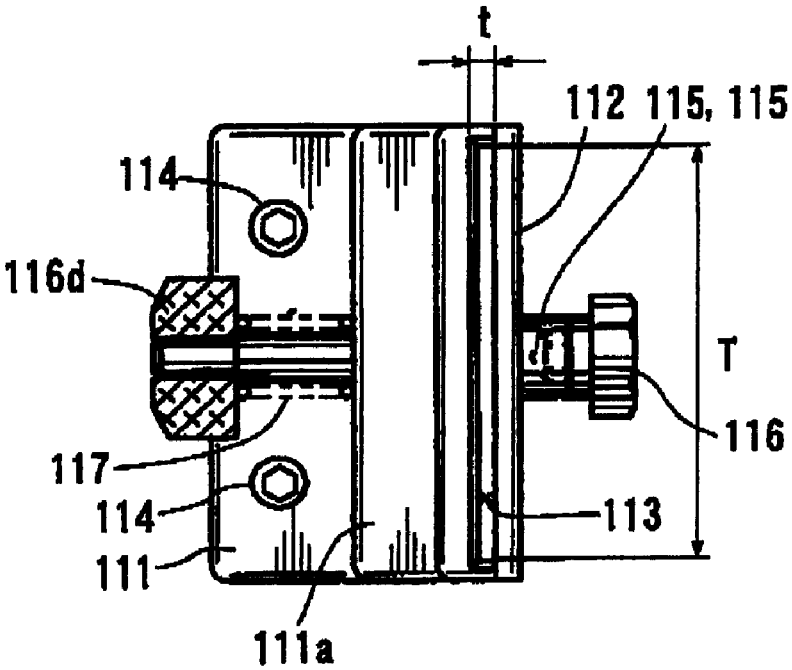
FIG. 22 is a plan view of the mounting device of FIG. 21.

Referring to FIGS. 21 and 22, a mounting device 110 includes a mount base 111 and a holder plate 112. The holder plate 112 is fixedly mounted to an upright portion 111*a* of the mount base 111 by, for example, bolts 115. A mount recess 113 is defined between the upright portion 111*a* and the holder plate 112 in order to permit insertion of a base portion L1*a* of a riving knife L1. The mount base 111 is secured to an extension 105*a* of a mount 105 of a table saw by, for example, bolts 114. The mount 105 and its extension 105*a* correspond to the mount 305 and the extension 305*a* of the known table saw shown in FIG. 55.

As shown in FIGS. 21 and 22, the length T and width t of the mount recess 113 are determined such that the base portion L1*a* of the riving knife L1 can be received without substantial clearance (i.e., closely fitted). A headed lock pin 116 is inserted thought the upright portion 111*a* of the mount base 111 and the holder plate 112 in the direction of thickness of these elements. The lock pin 116 has a large diameter portion 116*a* and a small diameter portion 116*b*. One end (i.e., the left end in FIGS. 21 and 23) of the large diameter portion 116*a* on the side of the small diameter portion 116*b* is configured as a tapered portion 116*c*, substantially defining a truncated conical surface. The large diameter portion 116*a* is slidably (i.e., axially movable) inserted into a large insertion hole 112*a* formed in the holder plate 112. The small diameter portion 116*b* is slidably (i.e., axially movable) inserted into a small insertion hole 111*b* formed in the upright portion 111*a* of the mount base 111. A relief recess 111*c*, having a predetermined depth and the same diameter as the large insertion hole 112*a*, is formed in the upright portion 111*a* of the mount base 111. The relief recess 111*c* is formed around one end of the insertion hole 111*b* on the side of the holder plate 112.

Figure 23:
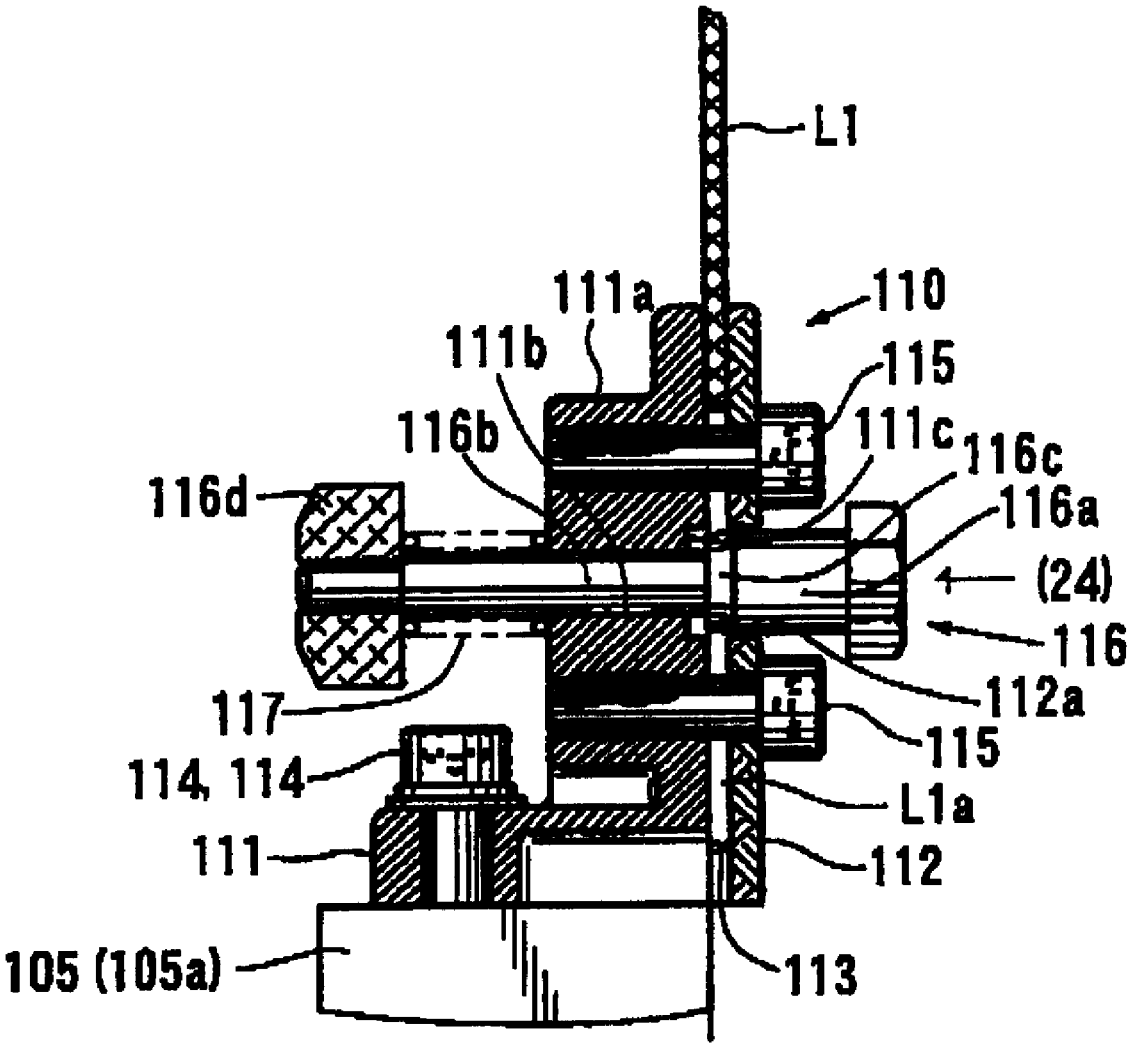
FIG. 23 is a vertical sectional view of the mounting device and showing the state where the riving knife has been mounted to the mounting device.
Figure 24:
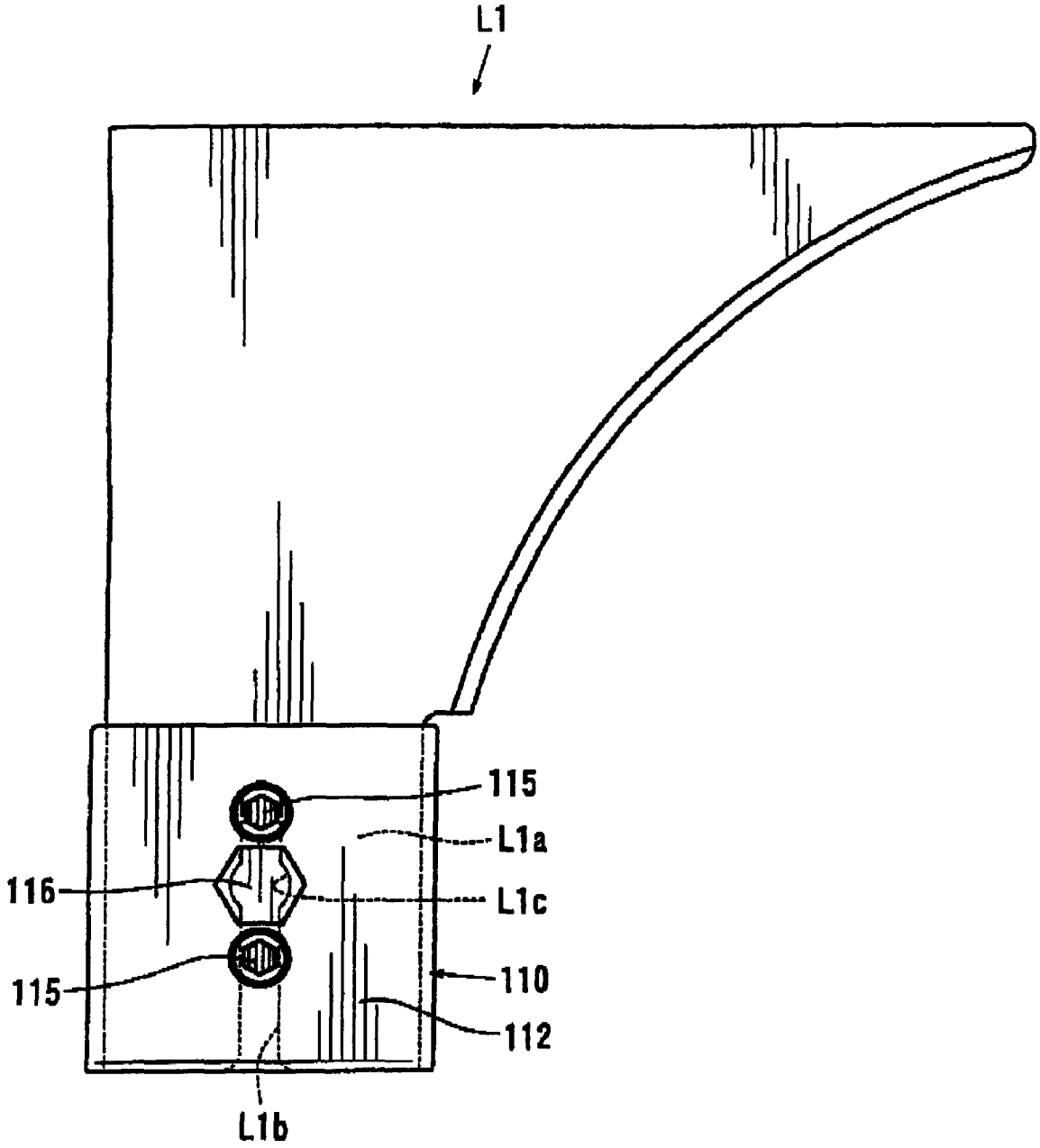
FIG. 24 is a view of the mounting device as viewed in the direction of arrow (24) in FIG. 23.

The small diameter portion 116*b* of the lock pin 116 extends outward from the left side of the upright portion 111*a* via the insertion hole 111*b* (as viewed in FIGS. 21 to 23). A flange 116*d* is mounted to the extended end of the small diameter portion 116*b*. A compression coil spring 117, for example, is interposed between the flange 116*b* and the upright portion 111*a* in order to normally bias the lock pin 116 in a left direction, which direction will be hereinafter called a "locking direction."

FIG. 21 shows the state in which no base portion L1*a* of the riving knife L1 is inserted into the mount recess 113. Therefore, in this configuration the tapered portion 116*c* of the large diameter portion 116*a* of the lock pin 116 enters the relief recess 111*c* as a result of the biasing force of the compression coil spring 117.

Figure 25:
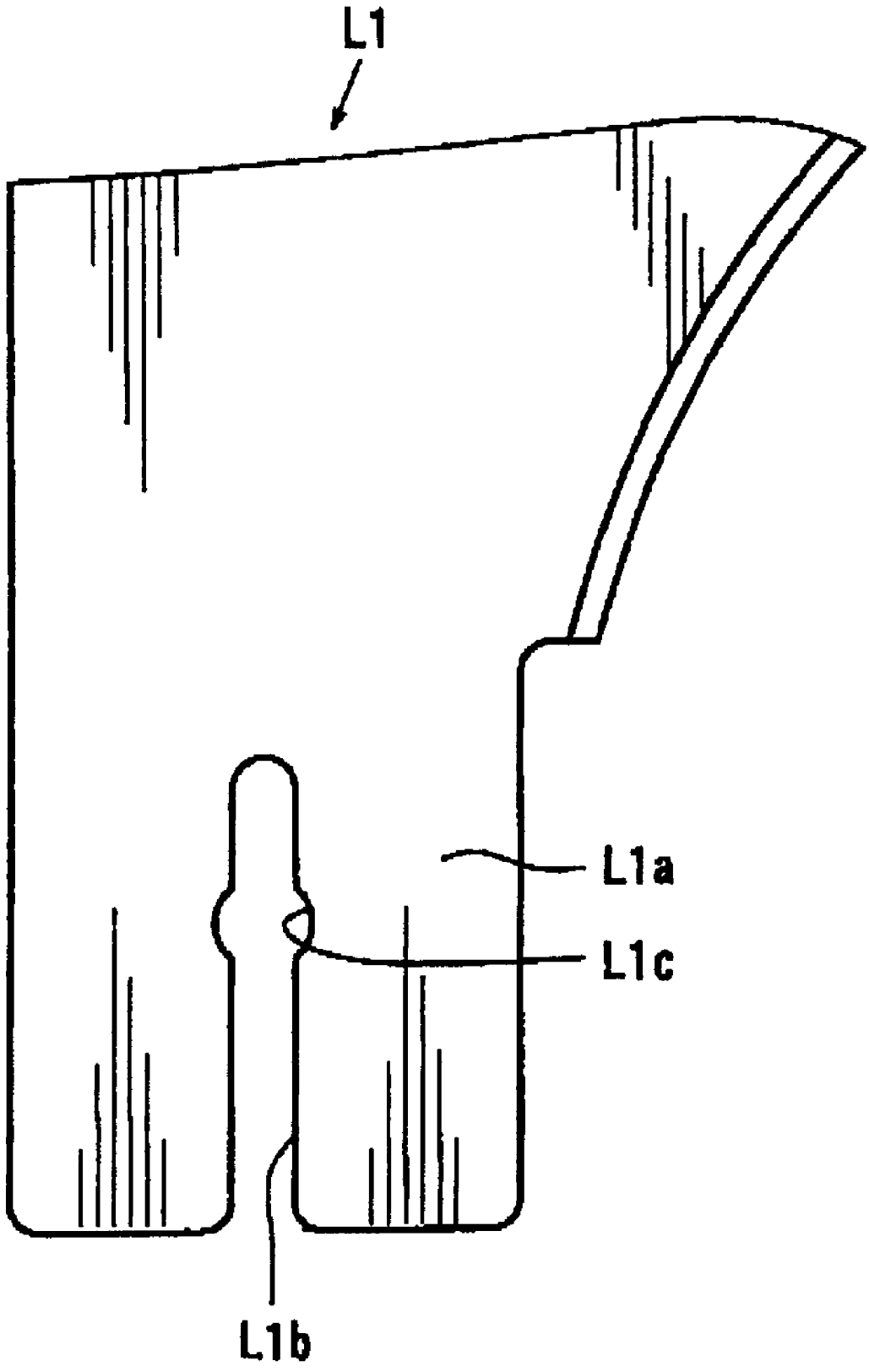
FIG. 25 is a side view of a base portion of the riving knife.
Figure 26:
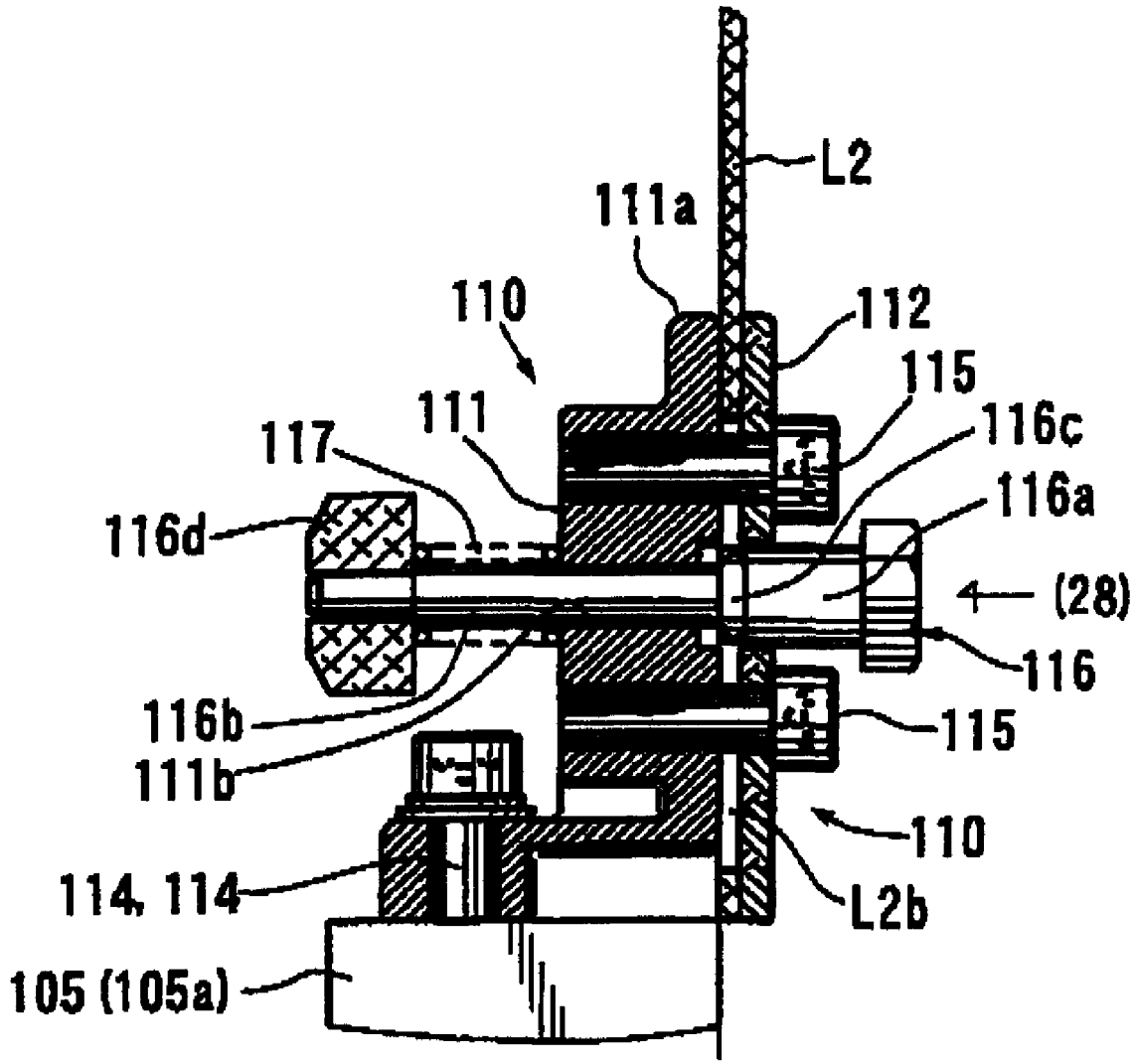
FIG. 26 is a modification of the sixth representative embodiment showing a mounting device and a vertically adjustable riving knife mounted to the mounting device.
Figure 27:
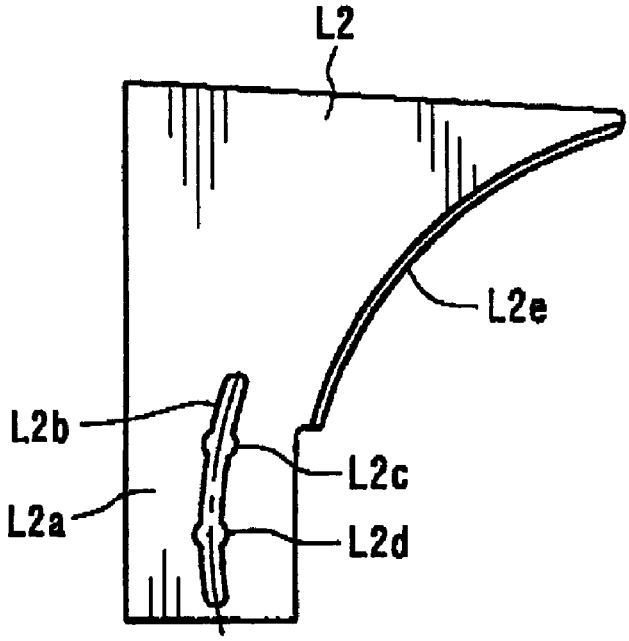
FIG. 27 is a side view of the vertically adjustable riving knife shown in FIG. 26.
Figure 28:
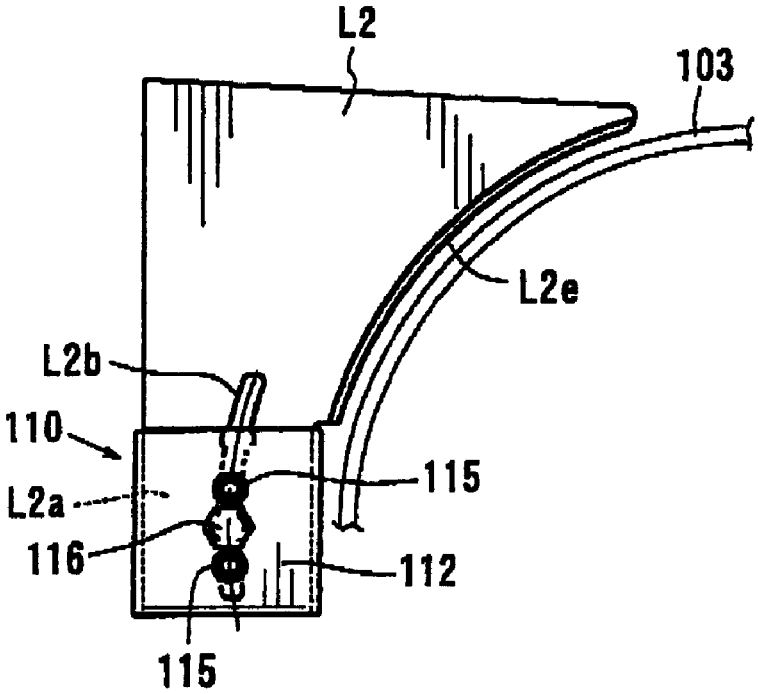
FIG. 28 is a view of the mounting device as viewed in a direction of arrow (28) in FIG. 26.
Figure 29:
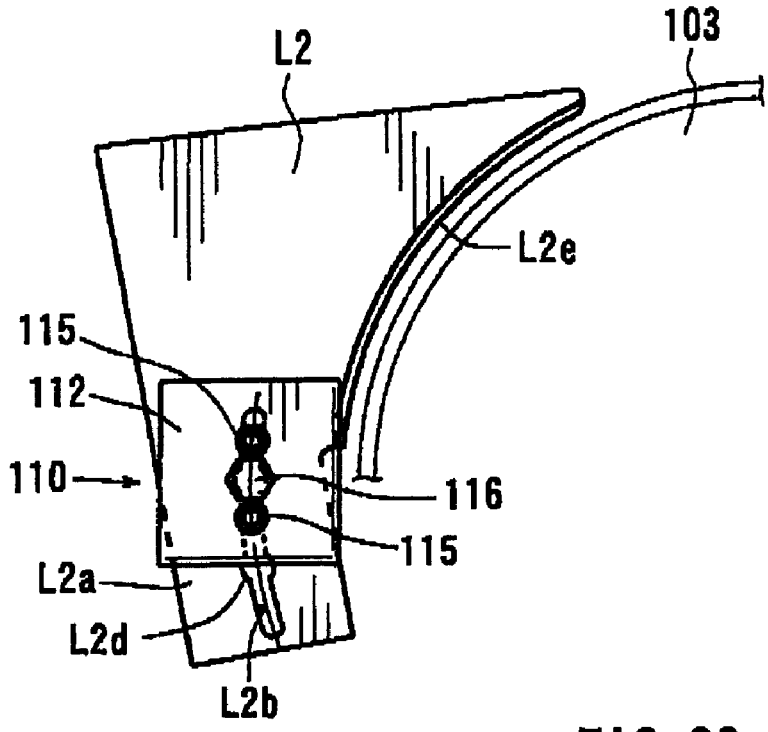
FIG. 29 is a view similar to FIG. 28 but showing a different mounting height of the vertically adjustable riving knife.
Figure 30:
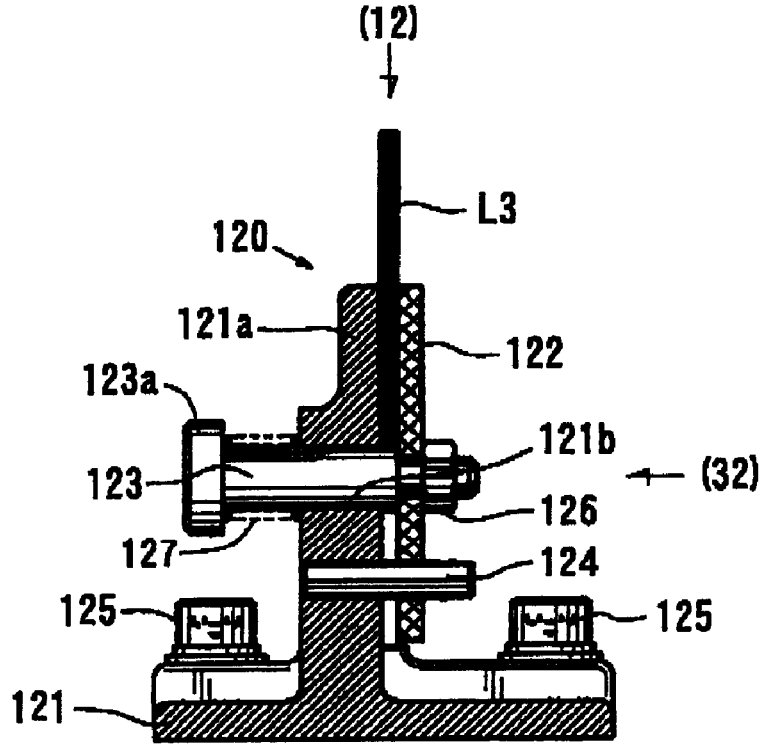
FIG. 30 is a vertical sectional view of a mounting device for mounting a riving knife according to a seventh representative embodiment.
Figure 31:
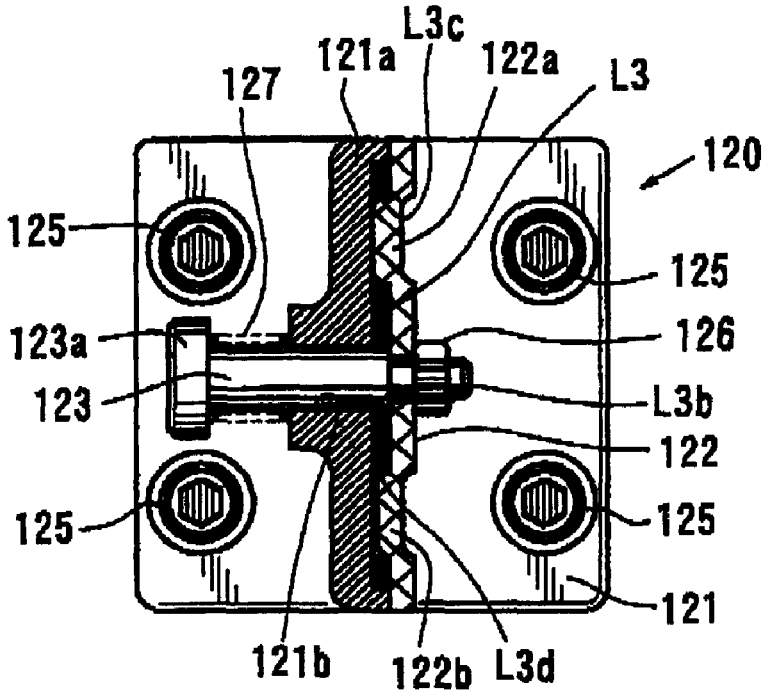
FIG. 31 is a partially sectional plan view of the mounting device of FIG. 30.
Figure 32:
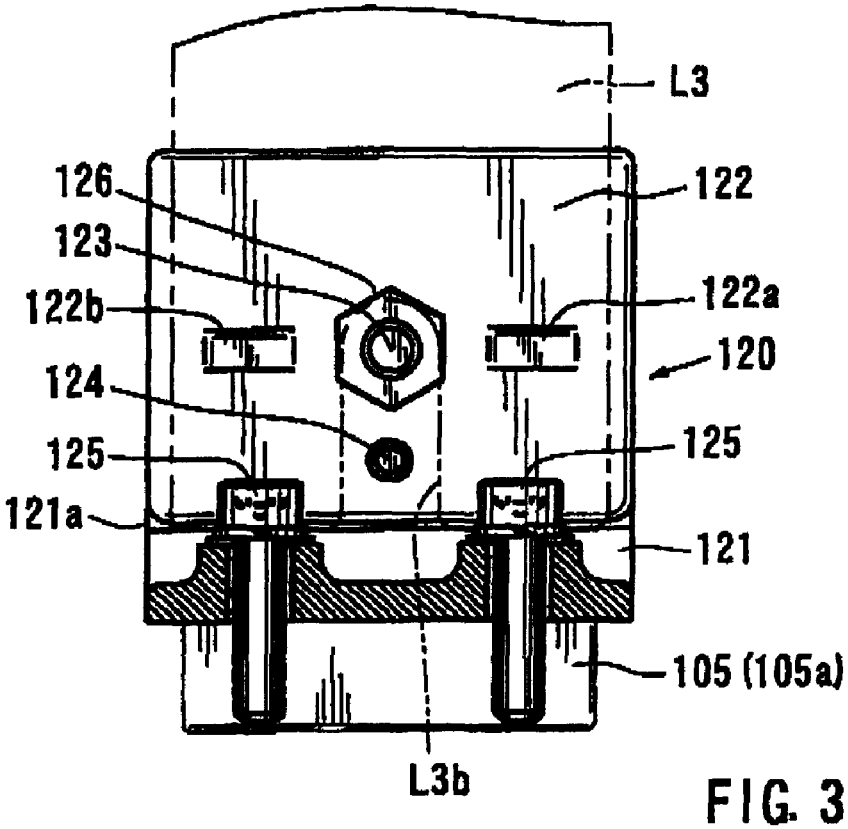
FIG. 32 is a partially sectional view of the mounting device as viewed in the direction of arrow (32) in FIG. 30.

The mounting device 110 may be mounted to a riving knife L1 that is best shown in FIG. 25. A substantially linear mount slot L1*b* is formed in the base portion L1*a* of the riving knife L1 and extends in the vertical direction. The mount slot L1*b* has a closed upper end and an opened lower end. In addition, the middle portion of the mount slot L1*b* is configured as a circular lock hole Lie that has a slightly smaller diameter than the diameter of the large diameter portion 116*a* of the lock pin 116. The remaining portion of the mount slot L1*b* has a width that is slightly greater than the diameter of the small diameter portion 116*b* of the lock pin 116 and the diameter of the bolts 115.

The riving knife L1 can be easily mounted to and removed from the mounting device 110 by performing the following operations. In the state shown in FIG. 21, where the riving knife L1 is not yet mounted, the operator may press the lock pin 116 from the side of the flange 116*d* against the biasing force of the spring 117, as indicated by an outline arrow in FIG. 21. This action positions the small diameter portion 116*b* of the lock pin 116 within or across the mount recess 113. In FIG. 21, solid lines indicate the position of the lock pin 116 prior to the pressing operation and chain lines indicate the position of the lock pin 116 after the pressing operation (i.e., hereinafter called the "unlock position").

With the lock pin 116 held in the unlock position, the operator may men insert the base portion L1*a* of the riving knife L1 into the mount recess 113 of the mount device 110. During this insertion operation, the shanks of the bolts 115 and the small diameter portion 116*b* of the lock pin 116 may enter the mount slot L1*b* of the base portion L1*a*.

When the base portion L1*a* has been inserted to a position where the axis of the lock pin 116 is substantially aligned with the center of the lock hole Lie, the operator may release the pressing force applied to the lock pin 116. The lock pin 116 may then move leftward as viewed in FIG. 21 as a result of the biasing force of the spring 117. When the lock pin 116 reaches the lock position, the large diameter portion 116*a* of the lock pin 116 engages the lock hole Lie of the base portion L1*a*. The base portion L1*a* may therefore be prevented or inhibited from being removed from the mount recess 113. In this way, the riving knife L1 is mounted to the mounting device 110 and correspondingly to the extension 105*a* of the mount 105 of the table saw.

In order to remove the riving knife L1 from the mounting device 110, the operator may press the lock pin 116 towards the unlock position against the biasing force of the spring 117, as indicated by the arrow in FIG. 21. When the lock pin 116 reaches the unlock position, the large diameter portion 116*a* may be disengaged from the lock hole Lie and the small diameter portion 116*b* may be positioned within the lock hole Lie. Therefore, with the lock pin 116 held in an unlock position, the operator may remove the base portion L1*a* from the mount recess 113. As a result, the riving knife L1 can be removed from the mounting device 105 and consequently from the mount 105.

In this way, by pressing the lock pin 116 the base portion L1*a* of the riving knife L1 can be inserted into the mount recess 113 of the mounting device 110. In addition, by releasing the lock pin 116 after the base portion L1*a* has been inserted into the mount recess 113, the riving knife L1 can be mounted to the mounting device 110. Further, by simply pressing the lock pin 116 again, the base portion L1*a* can be removed from the mount recess 113, allowing the riving knife L1 to be removed from the mounting device 110. As a result, the riving knife L1 can be easily mounted to and removed from the mount 105 of the table saw in comparison with the conventional mounting structure shown in FIG. 55, in which the riving knife 304 is mounted to the mount 305 by means of bolts 308.

Although the lock pin 116 is moved from the lock position to the unlock position by pressing the lock pin 116 from the side of the flange 116*d*, a knob may be mounted to the lock pin 116 on the side opposite to the flange 116*d*. In such a configuration, the lock pin 116 may be moved from the lock position to the unlock position by pulling the lock pin 116 via the knob. The same operations and advantages as the sixth representative embodiment can be achieved by this alternative arrangement.

Although the riving knife L1 has a single lock hole Lie along the mount slot L1*b*, two or more lock holes Lie may be formed at suitable intervals along the mount slot L1*b*. This arrangement enables the operator to easily adjust the mounting height of the riving knife L1.

Another modification of the sixth representative embodiment is shown in FIGS. 26 to 29. In this modification, the same mounting device 110 as in the sixth representative embodiment is used for mounting the riving knife L2 shown in FIG. 27. The riving knife L2 has a base portion L2*a*. A mount slot L2*b* is formed in the base portion L2*a*. The mount slot L2*b* differs from the mount slot L1*b* of the sixth representative embodiment in that the mount slot L2*b* extends along an arc having a radius of curvature about the rotational axis of a cutting blade 103. The cutting blade 103 corresponds to the cutting blade 303 shown in FIG. 55. In addition the mount slot L2*b* is closed at each opposing end. Further, circular lock holes L2*c* and L2*d* are formed in the base portion L2*a* along the mount slot L2*b* at positions spaced apart from each other.

In order to mount the riving knife L2 to the mounting device 110, the holder plate 112 is initially removed from the mount base 111 by loosening and removing the bolts 115, the flange 116*d*, and the spring 117. The bolts 115 and the small diameter portion 116*b* of the lock pin 116 are inserted into the mount slot L2*b* of the riving knife L2. Thereafter, the bolts 115 and the small diameter portion 116*b* of the lock pin 116 are engaged with the upright portion 111*a* of the mount base 111. Finally the bolts 115 and the flange 116*d*, after having previously attached the spring 117, may be tightened to mount the holder plate 112 to the upright portion 111*a* of the mount base 111. In this way, the base portion L2*a* of the riving knife L2 can be positioned within the mount recess 113 of the mounting device 110.

With the base portion L2*a* set as described above, the vertical position of the riving knife L2 can be changed by pressing the lock pin 116 towards the unlock position (i.e., to the right in FIG. 26) in order to position the small diameter portion 116*a* within the mount slot L2*b*. When the lock pin 116 is released with axis of the lock pin 116 substantially aligned with either the lock hole L2*c* or the lock hole L2*d*, the lock pin 116 moves toward the lock position due to die biasing force of the spring 117. Therefore, the large diameter portion 116*a* may engage either the lock hole L2*c* or the lock hole L2*d*, allowing the adjustment of the vertical position of the riving knife L2 to be accomplished. Since the large diameter portion 116*a* is closely fitted against the circumference of lock hole L2*c* or the lock hole L2*d* by the biasing force of the spring 117, the riving knife L2 can be reliably fixed in position relative to the mounting device 110.

Further, because the mount slot L2*b* of the riving knife 12 extends along an arc having a radius of curvature about the rotational axis of the cutting blade 103, the clearance between the cutting blade 103 and a front edge L2*e* of the riving knife 12 (i.e., positioned to follow the blade 103 in a cutting direction or a direction entering the split formed in a workpiece W) may be maintained, Irrespective of the change of height of the riving knife L2. Therefore, the riving knife 12 can be easily and quickly adjusted to smoothly enter the split formed in the workpiece W.

Although the mount slot L2*b* has closed ends in this representative embodiment, one end (e.g., the lower end) may be opened at the lower end of the base portion L2*a*. With this configuration the mounting and removing operation of the riving knife L2 can be made in the same manner as the riving knife L1 of the sixth representative embodiment (see FIG. 25).

Seventh Representative Embodiment

The seventh representative embodiment will now be described with reference to FIGS. 30 to 33, which show a mounting device 120 and a riving knife 13 that is applied to the mount device 120.

The mounting device 120 includes a mount base 121, a holder plate 122, and an operation rod 123. The mount base 121 is mounted to the mount 105 of the table saw. More specifically, the mount base 121 may be mounted to the extension 105*a* of the mount 105 by, for example, four bolts 125. The holder plate 122 is positioned to oppose to an upright portion 121*a* of the mount base 121. The operation rod 123 is mounted to the holder plate 122.

A support pin 124 is fixed to the upright portion 121*a* of the mount base 121 and slidably supports the lower portion of the holder plate 122. Therefore, the holder plate 122 can remain substantial parallel to the upright portion 121*a* as the holder plate 122 moves towards and away from the upright portion 121*a* (i.e., in the left and right directions as viewed in FIG. 30) along the support pin 124.

The operation rod 123 is slidably (i.e. axially movable) inserted into an insertion hole 121*b* that is formed to extend through the thickness of the central portion of the upright portion 121*a* of the mount base 121. One end of the operation rod 123 is secured to a central portion of the holder plate 122 via a nut 126, for example. Therefore, the holder plate 122 is slidably attached to the upright portion 121*a* via the operation rod 123 and the support pin 124 such that the holder plate 122 can in the axial direction of the operation rod 123. The combination of the operation rod 123 and the support pin 124 restrain the holder plate 122 from rotating about either the operation rod 123 or the support pin 124. During the movement of the holder plate 122, the holder plate 122 is maintained substantially parallel to the upright portion 121*a* of the mount base 121.

The other end of the operation rod 123 (i.e., the left end as viewed in FIGS. 30 and 31) extends outward from the upright portion 121*a*. A flange 123*a* is formed on the extended end of the operation rod 123. A compression coil spring 127, for example, is interposed between the flange 123*a* and the upright portion 121*a* causing the operation rod 123 to be biased leftward, as viewed in FIGS. 30 and 31. When the operator pushes the operation rod 123 rightward as viewed in FIGS. 30 and 31, towards an unlock position, via the flange 123*a* and against the biasing force of the spring 127, the holder plate 122 moves rightward together with the operation rod 123.

When the operation rod 123 reaches an unlock position, a space is established between the holder plate 122 and the upright portion 121*a* of the mount base 121, permitting the insertion of a base portion L3*a* of the riving knife L3. A pair of right and left engaging projections 122*a* and 122*b* (see FIGS. 31 and 32) is formed on a surface of the holder plate 122 in a direction opposing the upright portion 121*a*.

Figure 33:
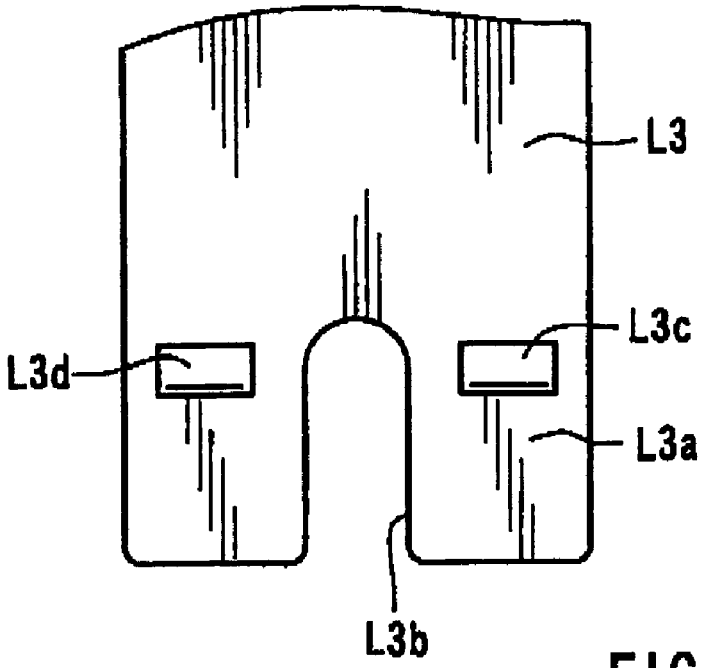
FIG. 33 is a side view of a riving knife adapted to be mounted to the mounting device of the seventh representative embodiment.

As shown in FIG. 33, a mount slot L3*b* having a closed upper end and an open lower end is formed in the base portion L3*a* of the riving knife L3. In addition, a pair of right and left engaging slots L3*c* and L3*d*, corresponding to the pair of the right and left engaging projections 122*a* and 122*b*, is formed in the riving knife L3. One engaging slot L3*c* or L3*d* is located on one side of the mount slot L3*b*, and the other engaging slot L3*d* or L3*c* is located on the other side of the mount slot L3*b*.

According to the seventh representative embodiment described above, the operator may push the operation rod 123 towards the unlock position against the biasing force of the spring 127 and may then insert the base portion L3*a* of the riving knife L3 into the space formed between the holder plate 122 and the upright portion 121*a* of the mount base 121. Thereafter, the operator may release the operation rod 123, so that the operation rod 123 moves leftward, as viewed in FIGS. 30 and 31, towards a lock position. As a result, the base portion L3*a* of the riving knife L3 is clamped between the upright portion 121*a* of the mount base 121 and the holder plate 122 by the biasing force of the spring 127. At the same time, the engaging projections 122*a* and 122*b* respectively engage the engaging slots L3*c* and 13*d*. The base portion L3*a* may be prevented from being inadvertently removed from the space between the upright portion 121*a* and the holder plate 122. In this way, the riving knife L3 may be mounted to the mounting device 120 and correspondingly to the mount 105 of the table saw.

In order to remove the riving knife L3 from the mounting device 120, the operator may push the operation rod 123 to move the operation rod 123 to the unlock position. The operator holds the operation rod 123 in the unlock position. The operator can then remove the base portion L3*a* of the riving knife L3 from the space between the upright portion 121*a* and the holder plate 122.

As described above, with the mounting device 120 of the seventh representative embodiment, the riving knife L3 can be easily mounted to and removed from the mounting device 120 by the operation of the operation rod 123.

Eight Representative Embodiment

The eighth representative embodiment will now be described with reference to FIGS. 34 to 36. This representative embodiment is a modification of the seventh representative embodiment. Therefore, like members are given the same reference numerals as in the seventh representative embodiment, and the description of these elements may not be repeated.

In this representative embodiment, a mounting device 130 is adapted to mount a riving knife L4. As shown in FIG. 36, the riving knife L4 includes an elongated linear engaging projection L4*b*. The engaging projection L4*b* extends across the entire width of a base portion L4*a* of the riving knife L4. When mounted, the engaging projection L4*b* protrudes in a direction towards a holder plate 131 of the mounting device 130.

Figure 34:
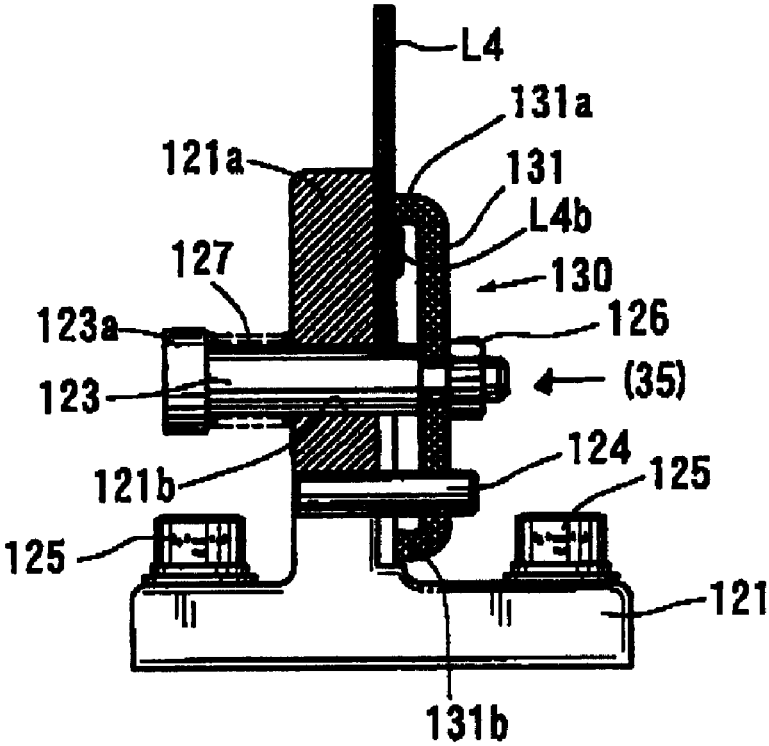
FIG. 34 is a vertical cross-sectional view of a mounting device for mounting a riving knife according to an eighth representative embodiment.

The holder plate 131 includes an upper engaging edge 131*a* and a lower engaging edge 131*b* that are bent leftward as viewed in FIG. 34. In the mounted state of the riving knife L4 shown in FIG. 34, the upper engaging edge 131*a* is positioned just above the engaging projection L4*b* of the riving knife L4. Therefore, the riving knife L4 may be prevented from being removed upward from the space formed between the upright portion 121*a* of the mount base 121 and the holder plate 131.

Figure 36:
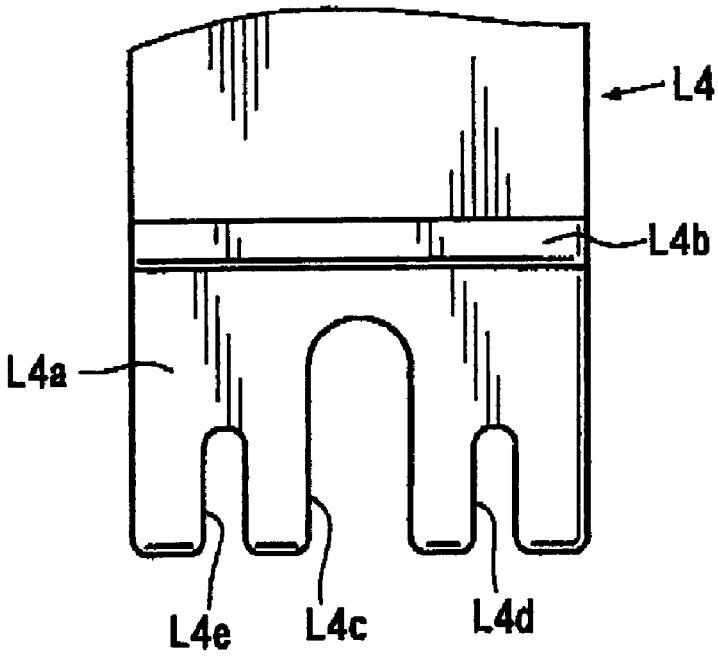
FIG. 36 is a side view of a riving knife adapted to be mounted to the mounting device of the eighth representative embodiment.

In addition, as shown in FIG. 36, a mount slot L4*c* is formed in the base portion L4*a* of the riving knife L4. The mount slot L4*c* is disposed centrally with respect to the width of the base portion L4*a*. A pair of right and left auxiliary slots L4*d* and L4*e* is also formed in the base portion L4*a*. Mount slot L4*c* is located between right and left auxiliary slots L4*d* and L4*e*. The mount slot L4*c* and the right and left auxiliary slots L4*d* and L4*e* each have a closed upper end and an opened lower end.

Figure 35:
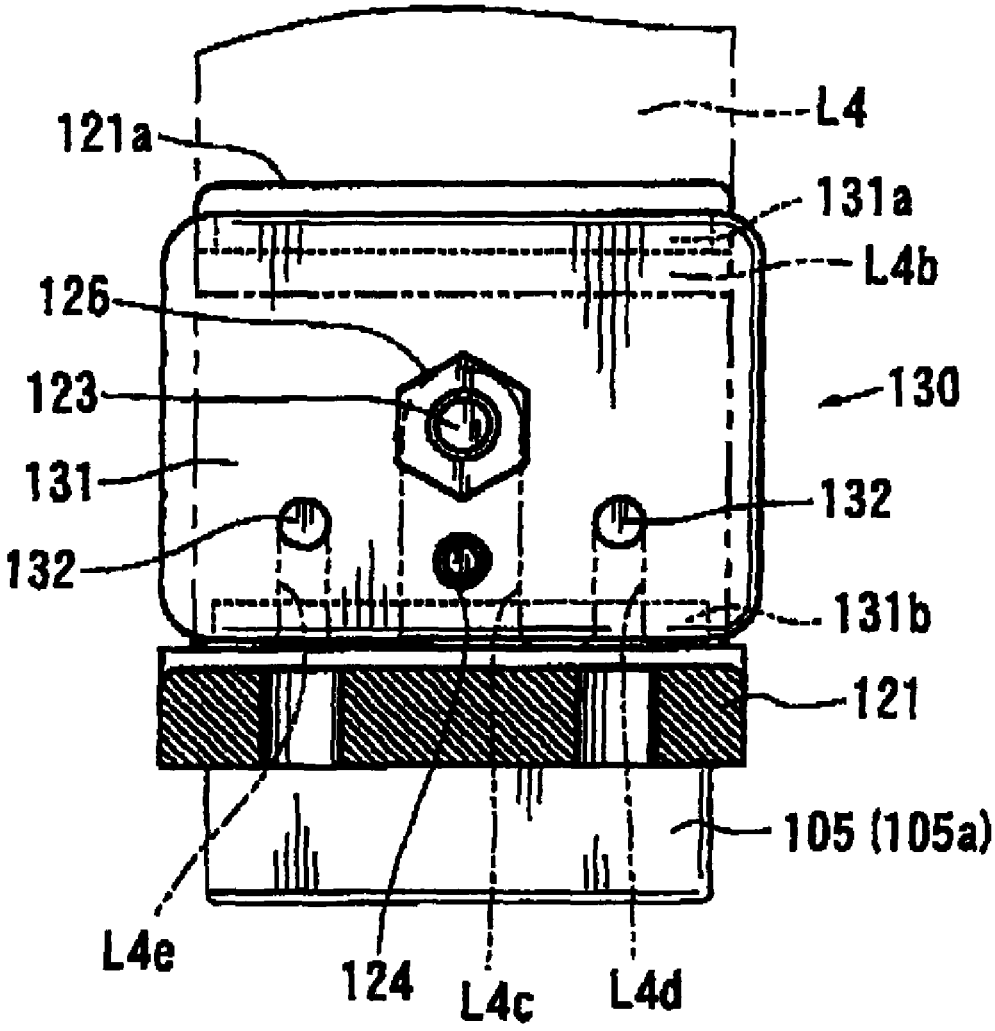
FIG. 35 is a partially sectional view of the mounting device as viewed in a direction of arrow (35) in FIG. 34.

In the mounted state of the riving knife L4, as shown in FIG. 35, the operation rod 123 and the support rod 124 are both inserted into the central mount slot L4*c*. Two rotation prevention pins 132 are each respectively inserted into the auxiliary slots L4*d* and L4*e*. One end of each of the rotation prevention pins 132 is fixed to the upright portion 121*a* of the mount base 121 so that the rotation prevention pins 132 extend parallel to each other towards the holder plate 131. The other end of each of the rotation prevention pins 132 is slidably inserted into the holder plate 131. Therefore, the holder plate 131 is supported by the operation rod 123, the support pin 124 and the rotation prevent pins 132, such that the holder plate 131 can move relative to the upright portion 121*a* of the mount base 121 along a substantially parallel displacement.

According to the eighth representative embodiment, when the operator pushes the operation rod 123 toward the unlock direction (i.e. right direction as viewed in FIG. 34) against the biasing force of the spring 127, the holder plate 131 moves together with the operation rod 123 toward the unlock direction. A space is formed between the upright portion 121*a* of the mount base 121 and the holder plate 131, permitting insertion of the base portion L4*a* of the riving knife L4.

With the operation rod 123 held in the unlock position, the operator may insert the base portion L4*a* of the riving knife L4 into the space between the upright portion 121*a* and the holder plate 131. The operator may then release the operation rod 123 so that the operation rod 123 moves towards the lock position (i.e., leftward as viewed in FIG. 34) as a result of the biasing force of the spring 127.

When the operation rod 123 returns to the lock position together with the holder plate 131, the riving knife L4 is clamped between the holder plate 131 and the upright portion 121*a*. More specifically, the upper and lower engaging edges 131*a* and 131*b* of the holder plate 131 are pressed against the surface of the base portion L4*a* of the riving knife L4. The upper engaging edge 131*a* is positioned just above the engaging projection L4*b* of the base portion L4*a*. Therefore, the base portion L4*a* may be prevented from being removed from the space between the upright portion 121*a* of the mount base 121 and the holder plate 131. In addition, the rotation prevention pins 132 may be respectively inserted into the auxiliary slots L4*d* and L4*e*. Consequently, the rotation of the riving knife LA about the operation rod 123 (i.e., rotation in a clockwise or counterclockwise direction as viewed in FIG. 35) may be reliably prevented or inhibited.

As described above, with the mounting device 130 of the eighth representative embodiment, the riving knife LA can be easily mounted to and removed from the mounting device 130. In particular, according to the eighth representative embodiment, potential displacement of the mounted riving knife L4 in the widthwise direction can be reliably prevented.

Ninth Representative Embodiment

The ninth representative embodiment will now be described with reference to FIGS. 37 to 40. This representative embodiment is a modification of the eighth representative embodiment. Therefore, like members are given the same reference numerals as in the eighth representative embodiment and the description of these elements may not be repeated.

In this representative embodiment, a mounting device 140 is adapted to mount a riving knife L5. This representative embodiment differs from the eighth representative embodiment mainly in that the riving knife L5 can be mounted to and removed from the mounting device 140 by the operation of an operation lever 143.

Figure 37:
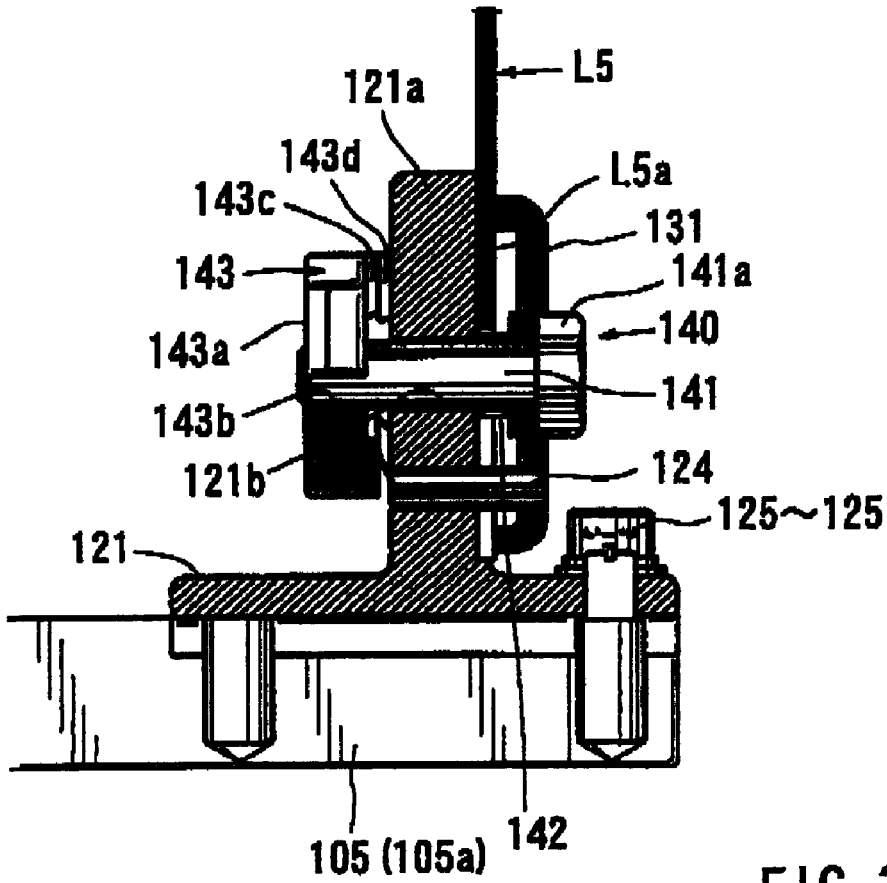
FIG. 37 is a vertical cross-sectional view of a mounting device for mounting a riving knife according to a ninth representative embodiment.
Figure 38:
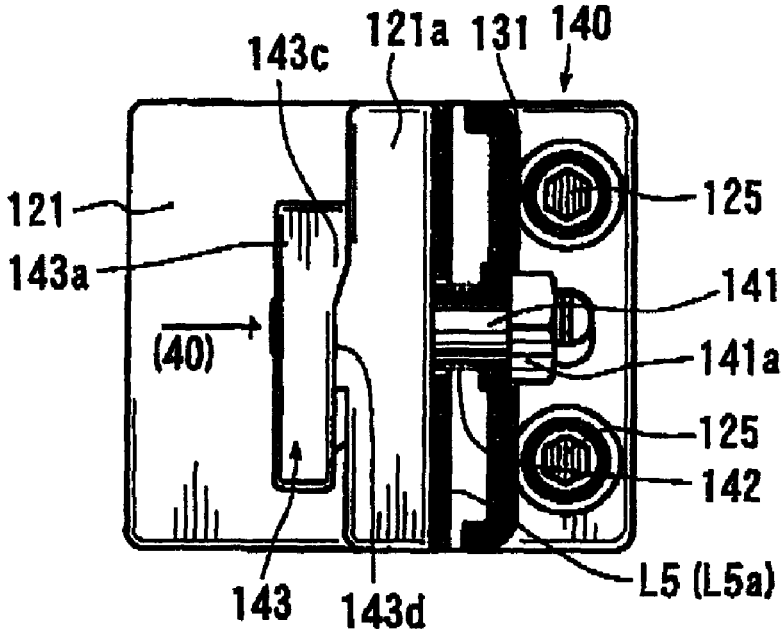
FIG. 38 is a partially sectional plan view of the mounting device of FIG. 37 showing the state where a holder plate is positioned in an unlock position.
Figure 39:
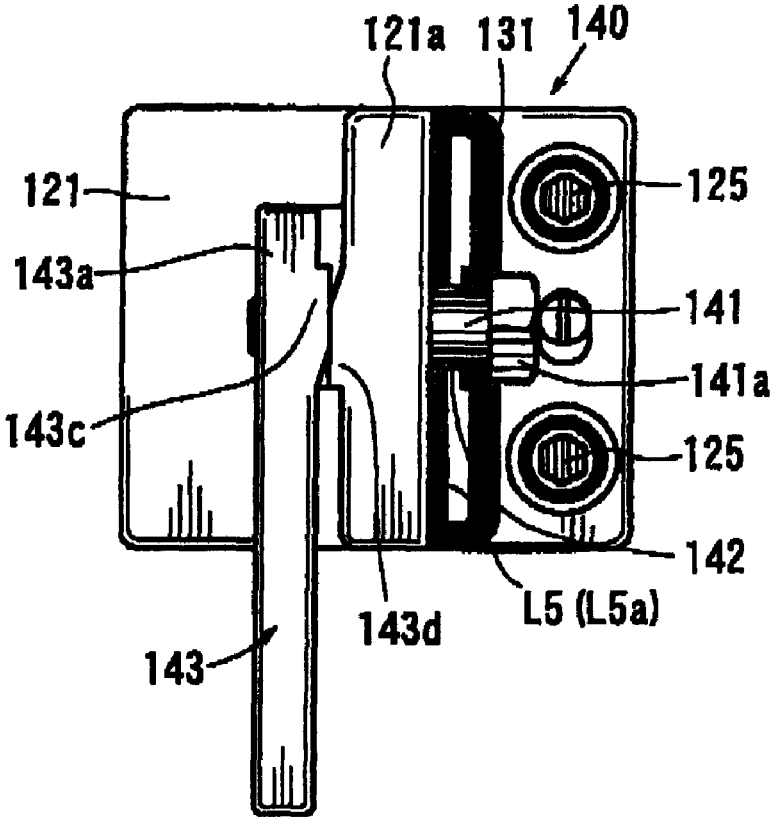
FIG. 39 is a partially sectional plan view similar to FIG. 38 but showing the state where the holder plate is positioned in a lock position.

As shown in FIG. 37, a threaded shaft 141 is mounted to the central portion of the holder plate 131. The holder plate 131 opposes the upright portion 121*a* of the mount base 121. The threaded shaft 141 is slidably (i.e., axially movable) inserted into an insertion hole 121*b*. The insertion hole 121*b* is formed in a central portion of the upright portion 121*a*. The threaded shaft 141 extends outward (i.e., leftward as viewed in FIG. 37) from the upright portion 121*a* on the side opposite to the side facing the holder plate 131. Preferably, the threaded shaft 141 may be a hexagon head bolt including a hexagonal head 141*a* and a right-handed thread pattern. The head 141*a* is engaged with a recess formed in the right side surface (as viewed in FIG. 37) of the holder plate 131. Consequently, the head 141*a* does not rotate relative to the holder plate 131. Since the holder plate 131 is prevented from rotating relative to the upright portion 121*a* of the mount base 121 as a result of the support pin 124, the threaded shaft 141 is also prevented from rotating relative to the upright portion 121*a*.

A compression coil spring 142 is fitted on the threaded shaft 141 and is interposed between the upright portion 121*a* and the holder plate 131. The holder plate 131 is biased in a direction away from the upright portion 121*a* (i.e., the right direction as viewed in FIG. 37).

The end portion of the threaded shaft 141 extends leftward beyond the upright portion 121*a*. The lever 143 is mounted to the end portion of the threaded shaft 141. A flange 143*a* is formed on one end of the operation lever 143 mounted to the threaded shaft 141. The threaded shaft 141 engages with a threaded hole 143*b* formed in a central portion of the flange 143*a*. The flange 143*a* and the operation lever 143 move axially along the threaded shaft 141 as the operation lever 143 is rotated.

Figure 40:
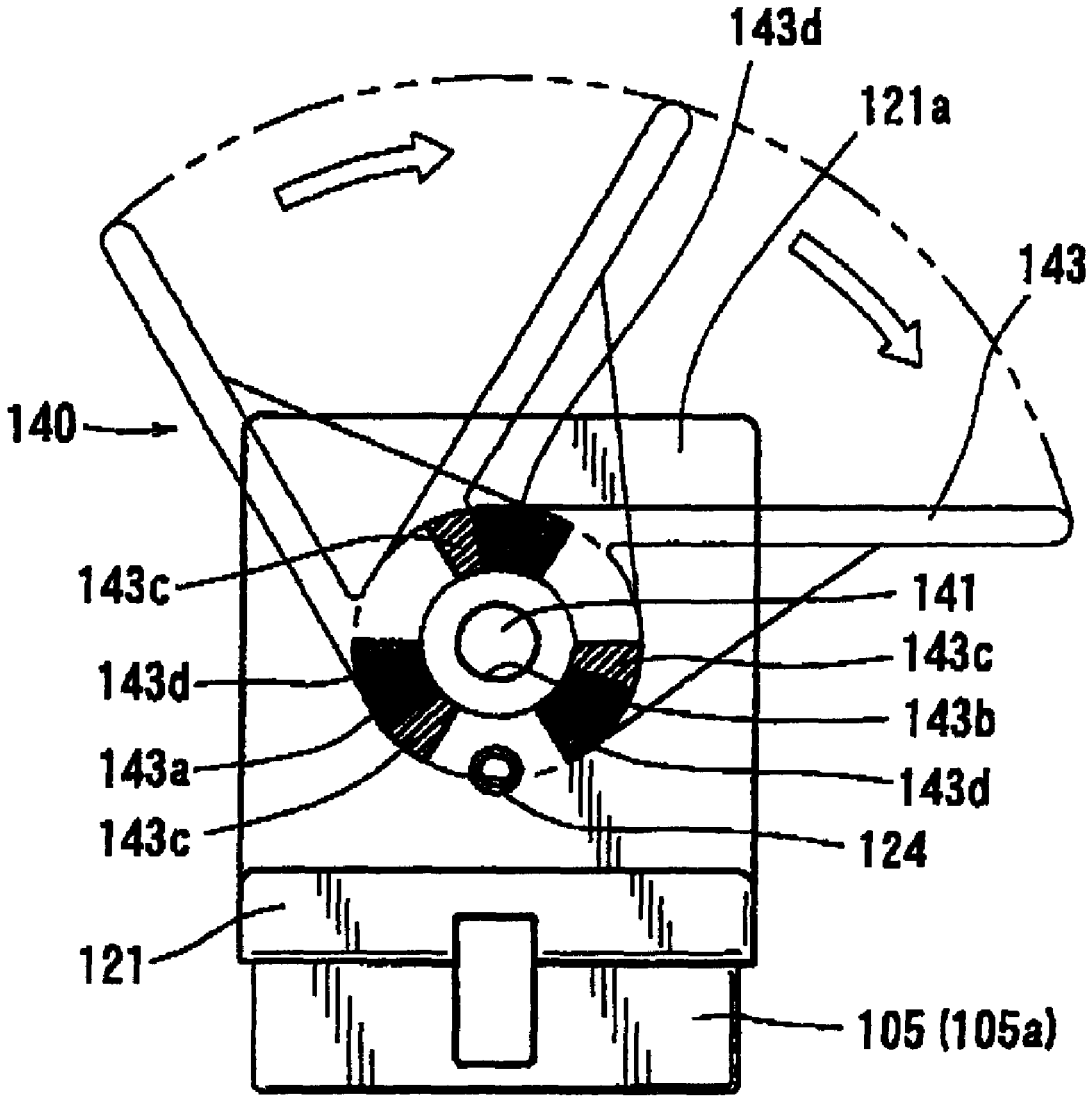
FIG. 40 is a view of the mounting device as viewed in the direction of arrow (40) in FIG. 38 and showing the relationship between opposing cam portions.

As shown in FIG. 40, three cam portions 143*c* are formed on the surface of the flange 143*a* of the operation lever 143. The cam portions 143*c* oppose the upright portion 121*a* of the mount base 121 and are equally spaced apart from each other in the circumferential direction. In this configuration, three corresponding cam portions 143*d* are formed on the surface of the upright portion 121*a* of the mount base 121 to oppose the cam portions 143*a*. The cam portions 143*d* are equally spaced apart from each other in the circumferential direction.

As the operation lever 143 is rotated in a clockwise direction towards a lock position (as indicated by the arrows in FIG. 40), the cam portions 143*c* of the flange 143*a* contact or interact on the cam portions 143*d* of the upright portion 121*a*. The flange 143*a* is forced to move away from the upright portion 121*a* in the left direction, as viewed in FIG. 37. Therefore, die threaded shaft 141 moves leftward together with the flange 143*a* so that the holder plate 131 correspondingly moves leftward towards the upright portion 121*a*, against the biasing force of the spring 142. As a result, the base portion L5*a* of the riving knife L5 may be clamped between the upright portion 121*a* and the holder plate 131 and may be prevented or inhibited from being removed from the mounting device 140.

In addition, as the operation lever 143 is rotated towards the lock position, the threaded shaft 141 moves relative to the operation lever 143 through threaded engagement with the threaded hole 143*b*. When the operation lever 143 reaches the lock position, the position of the threaded shaft 141 relative to the threaded hole 143*b* is locked due to the tightening of the connection. The base portion L5*a* of the riving knife L5 can consequently be securely held, clamped between the upright portion 121*a* and the holder plate 131.

When the operator rotates the operation lever 143 from a lock position to the unlock position in a counterclockwise direction (as viewed in FIG. 40), the tightening of the threaded shaft 141 is released, and the cam portions 143*c* of the flange 143*a* are shifted in the circumferential direction relative to the cam portions 143*d* of the upright portion 121*a*. As a result, the cam portions 143*c* are disengaged from the cam portions 143*d*. Consequently, the flange 143*a* and the threaded shaft 141 may be permitted to move rightward, as viewed in FIG. 37. Due to the biasing force of the compression spring 142, the holder plate 131 moves in a direction away from the upright portion 121*a*. The clamping force applied to the base portion L5*a* of the riving knife L5 is released, permitting removal of the riving knife L5 from the mounting device 140.

As described above, accenting to the ninth representative embodiment, the riving knife L5 can be easily mounted to and removed from the mounting device 140 by rotating the operation lever 143.

The ninth representative embodiment may be modified in various ways. For example, although three cam portions 143*c* and three cam portions 143*d* are provided, two or four cam portions 143*c* or 143*d* may be provided so as to be equally spaced apart in the circumferential direction.

Further, although the threaded shaft 141 is prevented from rotating relative to the holder plate 131 through the engagement of the hexagonal head 141*a*, the threaded shaft 141 may be fixed to the holder plate 131 by welding. In such a case the threaded shaft 141 may be a stud bolt that has a threaded portion that is formed along only a part of the length of the stud bolt for engaging the threaded hole 143*b* of the flange 143*a*.

Furthermore, although the same holder plate 131 used in the eighth representative embodiment has been used in the ninth representative embodiment, the holder plans 122 of the seventh representative embodiment may also be used. With this configuration, the riving knife L3 shown in FIG. 33 can be used in place of the riving knife L5 shown in FIG. 37.

Tenth Representative Embodiment

The tenth representative embodiment will now be described with reference to FIGS. 41 to 44. In this representative embodiment, like members are given the same reference numerals as in the previous representative embodiments, and the description of these members may not be repeated.

In this representative embodiment, a mounting device 150 is adapted to mount a riving knife L6. The riving knife L6 has a base portion Loa with a circular mount slot L6*b*. The mounting device ISO has a mount base 151 and a holder plate 152. The holder plate 152 is fixed to an upright portion 151*a* of the mount base 151 by, for example, four bolts 153. A mount recess 154 is defined between the upright portion 151*a* of the mount base 151 and the holder plate 152 in order to permit the insertion of the base portion L6*a* of the riving knife L6. The mount base 151 is fixed to the extension 105*a* of the mount 105 of the table saw by, for example, bolts 159.

A lock pin 155 is axially slidably inserted into a central portion of the upright portion 151*a* of the mount base 151. The lock pin 155 extends through the upright portion 151*a* in the direction of thickness. A compression coil spring 158 is interposed between the lock pin 155 and the upright portion 151*a* so mat the lock pin 155 is biased towards a lock position. The lock position is where the front end 155*a* (i.e., the right end as viewed in FIG. 41) of the lock pin 155 extends into the mount recess 154 and abuts the holder plate 152. The rear end of the lock pin 155 extends leftward beyond the upright portion 151*a*. A fiat operation plate 157 is vertically pivotally mounted to the rear end of the lock pin 155 via a support pin 156. An insertion hole 157*b* is formed in a central portion of the operation plate 157. Two support tabs 157*a* are formed on the operation plate 157 and are positioned on two sides of the insertion hole 157*b* (i.e., in a diametrical direction). The support tabs 157*a* extend perpendicular to the surface of the operation plate 157. Opposite ends of the support pin 156 are rotatably supported by the support tabs 157*a*. Therefore, the rear end of the lock pin 155 is inserted into the insertion hole 157*a* of the operation plate 157 so as to extend though the insertion plans 157. The rear end of the lock pin 155 is connected to the support pin 156 so that the lock pin 155 is joined to substantially the central portion of the operation plate 157.

Figure 44:
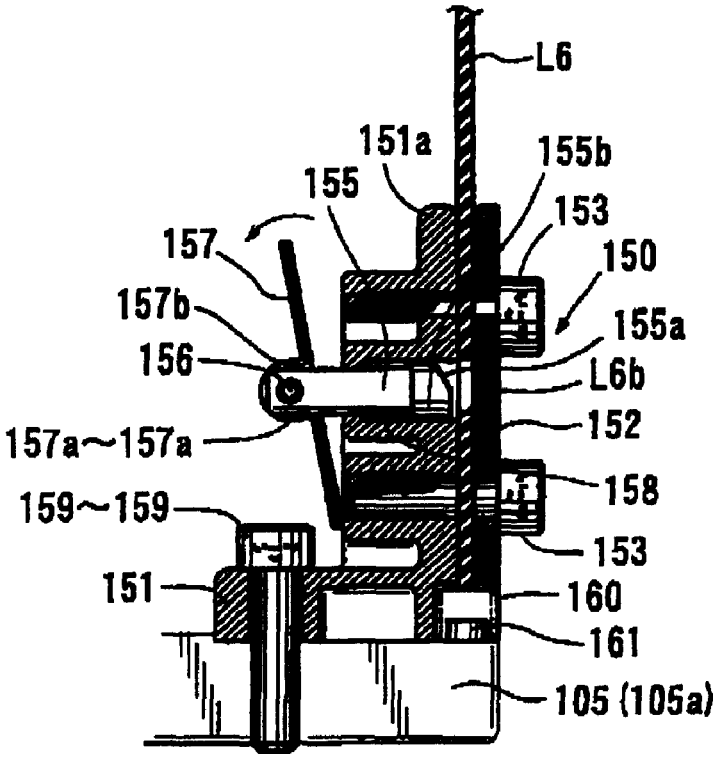
FIG. 44 is a cross-sectional view similar to FIG. 41 but showing the state where an operation plate has been inclined towards an unlock position.

With this arrangement, when the operator pulls an upper portion of the operation plate 157 leftward as shown in FIG. 44, the operation plate 157 may pivot about a lower end of the operation plate 157 that contacts the left surface of the upright portion 151*a*. Therefore, the lock pin 155 moves leftward towards an unlock position. The unlock position is where the front end 155*b* is withdrawn from the mount recess 154.

An inclined surface 155*a* is formed on the front end 155*b* of the lock pin 155. When the lock pin 155 is in a lock position, where the front end 155*b* is positioned within the mount recess 154, the lower end of the base portion L6*a* may contact with the inclined surface 155*a* of the front end 155*b* of the lock pin 155 as the base portion L6*a* of the riving knife L6 is moved downward into the mount recess 154. As the base portion L6*a* is force to move further downward, the lower end of the base portion L6*a* may interact with the inclined surface 155*a* to move the lock pin 155 towards the unlock position against the biasing force of the spring 158. When the mount slot L6*b* of the base portion L6*a* is positioned so as to oppose the front end 155*b* of the lock pin 155 (i.e., the mount slot L6*b* is aligned with the axis of the lock pin 155), the lock pin 155 may move due to the biasing force of the spring 158 to the lock position, where the front end 155*b* enters and engages the mount slot L6*b*.

Figure 43:
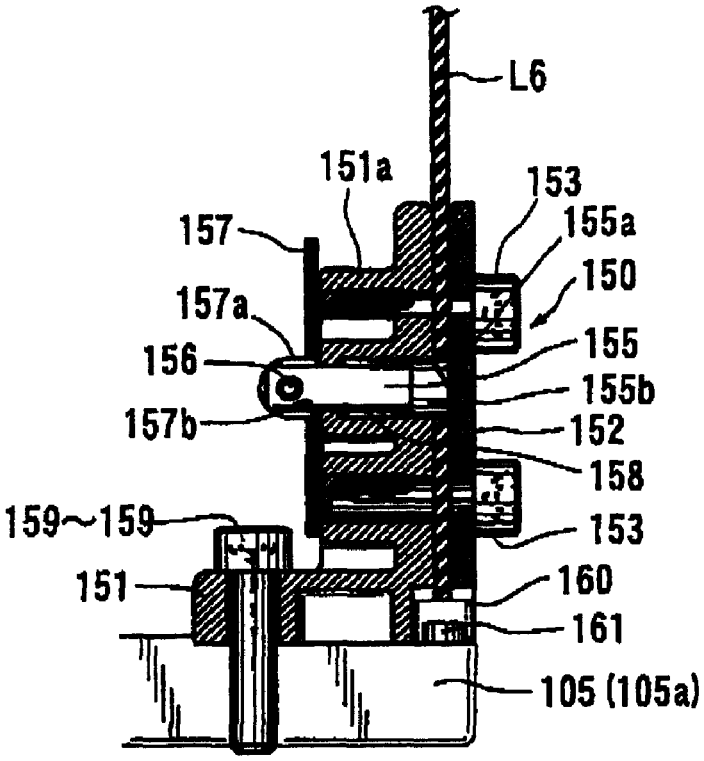
FIG. 43 is a cross-sectional view similar to FIG. 41 but showing the state where the riving knife has been mounted.

A compression spring 160 is mounted within the bottom of the mount base 151 and is positioned at the bottom of the mount recess 154, opposing the lower end of the base portion L6*a* of the riving knife L6. The lower portion of the spring 160 is fitted on a boss 161 formed on the surface of the mount 105 of the table saw so that the spring 160 is prevented from being displaced from the bottom of the mount recess 154. As shown in FIG. 43, the spring 160 may be compressed by the lower end of the base portion L6*a* of the riving knife L6 when the base portion L6*a* has been inserted into the mount recess 154 and the lock pin 155 enters the mount slot L6*b*. Therefore, the lower edge of the mount slot L6*b* may be pressed against the circumference of the front end 155*b* of the lock pin 155. Consequently, the base portion L6*a* may be prevented or inhibited from moving within the mount recess 154.

According to the tenth representative embodiment described above, when the riving knife L6 is not inserted within the mount recess 154, the front end 155*b* of the lock pin 155 extends into the mount recess 154 and abuts the holder plate 152. When the base portion L6*a* of the riving knife L6 is inserted within the mount recess 154, the lower end of the base portion L6*a* contacts the inclined surface 154*a* of the front end 155*b* of the lock pin 155. As the base portion L6*a* is inserted further, the front end 155*b* of the lock pin 155 is moved away from the mount recess 154. The base portion L6*a* is inserted until the base portion L6*a* compresses the spring 160 and the mount slot L6*b* is positioned to oppose the front end 155*b* of the lock pin 153. The front end 155*b* of the lock pin 155 then enters and engages the mount slot L6*b* as a result of the biasing force of the spring 158, as shown in FIG. 43.

Due to the engagement of the mount slot L6*b* by the front end 155*b* of the lock pin 155, the base portion L6*a* may be locked so as to not be inadvertently removable from the mount recess 154. Consequently, the riving knife L6 can be firmly mounted to the mounting device 150.

In order to remove the riving knife L6, the operator may grip and pull the upper portion of the operation plate 157 leftward as indicated by an arrow in FIG. 44. The operation plate 157 may then pivot in a counterclockwise direction about its lower end. As the operation plate 157 pivots in the counterclockwise direction, the lock pin 155 moves from a lock position to an unlock position. Specifically, the front end 155*b* of the lock pin 155 is withdrawn from die mount slot L6*b* of the riving knife L6. Therefore, the base portion L6*a* of the riving knife L6 can be removed from the mount recess 154 and the riving knife L6 can be removed from the mounting device 150. Further, as the front end 155*b* of the lock pin 155 is removed from the mount slot L6*b*, the base portion L6*a* may be moved upward or moved in the removing direction by a little distance by the force of the compression spring 160.

Figure 41:
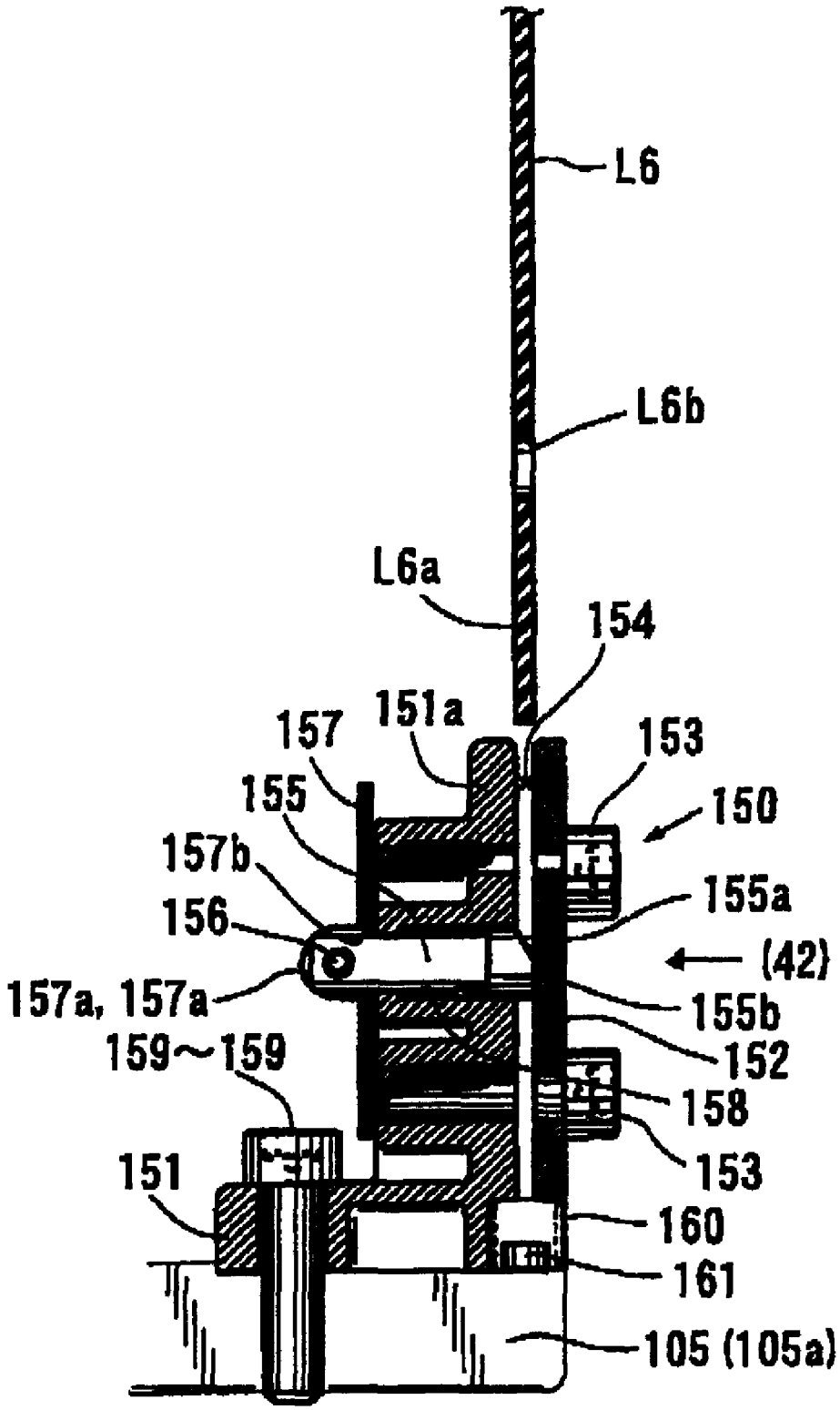
FIG. 41 is a vertical cross-sectional view of a mounting device for mounting a riving knife according to a tenth representative embodiment.
Figure 42:
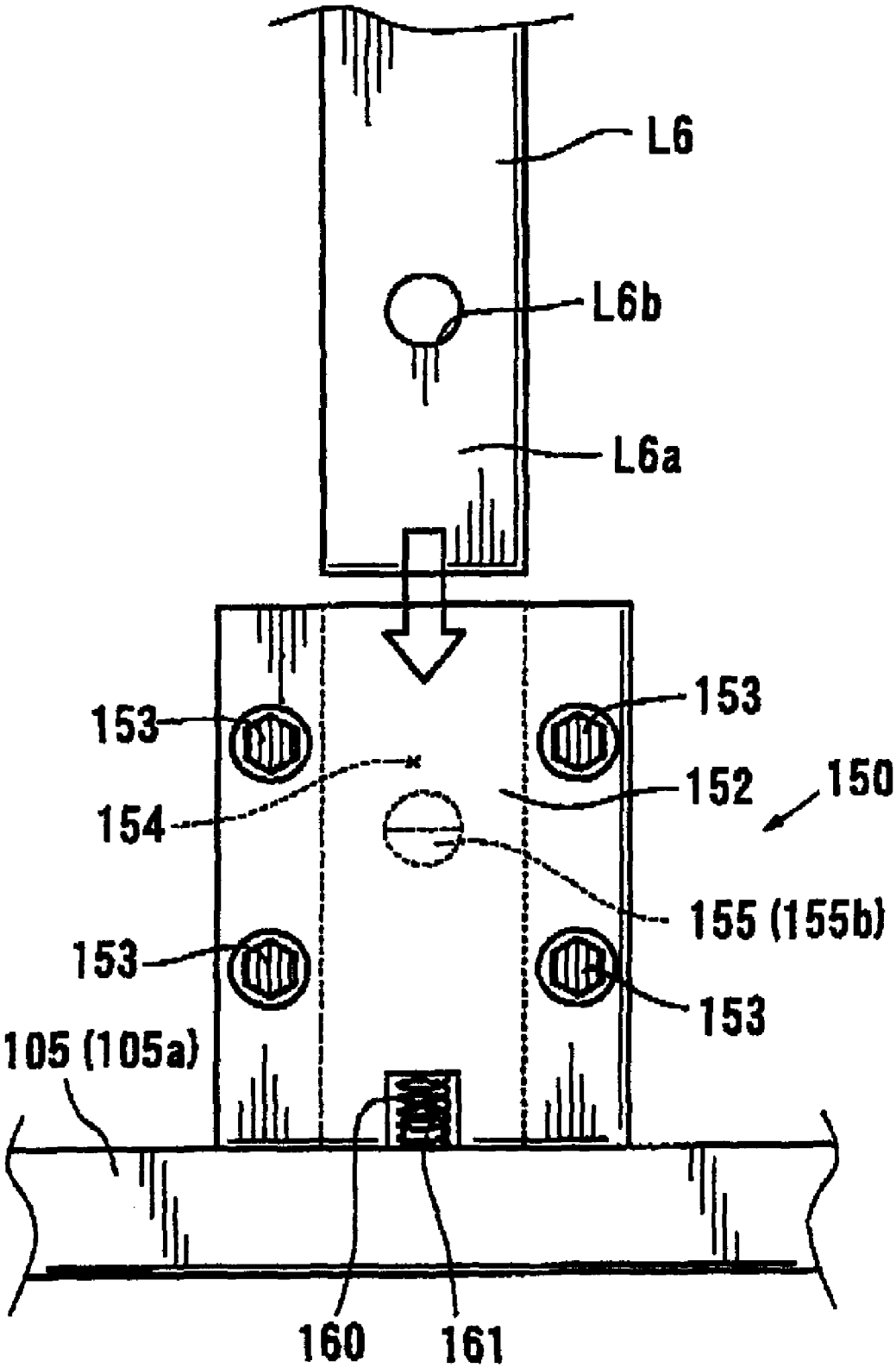
FIG. 42 is a view of the mounting device as viewed in the direction of arrow (42) in FIG. 41.

After the riving knife L6 has been removed from the mount recess 154, the operator may release the operation plate 157 so that the operation plate 157 and the lock pin 155 return to their original positions shown in FIG. 41. Specifically, the operation plate 157 is positioned to extend along the left surface of the upright portion 151*a* and the lock pin 155 is in a lock position. Even if the operator releases the operation plate 157 prior to attempting to remove the riving knife L6, the front end 155*b* of the lock pin 155 may not automatically re-engage with the mount slot L6*b* because the riving knife L6 has been slightly moved upward by the biasing force of the spring 160.

As described above, with the tenth representative embodiment the riving knife L6 can be easily and rapidly mounted to and removed from the mounting device 150 by the operation of the operation plate 157. Therefore, the cutting operation of a workpiece can be efficiently performed.

In particular, according to the tenth representative embodiment, the riving knife L6 can be mounted to the mounting device 150 by simply inserting the riving knife L6 into the mount recess 154. This feature can be incorporated into the sixth representative embodiment shown in FIGS. 21 to 25. By suitably setting the tapered angle and the configuration of the tapered portion 116*c* of the lock pin 116, the lower end of the base portion L2*a* of the riving knife L1 may contact and interact with the tapered portion 116*c* to move the lock pin 116 towards an unlock position. Therefore, the lock pin 116 can lock the riving knife L1 by simply inserting the riving knife L1 into the mount recess 113.

Eleventh Representative Embodiment

Figure 45:
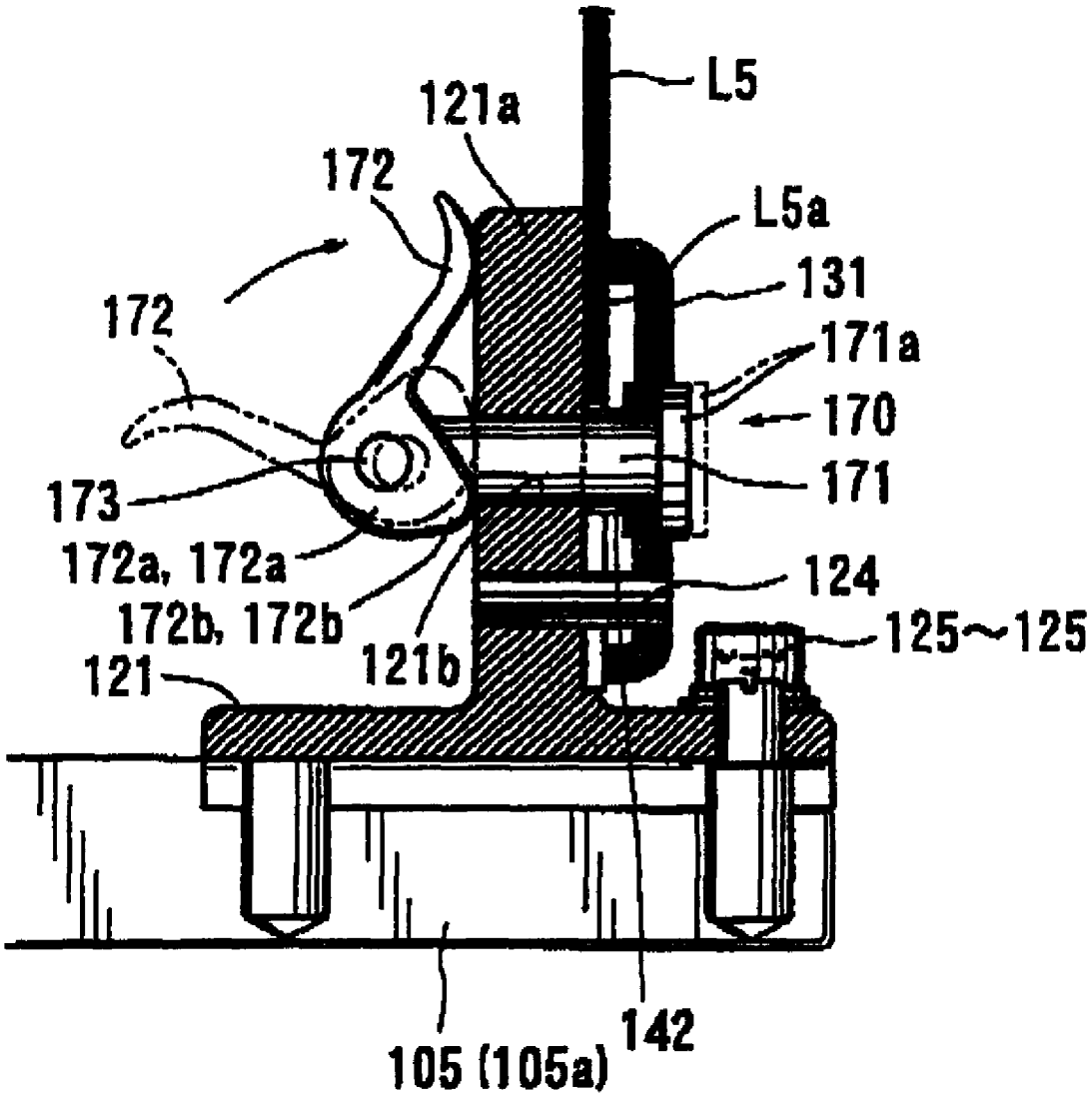
FIG. 45 is a vertical cross sectional view of a mounting device for mounting a riving knife according to an eleventh representative embodiment.

The eleventh representative embodiment will now be described with reference to FIG. 45. This representative embodiment is a modification of the ninth representative embodiment. Therefore, like members are given the same reference numerals as in the ninth representative embodiment and the description of these members may not be repeated.

A mounting device 170 of the eleventh representative embodiment differs from the mounting device 140 of the ninth representative embodiment in that the threaded shaft 141 and die operation lever 143 are replaced with different elements. In other respects, the construction of the mounting device 170 is the same as the mounting device 140.

The mounting device 170 includes a lock pin 171 in place of the threaded shaft 141. The lock pin 171 is slidably (i.e., axially movable) inserted into a central portion of the upright portion 121*a* of the mount base 121 and into a central portion of the holder plate 131. The holder plate 131 opposes the upright portion 121*a*. A flange 171*a* is formed on the right end (as viewed in FIG. 45) of the lock pin 171. Similar to the ninth representative embodiment, a compression coil spring 142 is interposed between the holder plate 131 and the upright portion 121*a*. As a result, the holder plate 131 is pressed against the flange 171*a* due to the biasing force of the spring 142 so that the lock pin 171 is biased rightward (as viewed in FIG. 45) towards an unlock position.

The left end of the lock pin 171 extends outward from the upright portion 121*a*. An operation lever 172 is mounted to the left end of the lock pin 171. More specifically, one end of the operation lever 172 is bifurcated to form a pair of support tabs 172*a*. The left end of the lock pin 171 is inserted between the support tabs 172*a* and is pivotally joined to the support tabs 172*a* via a support pin 173. The support pin 173 extends diametrically through the left end of the lock pin 171. In the ninth representative embodiment, the operation lever 143 is rotated about the threaded shaft 141. Alternately, in the eleventh representative embodiment, the operation lever 172 is pivoted relative to the lock pin 171.

A cam 172*b* for contacting with the left surface of the upright portion 121*a* of the mount base 121 is formed along the circumference of each support tab 172 within a predetermined range. A cam 172*b* extends radially outward from each support tab 172 about the pivotal axis, i.e., the support pin 173.

According to the eleventh representative embodiment described above, as the operation lever 172 is pivoted from an unlock position (indicated by chain fines in FIG. 45) to a lock position (indicated by solid lines), the cam 172*b* of each support tab 172 interacts with the surface of the upright portion 121*a*. The lock pin 171 consequently moves leftward against the biasing force of the spring 142 to clamp the base portion L5*a* of the riving knife L5 between the upright portion 121*a* and the holder plate 131.

Conversely, as the operation lever 172 is pivoted from a lock position to the unlock position, the cam 172*b* of each support tab 172 may have diminishing interaction with the surface of the upright portion 121*a*. The biasing force of the spring 142 may press the remaining portions of each support tab 172, which have a smaller diameter than the cam 172*b*, against the surface of the upright portion 121*a*. Therefore, the lock pin 171 may be moved rightward so that the holder plate 131 may move away from the upright portion 121. As a result, the riving knife L5 can be removed from the mounting device 170.

In this way, with the eleventh representative embodiment the riving knife L5 can be easily mounted to and removed from the mounting device 170 by the pivoting operation of the operation lever 172.

Twelfth Representative Embodiment

The twelfth representative embodiment will now be described with reference to FIGS. 46 and 47. This representative embodiment relates to a riving knife that is applicable to a table saw as described in connection with the known table saw, such as the known table saw shown in FIG. 55. However, a table saw directly applicable to the riving knife of this representative embodiment will be briefly described with reference to FIG. 46.

Figure 46:
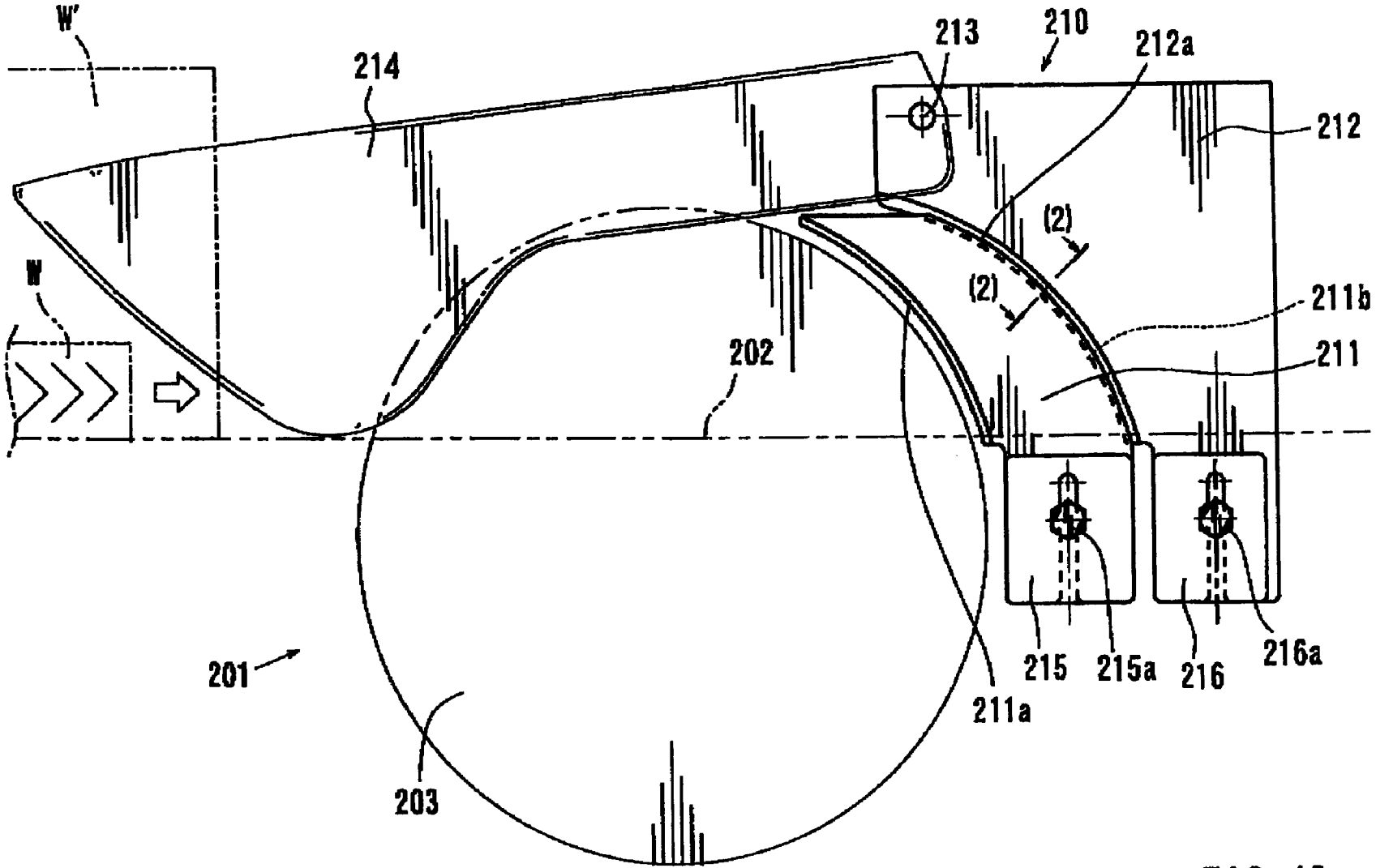
FIG. 46 is a side view of a table saw incorporating a riving knife according to a twelfth representative embodiment.
Figure 47:
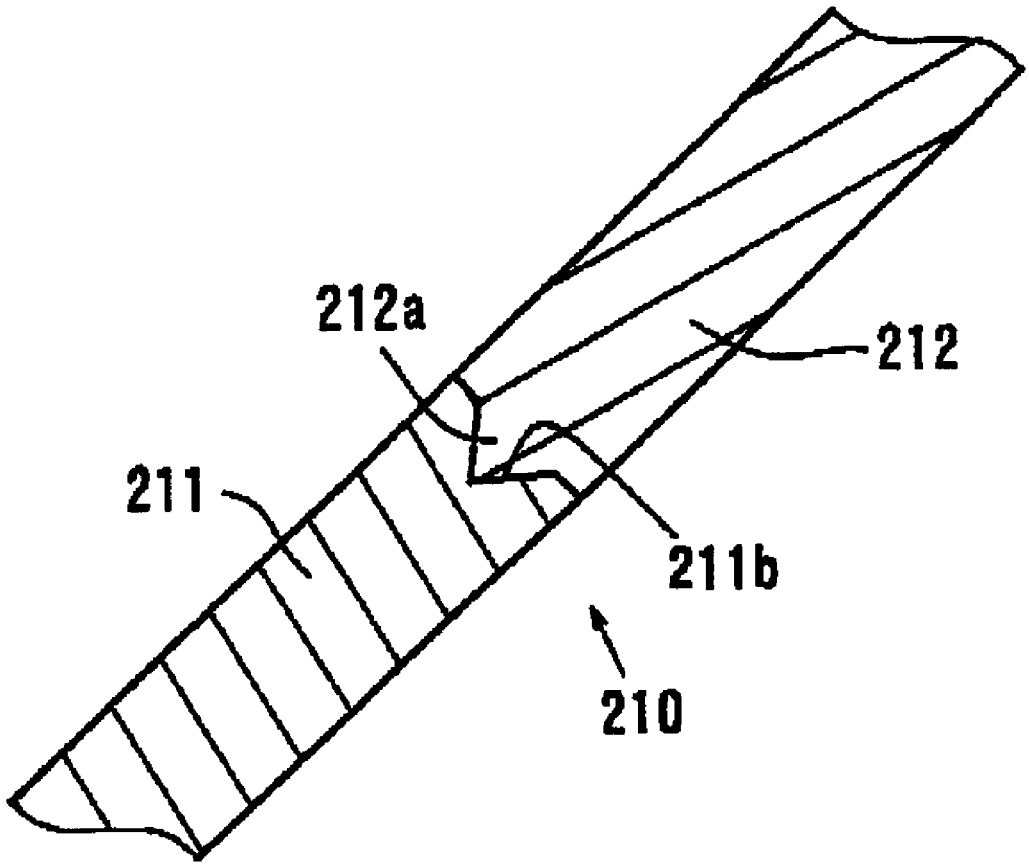
FIG. 47 is a cross sectional view taken along line (47)-47) in FIG. 46 and showing the state where an engaging recess is formed in a first knife portion and engages with an engaging projection formed on a second knife portion.

Referring to FIG. 46, a table saw 201 generally has a table 202 and a circular saw blade or a cutting blade 203. A riving knife 210, according to the twelfth representative embodiment, is positioned on the right side of the cutting blade 203 (as viewed in FIG. 46). The vertical position of the cutting blade 203 and the riving knife 210 is set such that the upper portions of the cutting blade 203 and the riving knife 210 extend above the surface of the table 202. The cutting blade 203 and the riving knife 201 may be mounted to a mount (not shown in FIG. 46 but corresponding to the mount 305 shown in FIG. 55) disposed below the table 202. The vertical position of the mount may be adjusted to vary the extending distance of the cutting blade 203 and the riving knife 210 above the surface of the table 202 in order to enable the adjustment of the cutting depth of the workpiece W. The cutting blade 203 may be rotatably driven by an electric motor (not shown) mounted to the mount.

In order to cut the workpiece W, the workpiece W is moved from the left side to the right side along the table 202, as indicated by an arrow in FIG. 46. Therefore, in this, representative embodiment, in order to indicate the front side and the rear side of the elements of the riving knife 202, the right side as viewed in FIG. 46 will be referred to as the "rear side", and the left side as viewed in FIG. 46 will be referred to as the "front side."

As shown in FIG. 46, the riving knife 210 includes a first knife portion 211 and a second knife portion 212, respectively positioned to the rear of the cutting blade 203. The first knife portion 211 is located in front of the second knife portion 212. In addition, the first knife portion 211 is separated from the second knife portion 212. The thickness of the first knife portion 211 is substantially equal to the thickness of the second knife portion 212, and both portions are substantially equal to the thickness of the cutting blade 203.

The first knife portion 211 is mounted to a first bracket 215 by, for example, a bolt 215*a*. The second knife portion 212 is mounted to a second bracket 216 by, for example, a bolt 216*a*. The brackets 215 and 216 may be further mounted to the mount disposed below the table 202 and described above (i.e., corresponding to mount 305 of FIG. 55). Therefore, the first knife portion 211 and the second knife portion 212 can be removed from the table saw 201 by releasing the bolts 215*a* and 216*a*. The height of the first knife portion 211 above the surface of die table 202 may be equal to or slightly lower than the height of the cutting blade 203 above the surface of the table 202. The height of the second knife portion 212 above the surface of the table 202 may be higher than the height of the cutting blade 203 and the height of the first knife portion 211 above the surface of the table 202. A cover 214 is vertically pivotally mounted to an upper portion of the second knife portion 212 via a support pin 213 so that the cover 214 can open and close, exposing the upper portion of the cutting blade 203.

The front edge of the first knife portion 211 is pointed to have a substantially V-shaped cross-section along the entire length of the front edge. As a result, the first knife portion 211 can smoothly enter a split that may be formed during the cutting operation of the workpiece W.

The rear edge of the first knife portion 211 is configured to have an engaging recess 211*b* that extends along the entire length of the rear edge. The engaging recess 211*b* has a substantially V-shaped cross-section as shown in FIG. 47. Correspondingly, similar to the front edge of the first knife portion 211, the front edge of the second knife portion 212 is pointed to form an engaging projection 212*a* that extends along the entire length of the front edge. The engaging projection 212*a* has a substantially V-shaped cross-section as shown in FIG. 47 conforming to the configuration of the engaging recess 211*b* of the first knife portion 211. Consequently, the engaging projection 211*b* is engageable with the engaging recess 212*a*, as shown in FIG. 47.

Due to engagement between the engaging projection 212*a* of the second knife portion 212 and the engaging recess 211*b* of the first knife portion 211, the first knife portion 211 and the second knife portion 212 can be reliably positioned relative to each other in the direction of thickness of these portions. In other words, the first knife portion 211 and the second knife portion 212 may be reliably positioned within the same plane.

According to the riving knife 210 configured as described above, the first knife portion 211 and the second knife portion 212 may be set as shown in FIG. 46 in order to perform a normal cutting operation to split a workpiece W into two parts with the cutting blade 203 covered with the cover 214. As described above, the first knife portion 211 and the second knife portion 212 are positioned within the same plane through engagement between the engaging recess 211*b* and the engaging projection 212*a* provided on opposing edges of the first knife portion 211 and the second knife portion 212. Therefore, during a cutting operation, the riving knife 210 may function like a riving knife made of a single flat plate of material. In the known riving knifes divided into two knife portions, there exists a possibility that the knife portions are offset from each other in the direction of thickness. The riving knife 210 of this representative embodiment eliminates or minimizes the potential offset between the first knife portion 211 and the second knife portion 212. Consequently, the cutting operation can be smoothly performed.

If it is necessary to remove the cover 214 in order to perform a groove farming operation of a workpiece W having a thickness higher than the height of the cutting blade 203 above the surface of the table 202, the second knife portion 212 may be removed together with the cover 214. The groove forming operation can then be performed with the aid of the remaining first knife portion 211.

Thirteenth Representative Embodiment

The thirteenth representative embodiment win now be described with reference to FIGS. 48 and 49. This representative embodiment differs from the twelfth representative embodiment in the configuration for positioning the first knife portion and the second knife portion relative to each other. Therefore, like members are given the same reference numerals as in the twelfth representative embodiment and the description of these members will not be repeated A riving knife 220 according to the thirteenth representative embodiment is also divided into a first knife portion 221 and a second knife portion 222. The first knife portion 221 is mounted to a first bracket 225 by, for example, a bolt 225*a*. The second knife portion 222 is mounted to a second bracket 226 by, for example, a bolt 226*a*. The brackets 225 and 226 may be further mounted to another mount (i.e., corresponding to mount 305 shown in FIG. 55) disposed below the table 202. Therefore, the first knife portion 221 and the second knife portion 222 can be removed from the table saw by releasing the bolts 225*a* and 226*a*.

Similar to the twelfth representative embodiment, the front edge of the first knife portion 221 (i.e., nearest to the cutting blade 203) is configured as a guide edge 221*a*, pointed to have a substantially V-shaped cross section along the entire length of the front edge. As a result, the first knife portion 221 can smoothly enter a split that may be formed during a cutting operation of the workpiece W.

A support pin 224 is inserted into the first knife portion 221 in a position below the surface of the table 202. The support pin 224 extends in the direction of thickness of the first knife portion 221. Two elongated positioning members 223 (only one positioning member 223 is shown in the drawings) are disposed along both lateral sides of the first knife portion 221. The petitioning members 223 have lower ends that are fixedly joined to opposite ends of the support pin 224. For example, the support pin 224 may be a threaded screw so that the lower ends of the positioning members 223 may be fixed in position relative to the support pin 224 by tightening a nut against the screw. Therefore, the positioning members 223 may pivot together with each other and together with the support pin 224. A torsion spring 227 is interposed between one of the positioning members 223 and the lateral surface of the first knife portion 221. The torsion spring 227 biases the positioning members 223 in a counterclockwise direction, as viewed in FIG. 48.

The pivotal range of the rationing members 223 are limited by a stopper 228 mounted to the first knife portion 221. The position members 223 are not able to pivot beyond the vertical position indicated by the solid lines in FIG. 48.

Figure 48:
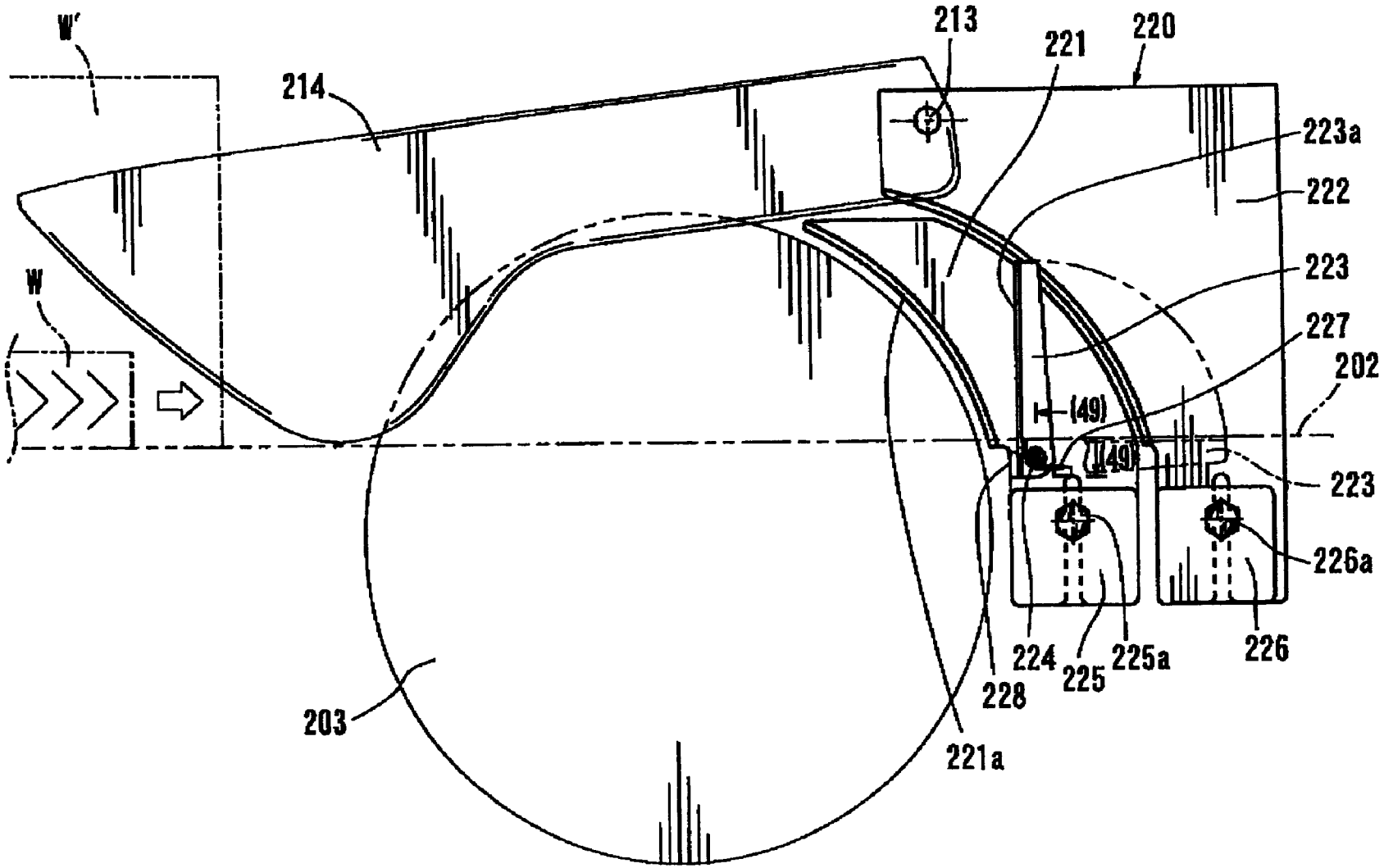
FIG. 48 is a side view of a table saw incorporating a riving knife according to a thirteenth representative embodiment.
Figure 49:
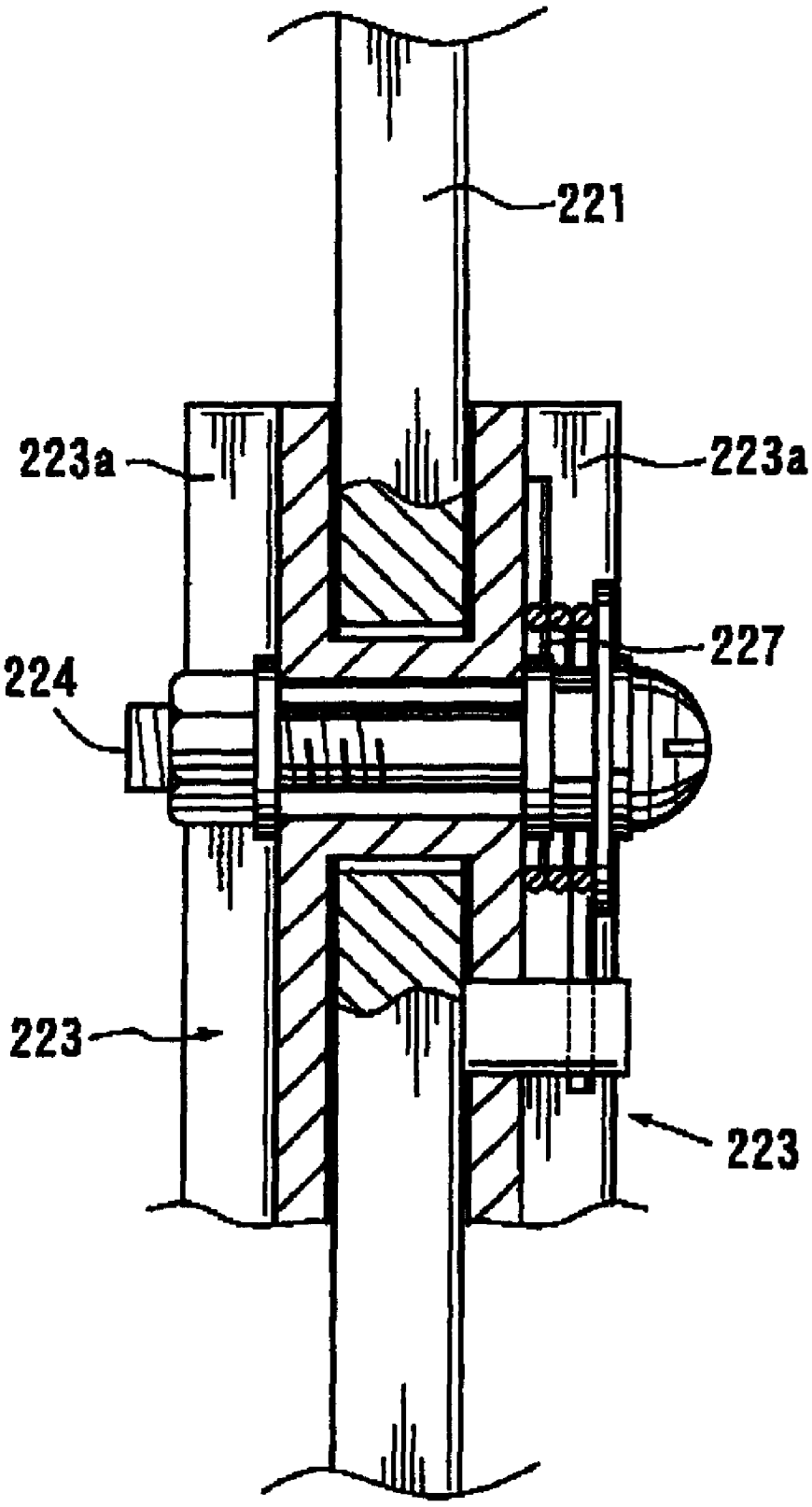
FIG. 49 is a partial cross-sectional view taken along line (49)-49) in FIG. 48 and showing the mounting structure of positioning members.

As the workpiece W is moved in the rightward direction during a cutting operation, as viewed in FIG. 48, the workpiece W may contact the positioning members 223. The contact with the workpiece W may cause the positioning members 223 to pivot from the vertical position in the clockwise direction against the biasing force of the torsion spring 227. In view of this function, a contact edge 223*a*, having a predetermined width, is formed on a side edge (i.e., the front edge) of each of the positioning members 223 and extends along the entire length of the side edge. Bending the side edge to have a substantially L-shaped cross-section may form the contact edge 223*a*. Since the workpiece W contacts with the positioning members 223 via the contact edges 223*a*, the petitioning members 223 reliably pivot as the workpiece W moves rightward. In addition, as the workpiece W moves rightward, the positioning members 223 may pivot from a vertical position to a substantially horizontal position. In other words, the pivotal range of the positioning members 223 is approximately 90°. The length of the portioning members 223 and the position of the support pin 224 are determined such that the radially outward portions of the positioning members 223 extend along the lateral surfaces of the second knife portion 222 during the pivotal movement of the positioning members 223 within the pivotal range. Consequently, the positioning members 223 may always extend between the first knife portion 221 and the second knife portion 222. In addition, the positioning members 223 may slidably contact with the lateral surfaces of the first knife portion 221 and the second knife portion 222. As a result, the first knife portion 221 and the second knife portion 222 may be reliably positioned substantially within a single plane. With this positioning, the first knife portion 221 and the second knife portion 222 may smoothly enter the split of the workpiece W as the workpiece W is moved in a cutting direction during the cutting operation. Therefore, the cutting operation can be smoothly and reliably performed.

Further, as the workpiece W moves in the cutting direction, the positioning members 223 may pivot from a vertical position to the horizontal position indicated by chain lines in FIG. 48, against the biasing force of the torsion spring 227. In the horizontal position, the positioning members 223 may be positioned entirely below or at least flush to the surface of the table 202. Therefore, the functioning of the positioning members 223 may not interfere with the movement of the workpiece W in the cutting direction. The cutting operation can also be smoothly performed in tins respect.

Fourteenth Representative Embodiment

The fourteenth representative embodiment will now be described with reference to FIG. 50. This embodiment differs from the thirteenth representative embodiment in the pivoting position of the positioning members. Therefore, like members are given the same reference numerals as in the thirteenth representative embodiment and the description of these members may not be repeated.

In this representative embodiment, a riving knife 230 is divided into a first knife portion 231 and a second knife portion 232, arranged along the cutting direction. The first knife portion 231 is mounted to a first bracket 235 by, for example, a bolt 235*a*. The second knife portion 232 is mounted to a second bracket 236 by, for example, a bolt 236*a*. The brackets 235 and 236 may be mounted to another mount (i.e., corresponding to mount 305 shown in FIG. 55) disposed below the table 202. Therefore, the first knife portion 231 and the second knife portion 232 can be removed from the table saw by releasing the bolts 235*a* and 236*a*.

Similar to the thirteenth representative embodiment, the front edge of the first knife portion 231, nearest to the cutting blade 203, is configured as a guide edge 231*a*. The guide edge 231*a* is pointed to have a substantially V-shaped cross-section along the entire length of the front edge. As a result, the first knife portion 231 can smoothly enter a split that may be formed during a cutting operation of the workpiece W.

The height of the first knife portion 231 above the surface of the table 202 is set to be equal to or slightly lower than the height of the cutting blade 203 above the surface of the table 202. The height of the second knife portion 232 above the surface of the table 202 is set to be higher than the height of the first knife portion 231 by a height H0. The cover 214 is vertically pivotally mounted to an upper portion of the second knife portion 232 via a support pin 213 (within the range of the height H0). The cover 214 can be removed from the table saw by removing the second knife portion 232 from the bracket 236 after loosening the bolt 236*a*.

Two positioning members 233 are pivotally mounted to the second knife portion 232 via a support pin 234 that is positioned within the range of the height H0, i.e., above the height of the first knife portion 231. The positioning members 233 extend along both lateral sides of the second knife portion 232. Similar to the thirteenth representative embodiment, the positioning members 233 pivot together with each other and the support pin 234. In addition, one of the positioning members 233 is biased in a clockwise direction by a torsion spring 237.

A stopper 238 is mounted on the second knife portion 232 and serves to limit the pivotal range in the clockwise direction of the positioning members 233. The position of the positioning members 233 at the limit of the pivotal movement in the clockwise direction is shown by solid lines in FIG. 50. In this position, the positioning members 233 extend from the lateral surfaces of the second knife portion 232 to the lateral surfaces of the first knife portion 231. In addition, the positioning members 233 slidably contact with the lateral surfaces of the second knife portion 232 and with the lateral surfaces of the first knife portion 231. Therefore, the first knife portion 231 and the second knife portion 322 are held substantially within the same plane.

The radially outer ends of the positioning members 233 are positioned at a height H1 above the surface of the table 202 when the positioning members 233 are positioned at the limit of the pivotal movement in the clockwise direction. Consequently, if the thickness of the workpiece W that will be cut is smaller than the height H1, the workpiece W may not interact with the positioning members 233 during the cutting operation. The positioning members 233 may hold the first knife portion 231 and the second knife portion 232 within the same plane whenever the thickness of the workpiece W is smaller than the height H1.

Conversely, if the thickness of the workpiece W is greater than the height H1, the front end of the workpiece W may contact with the positioning members 233 and pivot the portioning members 233 upward in the counterclockwise direction (as viewed in FIG. 50) against the biasing force of the spring 237. A contact edge 233*a* having a predetermined width is formed on a side edge (i.e., the front edge) of each of the positioning members 223 and extends along the entire length of the side edge. Bending the side edge to have a substantially L-shaped cross-section forms the contact edge 233*a*. Because the workpiece W contacts with the positioning members 233 via the contact edges 233*a*, the positioning members 233 can reliably pivot as the workpiece W moves rightward.

Figure 50:
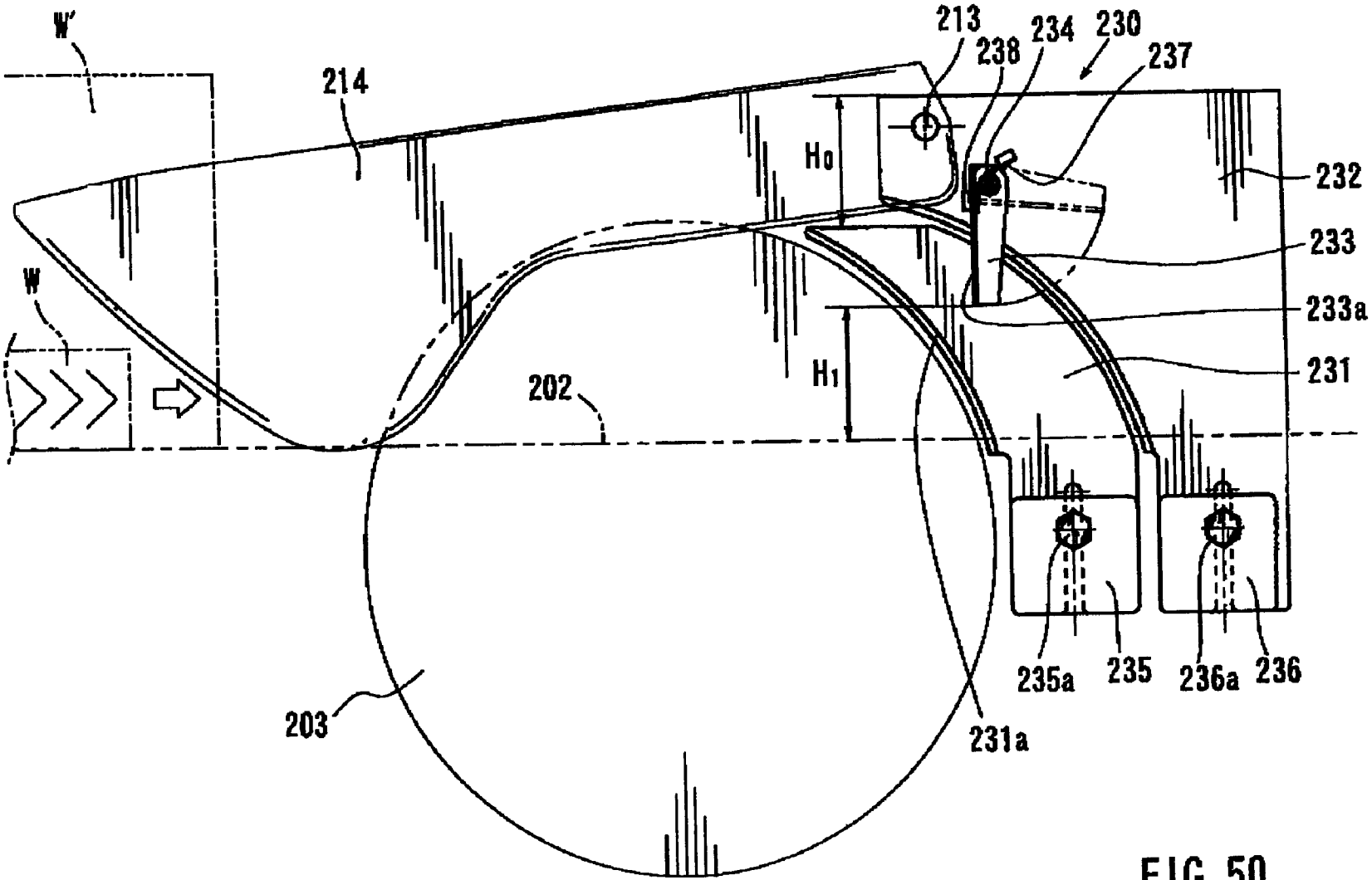
FIG. 50 is a side view of a table saw incorporating a riving knife according to a fourteenth representative embodiment.
Figure 51:
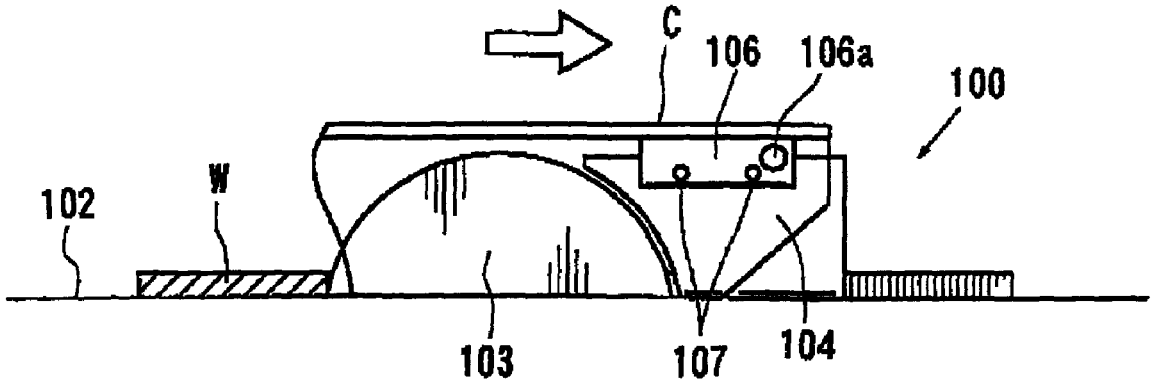
FIG. 51 PRIOR ART
FIG. 51 is a side view around a cutting blade of a known structure for mounting a cover to a table saw.
Figure 52:
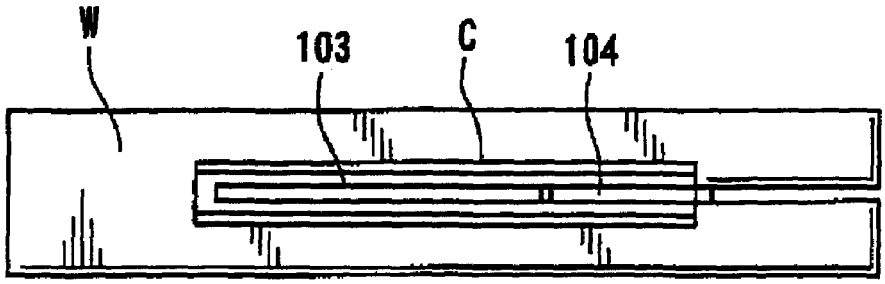
FIG. 52 PRIOR ART
FIG. 52 is a plan view around the cutting blade of the known mounting structure shown in FIG. 51.
Figure 53:
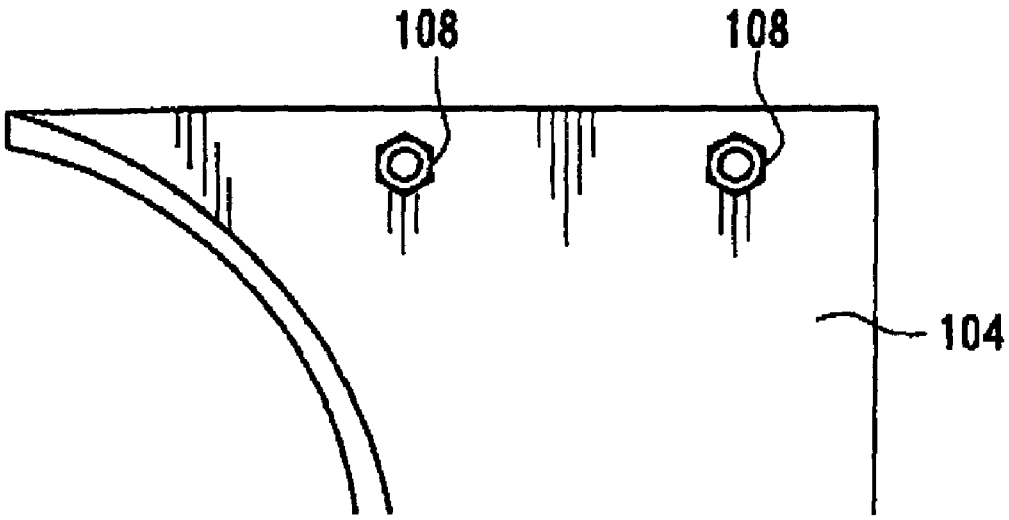
FIG. 53 PRIOR ART
FIG. 53 is a side view of a riving knife of a known mounting structure shown in FIG. 51.
Figure 54:
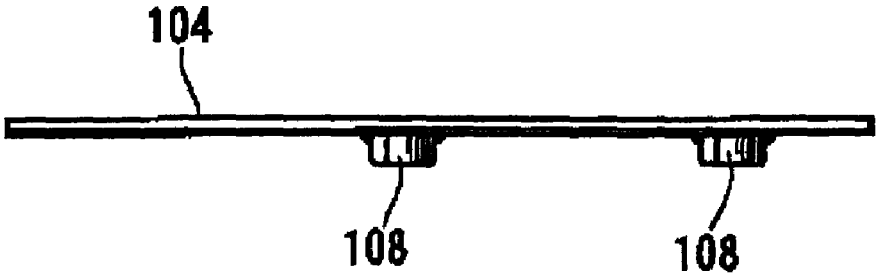
FIG. 54 PRIOR ART
FIG. 54 is a plan view of FIG. 53.

The positioning members 233 may pivot in the counterclockwise direction until they reach a substantially horizontal position, as indicated by chain lines in FIG. 50. In this position, the positioning members 233 are located along the lateral sides of the second knife portion 232 and within the range H0, which is higher than the upper end of the first knife portion 231. In view of this configuration, the positioning members 233 can pivot about 90° from a position indicated by solid lines in FIG. 50 to the position indicated by chain lines. Within a part of this pivotal range, the positioning members 233 may extend from the lateral surfaces of the second knife portion 232 to the lateral surfaces of the first knife portion 231. The positioning members 233 may slidably contact with these lateral surfaces. More specifically, at least until the beginning of the entrance of the second knife portion 232 into the split of the workpiece W formed during the cutting of the workpiece, the positioning members 233 are maintained in contact with both of the lateral surfaces of the first knife portion 231 and the second knife portion 232. As a result, the positioning members 233 are able to position the first knife portion 231 and the second knife portion 232 substantially within a single plane.

As described above, the riving knife 230 of the fourteenth representative embodiment is divided into a first knife portion 231 and a second knife portion 232 arranged along the cutting direction. The cover 214 is mounted to the second knife portion 232. Therefore, if removing the cover 214 is required in order to perform a groove forming operation, the operator may loosen the bolt 236*a* and remove the second knife portion 232 from the bracket 236. In this way, the cover 214 can be removed from the table saw.

In addition, because the first knife portion 231 and the second knife portion 232 can be positioned substantially within a single plane by the positioning members 233, the first knife portion 231 and the second knife portion 232 can smoothly enter a split formed in the workpiece W during a cutting operation. Therefore, the cutting operation can be smoothly and effectively performed.

Further, because the positioning members 233 are mounted to the upper portion of the second knife portion 232, the first knife portion 231 and the second knife portion 232 can reliably be positioned within the same plane by positioning members 233, as long as the workpiece W to be cut has a thickness equal to or smaller than a predetermined value (e.g., the Height H1). If the workpiece W to be cut has a thickness greater than the predetermined value, die positioning members 233 may be pressed by the front end of the workpiece and may subsequently pivot upward as the workpiece W moves in a cutting direction. The positioning members 233 can pivot to a position within the range of the height H1, which is higher than the upper end of the first knife portion 231. Therefore, a cutting operation can be performed without interference from the positioning members 233.

Although the twelfth to fourteenth representative embodiments have been described in connection with riving knives (210; 220; and 230) that are separated into two knife portions (211, 212; 221, 222; and 231, 232), these representative embodiments also may be applied to riving knifes that are divided into three or more knife portions in order to position the various knife portions substantially within a single plane.

Further, it is possible to combine two or more of the twelfth to fourteenth representative embodiments.

What is claimed is:

1. A combination comprising a riving knife and a mounting device for mounting a cover of a cutting blade to the riving knife, wherein the mounting device comprises:

a support member arranged and constructed to support the cover;

a pair of resiliently deformable plates having outer walls with a plurality of pressing projections formed thereon, the pair of plates coupled to the support member and defining an insertion recess therebetween for permitting insertion of a part of the riving knife having an engaging hole; and an operation device comprising a lever pivotable relative to the support member, the lever engaging the pressing projections to urge the pair of plates to narrow a distance between the pair of plates, wherein the plates have inner walls opposed to each other and have projections formed thereon; and wherein the projections on the inner walls engage the engaging hole of the riving knife from opposite sides of the engaging hole.

2. The combination as in claim 1, wherein a plurality of the projections are formed on each of the inner walls of the plates and are spaced from each other, and a plurality of the engaging holes are formed in the part of the riving knife for engaging with the corresponding projections.

3. The combination as in claim 1, wherein the support member is an intermediate plate held between the pair of plates.

4. A combination comprising a riving knife and a device for mounting a cover of a cutting blade to the riving knife, wherein the riving knife has an upper edge, a rear edge, and a cavity formed in at least a part of the riving knife; and wherein the mounting device comprises:

a support member arranged and constructed to support the cover, a lever mounted to the support member and operable between a mounting position and a releasing position, and an engaging member comprising a pair of resiliently deformable plates defining an insertion recess therebetween, the insertion recess having a width for permitting insertion of a part of the riving knife, wherein the resiliently deformable plates of the engaging member have outer walls, and are resiliently deformed to narrow the width of the insertion recess so as to clamp the part of the riving knife therebetween when the lever is operated to the mounting position, wherein pressing projections are formed on the outer walls, so that the lever engages with the pressing projections to urge the resiliently deformable plates to narrow a width of the insertion recess, when the lever has been moved to the mounting position, and wherein the engaging member is coupled to the support member and arranged and constructed to releasably engage the cavity formed in the riving knife.

5. The combination as in claim 4, wherein the resiliently deformable plates have inner walls opposing to both sides of the riving knife, and wherein projections formed on the inner walls of the resiliently deformable plates engage corresponding engaging holes formed in the riving knife.

6. A table saw comprising the combination of the riving knife and the mounting device as defined in claim 4 and further comprising a table for placing thereon a workpiece, so that the workpiece is cut by the cutting blade as the workpiece is moved along the table, wherein the riving knife is positioned on the rear side of the cutting blade substantially within the same plane as the cutting blade.

* * * * *